US011946266B2

(12) United States Patent
Boyce et al.

(10) Patent No.: US 11,946,266 B2
(45) Date of Patent: Apr. 2, 2024

(54) CEMENT FORM WITH BRICK LEDGE

(71) Applicant: Mono Slab EZ Form LLC, Island Park, ID (US)

(72) Inventors: Lance N. Boyce, Island Park, ID (US); Amber C. Boyce, Island Park, ID (US)

(73) Assignee: MONO SLAB EZ FORM LLC, Island Park, ID (US)

( * ) Notice: Subject to any disclaimer, the term of this patent is extended or adjusted under 35 U.S.C. 154(b) by 0 days.

(21) Appl. No.: 17/302,584

(22) Filed: May 6, 2021

(65) Prior Publication Data

US 2021/0348401 A1 Nov. 11, 2021

Related U.S. Application Data

(60) Provisional application No. 63/021,221, filed on May 7, 2020.

(51) Int. Cl.
*E04G 15/06* (2006.01)
*E02D 27/01* (2006.01)
(Continued)

(52) U.S. Cl.
CPC ..... *E04G 15/061* (2013.01); *E02D 27/013* (2013.01); *E04G 11/52* (2013.01); *E04G 17/14* (2013.01)

(58) Field of Classification Search
CPC ..... E04G 17/14; E04G 15/00; E04G 15/06; E04G 15/061; E04G 15/068; E04G 11/52;
(Continued)

(56) References Cited

U.S. PATENT DOCUMENTS 1,142,887 A * 6/1915 Keenen ..... E04G 13/00 249/34
1,527,698 A 2/1925 Pearthree
(Continued)

FOREIGN PATENT DOCUMENTS

CA 2396293 A1 * 1/2003 ..... E04G 13/00
CA 2984737 A1 * 5/2019 ..... E04G 13/00
(Continued)

OTHER PUBLICATIONS

Product Book 2014, Dee Concrete Accessories II, Division of Tesko Enterprises, Norridge, IL (28 pp.).
(Continued)

*Primary Examiner* — Michael Safavi
(74) *Attorney, Agent, or Firm* — HOLLAND & HART LLP

(57) ABSTRACT

A cement form can be made of foam and include a brick ledge portion that forms a brick ledge in a cement foundation. In some embodiments, the cement form includes a ground facing surface extending horizontally and configured to contact a ground surface and a cement facing surface extending vertically and configured to contact and support a volume of cement used to create the cement foundation. The cement facing surface can include two vertical surfaces offset horizontally from each other and configured to form a brick ledge in the cement foundation. The cement form can be a single unitary component having an elongated shape and a solid, continuous construction. The foam material can form at least a portion of the cement facing surface.

17 Claims, 32 Drawing Sheets

(51) Int. Cl.
*E04G 11/52* (2006.01)
*E04G 17/14* (2006.01)

(58) Field of Classification Search
CPC ..... E02D 27/013; E01C 19/50; E01C 19/502; E01C 19/504; E01C 19/506
USPC ..... 249/34; 52/699
See application file for complete search history.

(56) References Cited

U.S. PATENT DOCUMENTS 1,682,008 A 8/1928 Heltzel
1,944,511 A 1/1934 Heltzel
2,535,277 A * 12/1950 Fama ..... E04G 11/10 249/34
2,614,311 A * 10/1952 Shook ..... E04G 13/00 249/34
2,678,482 A 5/1954 Cuthbertson et al.
2,835,017 A 5/1958 Hoerr
2,845,684 A * 8/1958 Bell ..... E04G 15/06 249/46
2,875,500 A 3/1959 Stough
2,917,803 A 12/1959 Phillips
3,281,894 A 11/1966 Buff et al.
3,476,845 A 11/1969 Buff et al.
3,782,680 A 1/1974 Hopkins
3,797,800 A * 3/1974 Loy ..... E04G 13/00 249/34
3,888,209 A 6/1975 Boots
3,938,205 A 2/1976 Spann
4,101,111 A 7/1978 Bishop
4,214,326 A 7/1980 Spann
4,233,700 A 11/1980 Spann
4,372,299 A 2/1983 Fixel
4,463,934 A 8/1984 Ochoa et al.
4,574,017 A * 3/1986 Stegmeier ..... E04H 4/141 156/247
4,823,534 A 4/1989 Hebinck
4,863,307 A 9/1989 Jones
RE33,550 E 3/1991 Jones
5,007,122 A 4/1991 Daughdrill
5,027,551 A 7/1991 Rodriguez
5,035,015 A 7/1991 Maietta
5,073,061 A 12/1991 Jones
5,092,091 A 3/1992 Hull et al.
5,096,155 A * 3/1992 Fitzgerald ..... E04G 17/04 403/374.2
D326,976 S 6/1992 Wickis, Jr. et al.
5,134,817 A 8/1992 Richardt
5,212,917 A 5/1993 Kurtz et al.
5,452,963 A 9/1995 Christensen
5,454,195 A 10/1995 Hallsten
5,524,640 A 6/1996 Lisak et al.
5,605,416 A 2/1997 Roach
5,611,641 A 3/1997 Christensen
5,694,723 A 12/1997 Parker
5,772,357 A 6/1998 Evans
D399,573 S * 10/1998 Stegmeier ..... D25/119
5,836,714 A 11/1998 Christensen
5,843,327 A 12/1998 Lindgren
5,956,912 A 9/1999 Carter et al.
6,021,994 A 2/2000 Shartzer, Jr.
6,026,623 A 2/2000 Anderson
6,195,956 B1 3/2001 Reyneveld
6,324,782 B1 12/2001 Gaston
6,477,817 B1 * 11/2002 Yurick ..... E04G 21/185 249/34
6,536,737 B1 3/2003 Davis
6,705,582 B2 3/2004 Osborn
6,735,793 B2 5/2004 Peterson
6,742,758 B2 6/2004 Janesky
6,951,434 B2 10/2005 Yodock, Jr. et al.
7,051,988 B2 5/2006 Shaw et al.
D552,250 S 10/2007 Christensen et al.
7,445,403 B2 11/2008 Williams et al.
7,967,524 B2 6/2011 Jones
8,011,144 B2 9/2011 Compton
8,266,844 B2 9/2012 Kurtz et al.
D679,173 S 4/2013 Parady et al.
8,485,603 B2 7/2013 Albecker
8,662,790 B2 3/2014 Phelps
9,004,815 B2 4/2015 Taylor
9,016,980 B2 * 4/2015 Wheeler ..... B65G 3/04 405/129.75
9,068,364 B2 6/2015 Troudt
9,173,350 B1 11/2015 Beutler
9,346,454 B1 5/2016 Leith
9,394,650 B2 7/2016 Diamond
9,551,163 B2 1/2017 Anaya Perez
D781,463 S 3/2017 Otto
2002/0062603 A1 5/2002 Shaw
2002/0145099 A1 10/2002 Hoyle et al.
2002/0157325 A1 * 10/2002 Domanico ..... A47K 3/008 52/287.1
2004/0041074 A1 3/2004 Takagi
2004/0156680 A1 8/2004 Gibbs
2006/0016956 A1 1/2006 Bennett et al.
2006/0131475 A1 6/2006 Testa
2006/0284049 A1 12/2006 England
2007/0107342 A1 5/2007 Friedlich
2007/0193162 A1 8/2007 Krzowski
2007/0228254 A1 10/2007 England
2007/0259520 A1 11/2007 Cooper et al.
2008/0079269 A1 4/2008 Bushey et al.
2009/0249704 A1 * 10/2009 Wilson ..... E04D 13/076 52/12
2010/0024321 A1 2/2010 Scherer
2012/0047818 A1 * 3/2012 Lopez ..... E04D 13/076 52/12
2012/0076588 A1 3/2012 Dupuis et al.
2012/0126084 A1 5/2012 Christeson
2014/0260022 A1 9/2014 Lewis
2014/0295725 A1 10/2014 Passmann et al.
2015/0159373 A1 * 6/2015 Warren ..... E04G 13/00 52/127.3
2015/0184350 A1 7/2015 Taylor
2015/0354160 A1 12/2015 Ragsdale, Jr.
2016/0032585 A1 2/2016 Park
2016/0076262 A1 * 3/2016 Scott ..... E04G 17/14 249/219.2
2017/0291055 A1 10/2017 Madion
2018/0320334 A1 * 11/2018 Boyce ..... E04G 17/14

FOREIGN PATENT DOCUMENTS

CA 2845360 C * 1/2021 ..... E02D 27/00
DE 3837377 C2 10/1994
DE 19520723 A1 12/1996
DE 19615637 A1 * 10/1997 ..... E02D 27/01
DE 202013000686 U 6/2014
EP 1321602 A1 * 6/2003 ..... E04G 13/00
FR 2735525 A1 * 12/1996 ..... E04G 15/06
GB 656530 A * 8/1951 ..... E02D 27/013
GB 871439 A * 6/1961 ..... E04G 15/068
GB 2427881 A * 1/2007 ..... E02D 27/013
GB 2434543 A 8/2007
GB 2591266 A * 7/2021 ..... E04B 5/32
JP 2013-231290 A 11/2013
KR 200417980 Y1 * 6/2006 ..... E04G 17/14
KR 100844278 B1 7/2008
KR 200442545 Y1 * 11/2008 ..... E04G 17/14
KR 101353546 B1 1/2014
WO WO-1997/038167 10/1997
WO WO-9738167 A1 * 10/1997 ..... E01C 11/02

OTHER PUBLICATIONS

Information about Related Patents, Patent Applications, and Patent Office Proceedings see the section below having the same title.
U.S. Pat. No. 10,024,023 U.S. Appl. No. 14/698,674, Jul. 17, 2018 filed Apr. 28, 2015, Mono Slab EZ Form LLC, Cement Form Apparatus and Method.

(56) References Cited

OTHER PUBLICATIONS

U.S. Pat. No. 10,024,024 U.S. Appl. No. 15/136,795, Jul. 17, 2018 filed Apr. 22, 2016, Mono Slab EZ Form LLC, Cement Form With Breakaway Portion.
U.S. Pat. No. 10,538,893 U.S. Appl. No. 15/967,259, Jan. 21, 2020 filed Apr. 30, 2018, Mono Slab EZ Form LLC, Cement Form Apparatus and Method.
U.S. Pat. No. 10,920,391 U.S. Appl. No. 16/034,902, Feb. 16. 2021 filed Jul. 13, 2018, Mono Slab EZ Form LLC, Cement Form With Breakaway Portion.
US-2021/0079669 U.S. Appl. No. 16/571,496, Mar. 18, 2021 filed Sep. 16, 2019, Mono Slab EZ Form LLC, Cement Form With Extension.
US-2020/0115878 U.S. Appl. No. 16/713,517, Apr. 16, 2020 filed Dec. 13, 2019, Mono Slab EZ Form LLC, Cement Form Apparatus and Method.
U.S. Appl. No. 17/173,196, filed Feb. 10, 2021, Mono Slab EZ Form LLC, Cement Form With Breakaway Portion.
US-App.: filed herewith, filed May 6, 2021, Mono Slab EZ Form LLC, Cement Form With Brick Ledge.

* cited by examiner

CEMENT FORM WITH BRICK LEDGE

TECHNICAL FIELD

This relates to cement forms used to create cement structures such as building foundations.

BACKGROUND

Traditionally, cement forms are held in place with an arrangement of metal stakes, kickers and other supporting structure. The traditional methods for forming a monolithic building foundation are particularly time intensive to set up and take down after the cement monolithic foundation is poured. After the form is removed, dirt is backfilled around the foundation to provide support and soil grading. In certain cold climates, foam insulation sheets are positioned against the sidewall of the foundation and extending laterally from the sidewall after the form is removed and before dirt is backfilled around the foundation. The foam insulation provide a desired R value that helps hold in heat from the building within the foundation, thereby providing protection again extreme expansion and contraction of the foundation resulting from outside temperature changes.

GENERAL DESCRIPTION

According to one aspect of the present disclosure, a cement form includes a single piece, unitary body member having a solid, continuous construction and a wedge-shaped cross-section. The body member includes a first surface arranged vertically and configured to support a volume of cement during formation of a cement foundation, a second surface arranged horizontally and configured to contact a ground support surface, a foam material, an elongate construction with a greater length dimension in a horizontal direction than a height dimension in a vertical direction, and a brick ledge portion extending from the first surface and configured to displace a portion of the volume of cement to form a brick ledge in the cement foundation. The brick ledge portion is removable after the volume of cement is cured while other portions of the cement form remain in place thereby providing access to the brick ledge in the cement foundation.

The brick ledge portion may have a rectangular shape. The brick ledge portion may be integrally formed as a single piece with at least the first surface of the cement form. The brick ledge portion may be formed as a separate piece and releasably secured to the first surface in a separate assembly step prior to use of the cement form to create a cement foundation. The brick ledge portion may be arranged at a top end of the cement form and define at least in part an upper most surface of the cement form. The brick ledge portion may extend horizontally from the first surface in a direction perpendicular to the first surface.

The cement form may further include a weight-bearing surface positioned at an acute angle relative to the first and second surfaces, the weight-bearing surface facing at least in part in a vertical direction and being arranged at an angle in the range of about 20° to about 60° relative to the second surface. The cement form may include a connector groove extending along at least a portion of a length of the body member, the connector groove being configured to receive a connecting member that extends between adjacent positioned cement forms, be open in a vertically upward direction, and have a closed bottom end.

Another aspect of the present disclosure relates to a cement form having an elongate member that includes a wedge cross-sectional shape, a foam material, first and second ends and a length measured therebetween in a horizontal direction, a cement support surface extending vertically and configured to support a volume of cement used to create a cement foundation, and a height measured in a vertical direction that is less than the length. The cement form also includes a brick ledge portion configured to displace a portion of the volume of cement to form a brick ledge in the cement foundation. The brick ledge portion is removable after the volume of cement is cured thereby providing access to the brick ledge in the cement foundation.

The cement form, after removal of the brick ledge portion, may remain in place after the volume of cement cures. The brick ledge portion may extend from the cement support surface in a direction perpendicular to the cement support surface. The brick ledge portion may have a rectangular shape. The cement form may also include at least one relief cut formed in the cement form at a boundary of the brick ledge portion, the at least one relief cut facilitating disconnection of the brick ledge portion from the cement form. The at least one relief cut may include first and second relief cuts arranged within a horizontal plane. The elongate member may further include a connector groove extending along the length of the elongate member and spaced away from the cement support surface. The connector groove may be open in a vertical direction and sized to receive a connecting member that spans between adjacent positioned cement forms.

A further aspect of the present disclosure relates to a cement form configured for use in forming a cement foundation. The cement form includes a single piece foam member that includes first and second ends, a length measured between the first and second ends, and a cement support surface oriented vertically and arranged to support a volume of cement. The cement support surface defines a height of the cement form, wherein the height is less than the length. The cement support surface has a brick ledge portion configured to displace a portion of the volume of cement to form a brick ledge in the cement foundation.

The cement form may also include a connector groove extending along the length. The connector groove may be sized to receive a connector member that interconnects adjacent positioned cement forms. The brick ledge portion may be removable from remaining portion of the cement form after the volume of cement is cured. The cement form may include at least one relief cut positioned at an edge of the brick ledge portion. The relief cut may facilitate removal of the brick ledge portion after the volume of cement is cured.

A further aspect of the present disclosure relates to a method of forming a cement foundation. The method includes positioning a foam cement form on a ground surface, the cement form having a brick ledge portion extending from a cement supporting surface of the cement form, supporting a volume of cement against the cement supporting surface and the brick ledge portion, and, after the volume of cement is at least partially cured, removing the brick ledge portion from the cement form to expose a brick ledge in the cement foundation. The brick ledge is configured to support a plurality of bricks along an edge of the cement foundation.

The brick ledge portion may have a rectangular shape to form the brick ledge with a right angle shape. The cement form may include at least one relief cut, and removing the brick ledge portion may include breaking off the brick ledge portion at the at least one relief cut. The cement supporting surface may be arranged parallel with a vertical plane, and the cement form includes a ground support surface arranged perpendicular to the cement supporting surface and facing a ground surface upon which the cement form is supported. The cement form may include a connector groove extending along a length of the cement form in a horizontal direction, and the method includes inserting a connector member into the connector groove to interconnect adjacent positioned cement forms.

It should be appreciated that the terms cement and concrete are used interchangeably to refer to a mixture of aggregates and paste. The aggregates are typically sand and gravel or crushed stone, and the paste is water and portland cement. The portland cement makes up approximately 10-15 percent of the aggregate mixture, by volume. Through a process called hydration, the portland cement and water harden and bind the aggregates into a rocklike mass. The hardening process can continue for years meaning that concrete gets stronger as it gets older.

The general description is provided to give a general introduction to the described subject matter as well as a synopsis of some of the technological improvements and/or advantages it provides. The general description and background are not intended to identify essential aspects of the described subject matter, nor should they be used to constrict or limit the scope of the claims. For example, the scope of the claims should not be limited based on whether the recited subject matter includes any or all aspects noted in the general description and/or addresses any of the issues noted in the background.

DRAWINGS

The preferred and other embodiments are described in association with the accompanying drawings in which.

DETAILED DESCRIPTION OF EMBODIMENTS

Figure 1:
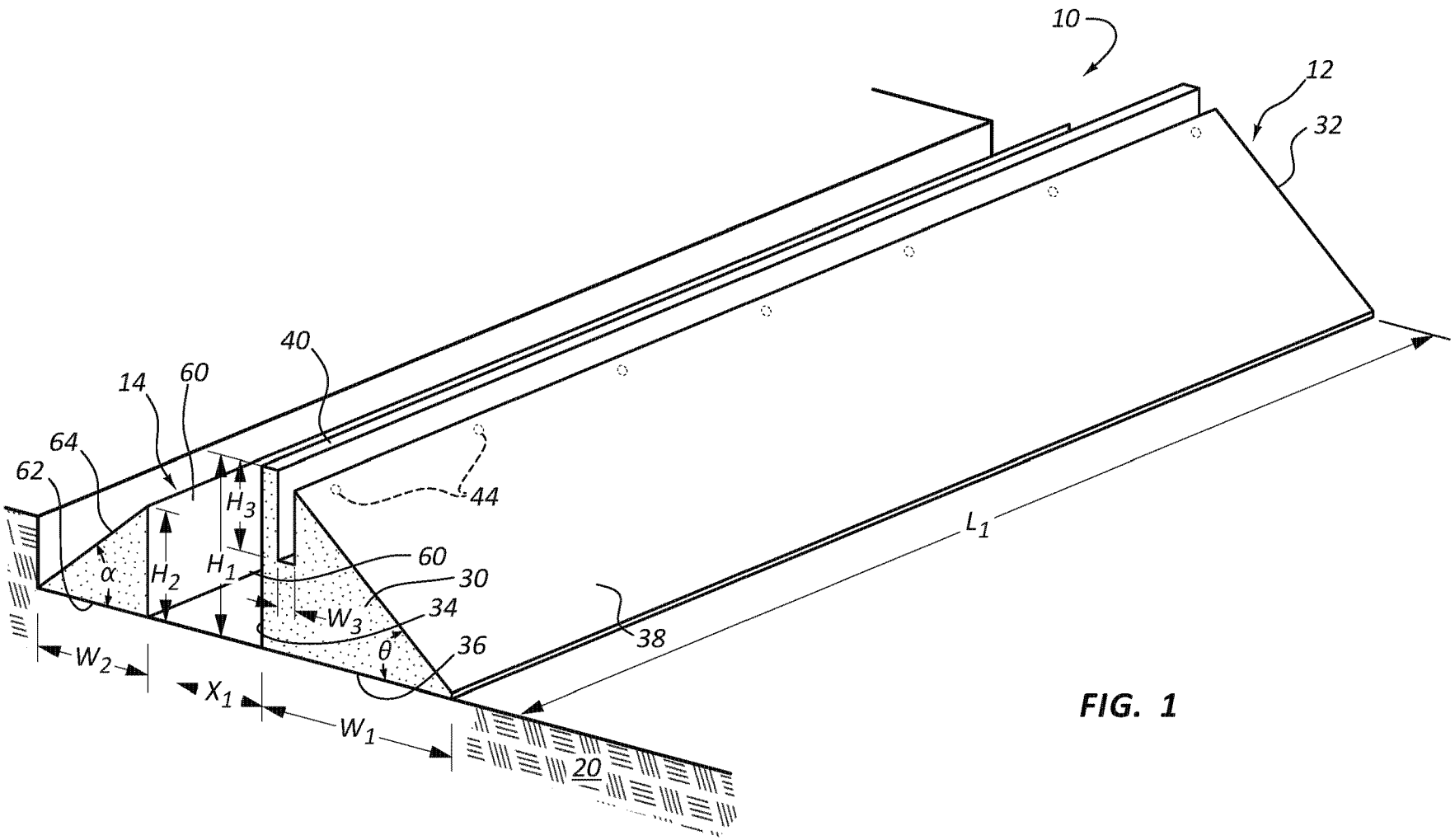
FIG. 1 is a perspective view of a cement form assembly in accordance with the present disclosure.

The present disclosure generally relates to cement forms used to form cement structures such as cement foundations. The apparatuses and methods of the present disclosure are particularly useful for forming monolithic foundations in which the footings and floor are poured as a single, monolithic structure. The apparatuses and methods of the present disclosure are also particularly useful for forming The disclosed cement forms, cement form assemblies, methods of making cement forms/cement form components, and methods of forming cement structures using the disclosed cement forms may be used in place of traditional wood/metal cement forms that are labor intensive to set up and must be removed after pouring the cement, and foam insulation sheets that are required in cold climates to be buried adjacent to the cement structure (e.g., cement foundation) to limit frost damage to the cement structure.

One aspect of the present disclosure relates to a cement form that is comprised substantially of a foam material such as, for example, expanded polystyrene or high density foam (e.g., known as Blue Board). The foam cement form may be used to form a cement structure by containing the cement while being poured and cured. The cement form remains in contact with the cement structure to later provide an insulating function to insulate the cured cement. The foam cement form may be at least partially buried prior to pouring the cement. The backfill material used to at least partially bury the foam cement form may help hold the form in place while the cement is being poured and cured.

Another aspect of the present disclosure relates to cement forms formed from a polymer material such as, for example, polystyrene, polyethylene, or other polymer. Various molding processes may be used to form the polymer cement form including, for example, blow molding, drape forming, injection molding, and the like. A polymer cement form may include additional intricate features such as support ribs, pass-through bores, grooves, internal cavities, and the like which may be more difficult to form in a foam cement form. Further, a polymer cement form in accordance with the present disclosure may be reusable for forming a plurality of cement structures, wherein the polymer cement form is removed from the cement structure after curing of the cement.

Another aspect of the present disclosure relates to methods of forming a cement structure such as a monolithic foundation. Such methods may include use of a foam cement form or a polymer cement form in accordance with the present disclosure. Such methods may also include the use of an internal insert that is positioned under or internal the cement structure. The internal insert may comprise a foam material, a polymer material, or the like. Typically, the internal insert is provided to help minimize the amount of cement that is needed to create the cement structure. The cost and labor associated with using an internal insert is usually less than the extra amount of cement that may otherwise be required to create the cement structure. In at least some examples, the internal insert may provide an additional insulating property that increases the R value associated with protecting the cement structure from fluctuations in temperature.

A further aspect of the present disclosure relates to methods of forming foam cement forms and polymer cement forms. Such methods may be implemented to provide cost-effective, efficient production of cement forms. The cement forms may be structured as part of such manufacturing methods to facilitate assembly, storage, and shipping that is more efficient and cost-effective than those available for existing cement forms.

Another aspect of the present disclosure relates to a cement form that includes a breakaway portion. The breakaway portion may be defined in part by one or more relief cuts formed in the cement form. The breakaway portion may include a pointed tip portion of the cement form. In at least one example, the detachable portion may be positioned adjacent to a connector groove of the cement form, wherein the connector groove is receptive of a connector that spans between adjacent positioned cement forms. The detachable portion may support the connector prior to and during formation of a cement structure that is formed using the cement form. After the cement structure has been formed, the detachable portion may be removed from the cement form, such as after removing the connector. Once the detachable portion is removed, the backfill dirt that at least partially covers the cement form may be further positioned to cover additional portions of the cement form.

Since the cement forms disclosed herein may have many different shapes and sizes, the detachable portion may itself have various shapes and sizes. Furthermore, one or a plurality of relief cuts may be provided in the cement form to assist in disconnecting the detachable portion. The shape, size and orientation of the relief cut may help facilitate disconnecting the detachable portion with relative low amounts of force and/or effort.

A yet further aspect of the present disclosure relates to an angled end face or portion of the cement form and/or inner insert. In one example, one or more ends of the cement form and/or inner insert are cut at a 45° angle. As such, a pair of cement forms and/or a pair of inner inserts may be arranged at 90° relative to each other with the 45° angled portions mating to provide a relatively continuous structure. In other examples, one or more ends of the cement form and/or inner insert may be cut at a different angle orientation, such as an angle in the range of about 30° to about 60° or other ranges of angles to permit mating of adjacent positioned cement forms and/or inserts at particular angles that are less than or greater than 90°.

A further aspect of the present disclosure relates to a cement form that includes a brick ledge portion, wherein the brick ledge portion creates a brick ledge feature in the cement structure being formed using the cement form. In one example, the cement structure is a monolithic building foundation, and the brick ledge is formed in a top perimeter edge of the foundation using the brick ledge feature of the cement form. The brick ledge feature may have a rectangular cross-sectional shape that creates a right angle shaped recess or ledge in the sidewall and/or top surface of the foundation. In some examples, the brick ledge portion is removable from the rest of the cement form after the foundation is poured and at least partially cured. The remaining portions of the cement form may be left in the ground to provide an insulating function for the foundation.

Referring to FIGS. 1-5, an example cement form assembly 10 is shown and described. The cement form assembly 10 includes a cement form 12 and an inner insert 14 (FIG. 1). The cement form 12 and inner insert 14 are particularly useful for forming a building foundation, such as a monolithic foundation. The cement form 12 is used to support an exterior wall of the foundation. The inner insert 14 is positioned spaced inward from the cement form 12 and at a location that defines an inner and bottom surface of the foundation. Each of cement form 12 and inner insert 14 have a wedge shaped cross-sectional shape in the embodiment shown in FIGS. 1-5. A vertical surface of the wedge shape defines a supporting surface that contains cement that is poured to form the foundation. A bottom, downward facing surface of each of the wedge shaped structures rests against a ground support and has sufficient width to maintain the cement form 12 and inner insert 14 in an upright position without the use of stakes, kickers, or other structures typically used in known cement form assemblies. The cement form 12 and inner insert 14 may be held in a specific position along the ground support using stakes that are driven through the cement form 12 and inner insert 14 and into the ground support, or driven into the ground support at a position directly adjacent to the cement form 12 and inner insert 14. The support stakes are typically not needed to hold the cement form 12 and inner insert 14 in an upright position.

Figure 34A:
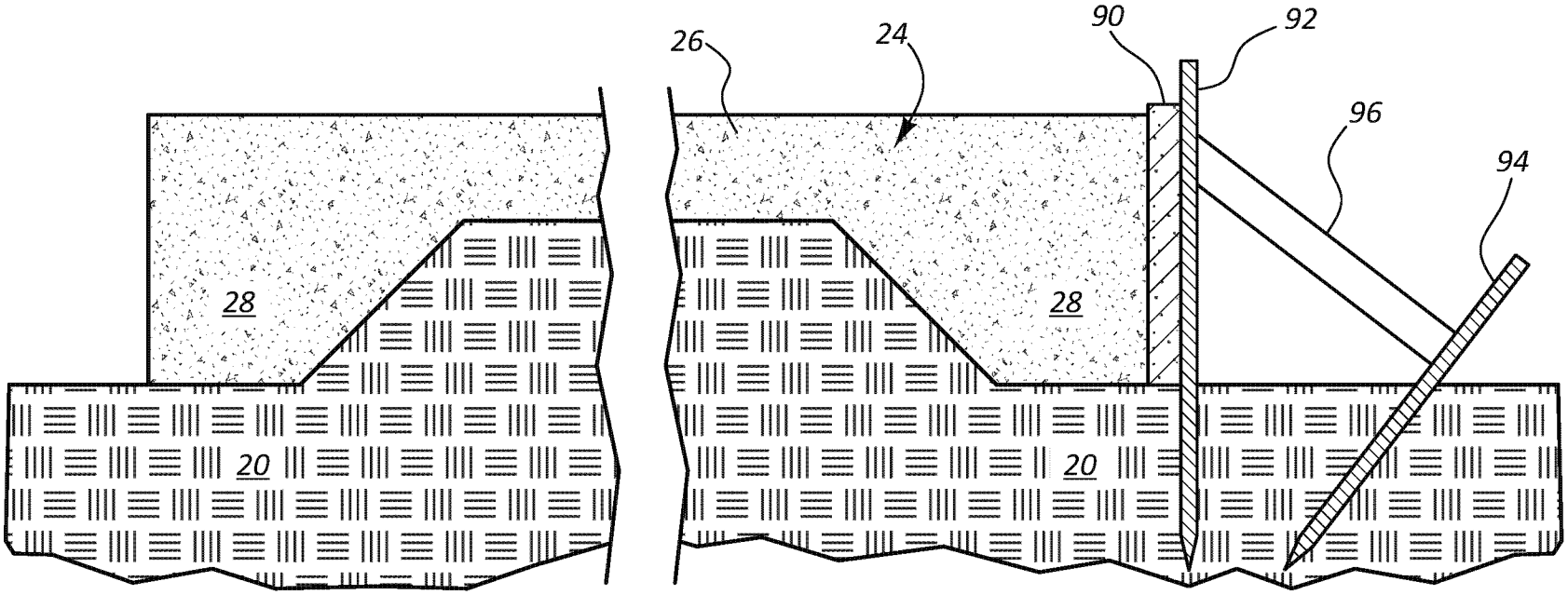
FIG. 34A (Prior Art)
FIGS. 34A and 34B show a prior art cement form assembly.
Figure 34B:
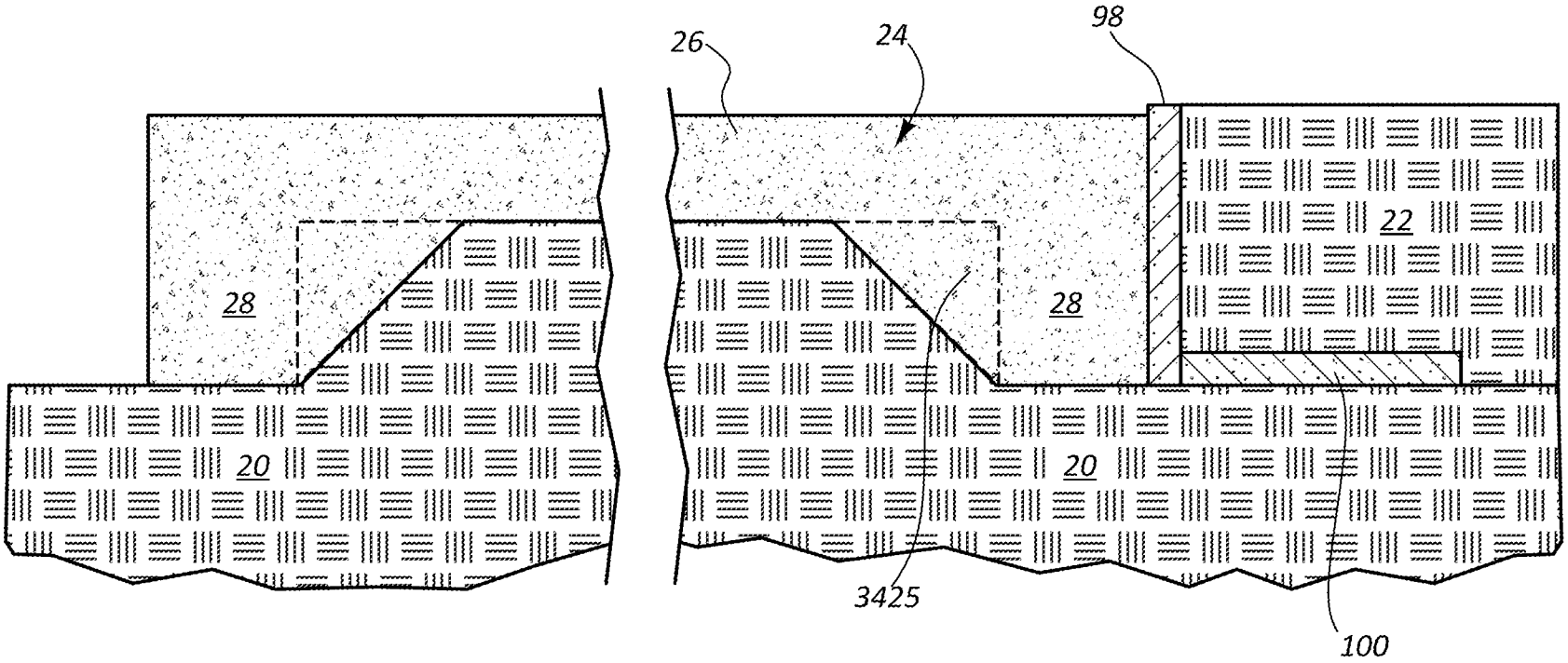
FIG. 34B (Prior Art)

Referring to FIGS. 34A and 34B, a traditional cement form assembly is shown. The traditional assembly includes a cement form 90 that is held in place along a ground support 20 with a plurality of form stakes 92. A plurality of kickers 96 extend diagonally from the cement form 90 to hold the cement form 90 in a vertical, upright position. The kickers 96 are held in place with a plurality of kicker stakes 94. The process of setting up the form assembly shown in FIG. 34A is extremely labor intensive because not only does the cement form 90 need to be held in an upright position, but also needs to be held in a fixed lateral and axial position along the ground support 20.

The ground support 20 is pre-shaped to match the desired dimensions for a slab 26 and footings 28 of a foundation 24. The increased depth required for the footings 28 requires a tapering of the ground support 20 from the area of the slab 26 to the area of the footings 28. Because the ground support 20 comprises dirt, gravel, or other fill material that is generally loose, it is difficult to form the transition between the slab support area and foundation support area of the ground support 20 in a square shape represented by feature 3425 in FIG. 34B. The feature 3425 shown in FIG. 34B represents the additional cement that is required to fill the transition space between the slab support portion and foundation support portions of the ground support 20. This additional cement can be significant, particularly when forming large foundations. This additional cement is unnecessary from a structural perspective for the foundation, but is a required additional cost when using traditional methods to form monolithic foundations.

Referring to FIG. 34B, after the foundation 24 is poured and cured, the cement form 90, stakes 92, 94 and kicker 96 are removed, and a pair of foam sheets 98, 100 are positioned resting against the exterior, lateral surface of the foundation 24 and against the ground support 20 adjacent to foundation 24. The foam sheets 98, 100 provide insulation for foundation 24 and provide a certain R value. In at least some cases, the foam sheets 98, 100 help retain heat within the foundation 24 so that the heat does not immediately dissipate into backfill 22 that is later used to cover the foam sheets 98, 100 and grade the ground surface adjacent to foundation 24. The backfill 22 may be in the form of dirt, gravel, or other fill material. The backfill 22 holds the foam sheets 98, 100 in their respective positions in contact with the lateral outside surface of foundation 24 and along the ground support 20 extending laterally outward from foundation 24.

The traditional structures and methods of forming monolithic foundations and other cement structures as represented in FIGS. 34A and 34B have many disadvantages, inefficiencies, and unnecessary costs. The apparatuses and methods disclosed herein, particularly with reference to FIGS. 1-38 address many of the drawbacks associated with the traditional apparatuses and methods described with reference to FIGS. 34A and 34B.

Referring again to FIG. 1, the cement form 12 includes first and second ends 30, 32, a first or cement facing surface 34, a second or ground facing surface 36, and a weight-bearing or inclined surface 38. Cement form 12 may also include a top surface 40 and a connector groove 42. Cement form 12 may optionally include a plurality of stake openings or apertures 44 positioned along a length $L_1$. The stake openings 44 may be provided as pass-through bores that extend from the weight-bearing surface 38 or top surface 40, through the body of cement form 12 and out through second surface 36. The cement form 12 may be referred to as an elongated body, a unitary body or unitary cement form, or a body portion.

The first surface 34 may be arranged generally vertical or aligned parallel with a vertical plane. First surface 34 may support a volume of concrete that is poured into a space between cement form 12 and inner insert 14. First surface 34 may have any desired shape, size and orientation to provide the desired shape, size and orientation of a resulting surface of a cement structure supported by cement form 12. First surface 34 is shown having a height $H_1$. The height $H_1$ may be in the range of, for example, about 4 inches to about 60 inches, and more preferably in the range of about 12 inches to about 24 inches, which is common for standard monolithic foundations. First surface 34 may include a decorative pattern that results in a decorative pattern formed on the side surface of the cement structure (e.g., foundation). Such a decorative pattern may be visible in the event that cement form 12 is removed and the side surface of the cement structure is exposed for viewing.

Second surface 36 typically is oriented generally horizontally or aligned parallel with a horizontal plane. Second surface 36 rests upon a ground support 20. Typically, the ground support 20 is generally planer or arranged in a horizontal plane at least in the area where the cement form 12 is positioned. Second surface 36 may have a width $W_1$ that is in the range of, for example, about 6 inches to about 48 inches, and more particularly in the range of about 12 inches to about 24 inches. In at least some embodiments, the width $W_1$ is substantially equal to the height $H_1$ of first surface 34. The width $W_1$ is typically equal to or greater than the height $H_1$ to provide balance and support for the cement structure being formed. However, the ratio between weight $W_1$ and height $H_1$ may vary based upon a variety of factors including, for example, materials used for cement form 12, the amount of cement supported by cement form 12 and other structural features of cement form 12 such as, for example, the size and shape of connector groove 42, an angle θ that defines an orientation of weight-bearing surface 38, the amount of backfill that is possible to cover weight-bearing surface 38 prior to pouring the cement structure, and the like.

The weight-bearing surface 38 is substantially planer and extends from an outermost edge of second surface 36 toward the first surface 34. A plurality of stake openings 44 may be formed in the weight-bearing surface 38. In at least some examples, cement form 12 comprises a material that permits driving a stake through the cement form 12 without pre-forming a stake opening 44. Driving a stake through the cement form 12 may concurrently form a stake opening. Such materials are commonly foam materials as described above, but may include other materials that can be punctured without cracking or otherwise failing structurally. The use of certain foam materials permits driving stakes through cement form 12 at any desired location along the weight-bearing surface 38, within connector groove 42, or through top surface 40. In some embodiments, stakes may be driven into ground support 20 at an outer edge of cement form 12 at the interface between second surface 36 and weight-bearing surface 38 to prevent sliding of the cement form 12 in at least one direction along ground support 20. Stakes may be temporarily driven into ground support 20 along an opposite edge of cement form 12 at the interface between first and second surfaces 34, 36 prior to pouring the cement structure. Such temporarily position stakes may remain in place while taking other steps related to setting up the cement form assembly 10 such as, for example, inserting connecting members into connector groove 42, driving stakes through stake openings 44 or along the outer edge of cement form 12, and/or at least partially covering weight-bearing surface 38 with a backfill dirt or gravel material.

Figure 2:
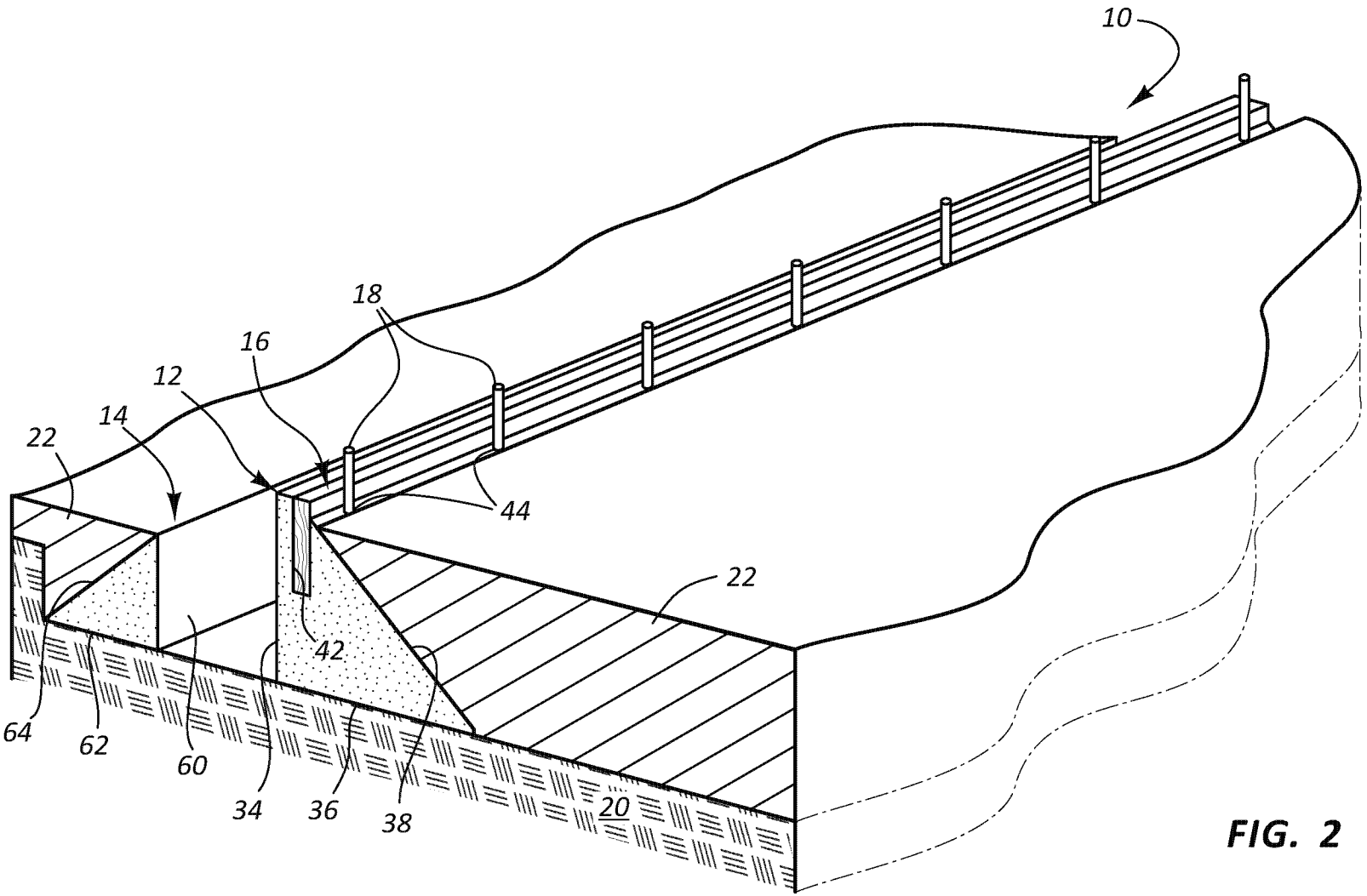
FIG. 2 is a perspective view of the cement form assembly shown in FIG. 1 with connecting members.
Figure 3:
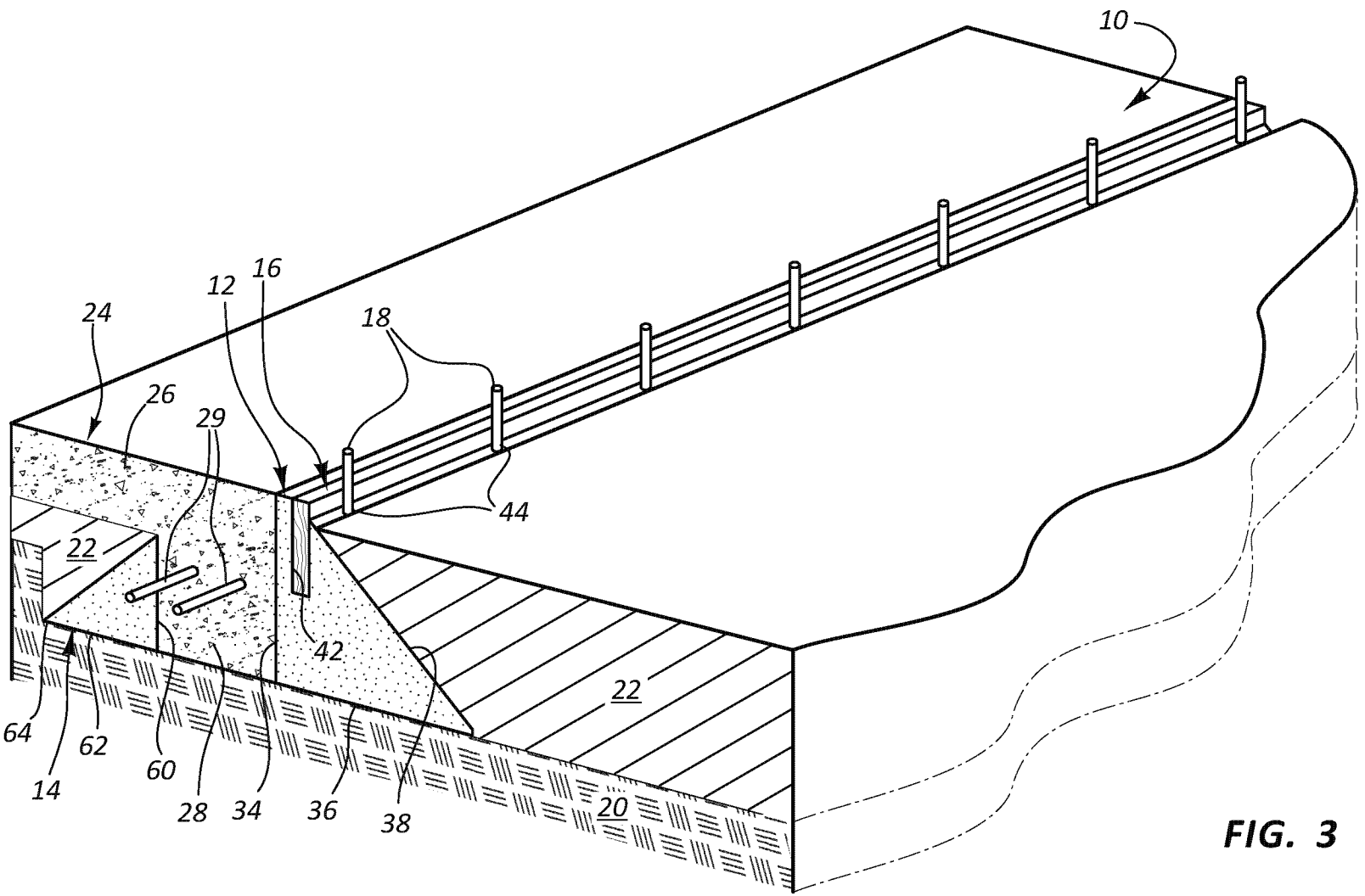
FIG. 3 is a perspective view of the cement form assembly of FIG. 2 used to form a monolithic foundation.

The connector groove 42 may be positioned along the weight-bearing surface 38. Connector groove 42 may be accessible along a top side of cement form 12. Connector groove 42 may be open facing in a generally vertical or upward direction. In at least some examples, connector groove 42 is formed in top surface 40 rather than in weight-bearing surface 38, or a combination of the two. Connector groove 42 is shown having a maximum height $H_3$ and a width $W_3$. In at least some examples, connector groove 42 is dimensioned to receive a standard board size such as a 2"×4", 2"×6" or 2"×8" board. Such a board may be referred to as a connecting member 16 (FIGS. 2-3). The boards or connecting member 16 may be positioned within connector groove 42 and spanned between adjacent positioned cement forms 12 to provide an interconnection of adjacent position cement forms 12. Connector groove 42 is sized, shaped and oriented on cement form 12 to provide easy insertion and removal of such connecting members at various stages of setting up cement form assembly 10 and creating a cement structure, such as a monolithic foundation.

Typically, connectors are inserted into connector groove 42 prior to pouring cement to form a cement structure, and are later removed after the cement cures so that the connecting members may be reused for other cement form assemblies. The connector groove 42 may have any desired shape and size to accommodate connecting members of different shapes and sizes. In one example, the connecting members are in the form of a sheet of material, a clip structure, a bracket, or the like. Connector groove 42 may be customized in its shape, size and orientation to accommodate such connecting members. In some embodiments, connector groove 42 may extend along the entire length $L_1$. In other examples, the connector groove 42 extends along only a portion of the length $L_1$ such as, for example, along portions directly adjacent to the first and second ends 30, 32.

The material of cement form 12 that is removed in order to form connector groove 42 may be saved and then reinserted in connector groove 42 after removal of the connecting members. This inserted material may help fill connector groove 42 to prevent backfill dirt or other objects from collecting in connector groove 42, which may otherwise reduce the R value of cement form 12 when cement form 12 is left in the ground and used to insulate the cement structure.

The cement form 12 may be used alone or in combination with inner insert 14. Inner insert 14 may eliminate the need for the extra cement 3425 shown in FIG. 34B and discussed above. Inner insert 14 may be positioned along the ground support 20 in the area of the footing portion 28 of foundation 24. Inner insert 14 may be positioned adjacent to that portion of ground support 20 that supports the slab portion 26 of the foundation 24. Backfill material may be used to cover at least portions of the inner insert 14 on top of or adjacent to the portion of ground support 20 that supports the slab 26 thereby reducing the extra cement 3425 that is otherwise needed.

Figure 1A:
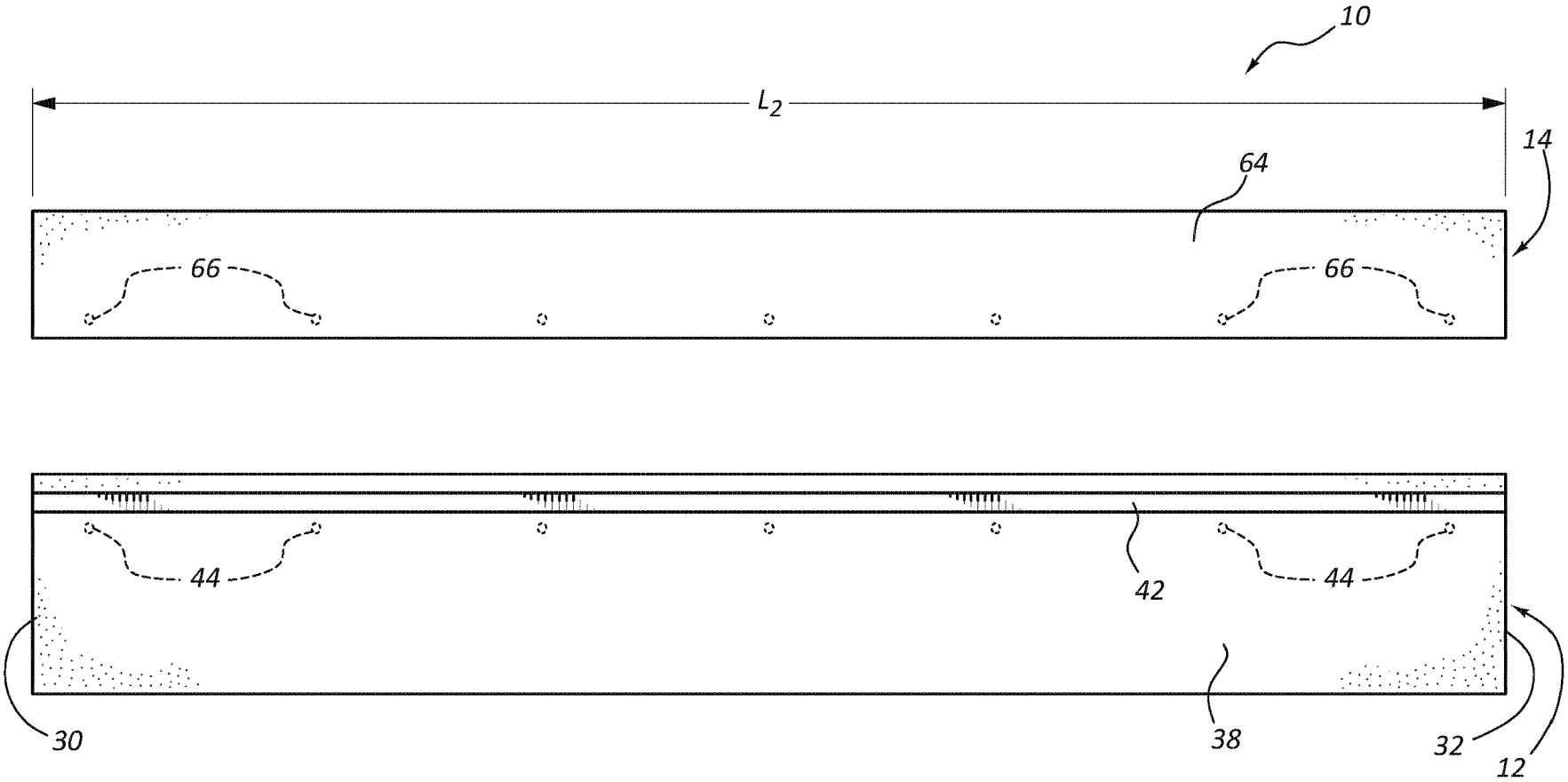
FIG. 1A is a top view of the cement form assembly shown in FIG. 1.

Inner insert 14 includes a cement surface 60, a ground support surface 62, and a backfill support surface 64. Cement surface 60 has a height $H_2$ and is arranged generally vertically and/or in parallel with a vertical plane. Ground support surface 62 has a width $W_2$ and is arranged horizontally and/or parallel with a horizontal plane. Backfill support surface 64 extends from the ground support surface 62 to the cement surface 60 and may be arranged at an angle $\alpha$ is directly dependent on the height $H_2$ and width $W_2$. Inner insert 14 also has a length $L_2$ (FIG. 1A). Inner insert 14 is typically spaced apart from cement form 12 a distance $X_1$. The distance $X_1$ is typically in a range of about six inches to about 36 inches, and more particularly in the range of about 12 inches to about 24 inches, which is typical for monolithic foundations.

Inner insert 14 may include a plurality of stake openings 66 positioned along the length $L_2$ (FIG. 1A). Inner insert 14 may comprise a foam material such as polystyrene foam or a high density foam. In some examples, inner insert 14 comprises a polymer material such as, for example, a polystyrene or other molded material. The materials used for inner insert 14 may be the same as those used to form cement form 12. Certain materials used for inner insert 14 may permit forming of the stake opening 66 as stakes are driven through inner insert 14 and into ground support 20. In other examples, the stake opening 66 are pre-formed as, for example, pass-through bores that extend from backfill support surface 64 through ground support surface 62. The stake opening 66 may be formed at any location along the backfill support surface 64. In at least some examples, stakes are driven into ground support 20 adjacent to inner insert 14 but not extending through any portion of inner insert 14 to hold inner insert 14 in position during various steps leading up to pouring the cement structure. For example, stakes may be positioned along the cement surface 60 to hold inner insert 14 in position while backfill material is placed on the backfill support surface 64, and those stakes are removed prior to pouring the cement structure.

Referring to FIG. 2, the cement form assembly 10 is shown with connecting member 16 positioned in connector groove 42, stakes 18 driven through cement form 12 and into ground support 20, and backfill 22 positioned covering at least portions of the weight-bearing surface 38 of cement form 12 and substantially all of the backfill support surface 64 of inner insert 14. The cement form assembly 10 is shown prepared for pouring cement to create a cement structure (e.g., monolithic foundation). Typically, the backfill 22 is filled up to the connector groove 42 but typically not covering the connecting members 16. The backfill 22 can be filled to any desired height, but is typically always vertically lower than the connector groove 42 and/or the top surface 40. The stakes 18 may have ends that protrude through backfill 22 or may be positioned on cement form 12 in a way that they are completely buried by backfill 22. The stakes 18 may extend above the cement form 12, particularly above the weight-bearing surface 38 or top surface 40 into which the stakes are driven. The stakes 18 may be later removed. In at least some examples, the stakes 18 are left positioned in cement form 12 even after the cement structures is cured. The stakes 18 may be in the form of, for example, wood or other insulating material that does not significantly reduce the R value of the cement form 12. Further, stakes 18 may comprise a relatively low cost material that makes it possible from a cost perspective to leave the stakes 18 positioned in cement form 12 permanently. In some examples, stakes 18 may be driven into ground support 20 a distance that buries then within the cement form 12 or at least flush with the weight-bearing surface 38 and/or top surface 40 so that they are no longer exposed outside of backfill 22.

The backfill 22 is typically graded to the top edge of inner insert 14 as shown in FIG. 2. In at least some examples, the top edge of inner insert 14 includes a flat surface, round surface, or the like to help reduce or otherwise minimize stress concentrations at an internal corner feature formed in the cement structure. Some additional inner insert embodiments are shown and described below with reference to FIGS. 12A-12E.

Referring to FIG. 3, a cement structure in the form of a monolithic foundation 24 is shown poured into the space between cement form 12 and inner insert 14 and covering inner insert 14. Foundation 24 includes a slab portion 26 and a footing portion 28. Foundation 24 may also include a plurality of rebar members 29 positioned internally. The cement form 12 is held in place laterally by stakes 18 and backfill 22. Cement forms 12 are also held in alignment relative to each other (e.g., relative to an adjacent cement form 12 that is positioned end-to-end therewith) with connecting members 16. Inner insert 14 may be held in place laterally and vertically using a plurality of stakes (not shown) and backfill 22. In at least some examples, the inner inserts 14 may also be interconnected with adjacent position inner inserts using connecting members such as connecting members 16. The connecting members may be positioned within connector grooves or other features formed in inner inserts 14 to promote interconnection of the adjacent position inner inserts 14.

In at least some examples, the cement structure (e.g., foundation 24) may be poured without first covering at least a portion of cement form 12 with backfill 22. For example, the connecting member 16 and stakes 18 may provide sufficient support and connection between cement form 12 and ground support 20 that no backfill 22 is needed. However, in at least some examples, backfill 22 is used to cover at least portions of cement form 12 to provide additional support for cement form 12 during pouring of the cement. Applying backfill 22 may also make it easier for a cement truck to move close to cement form 12 for purposes of delivering the cement as part of the cement pouring process. An additional benefit of pre-filling the backfill 22 before pouring the cement is that most, if not all of the grading associated with the cement structure (e.g., foundation 24) may be completed prior to pouring the cement without requiring a further follow-up grading step.

Figure 4:
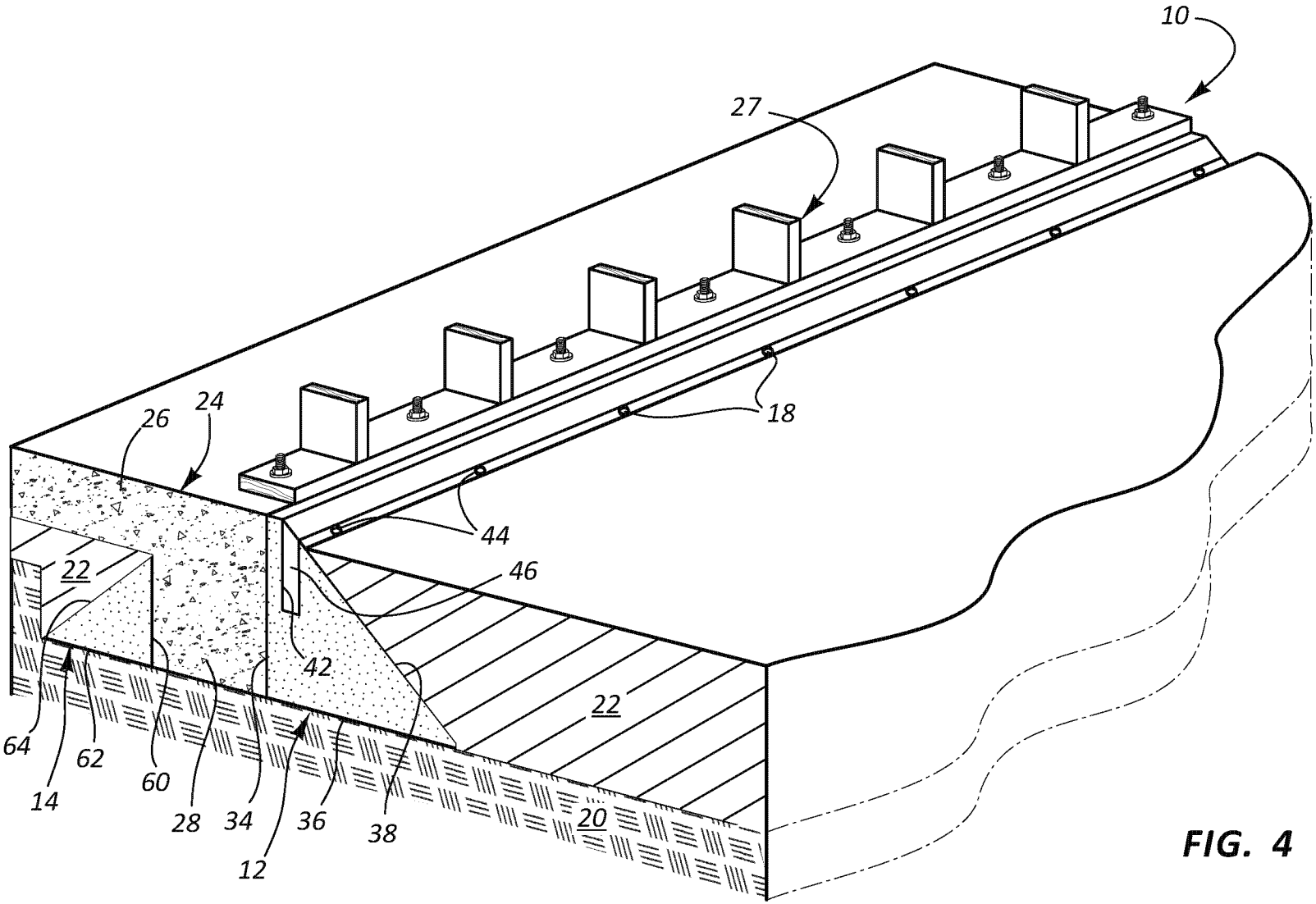
FIG. 4 is a perspective view of the cement form assembly shown in FIG. 3 with connecting members removed and a structure supported on the foundation.

Referring now to FIG. 4, the foundation 24 is shown with a building structure (e.g., wall 27) including a plurality of boards positioned along a top surface of the foundation 24. The connecting members 16 may be removed from connector groove 42 and reused in another cement form assembly. The stakes may be removed from stake openings 44, or may be driven further into stake openings 44 to be flush with weight-bearing surface 38 or at least the top surface of backfill 22. In at least some examples, the connector groove 42 may be filled with a strip 46 (also referred to as insert 46). The strip 46 may comprise the same material as the rest of the cement form 12. In at least some examples, the strip may be the material that was removed from cement form 12 as part of forming connector groove 42. Strip 46 may fill connector groove 42 to limit the amount of material or other objects that may otherwise fill connector groove 42. Using the strip 46 within connector groove 42 may improve the aesthetics of the exposed portion of cement form 12. In other embodiments, connector groove 42 may be filled with other materials such as, for example, an expandable foam or other insulating material that is different than the material of cement form 12.

Figure 5:
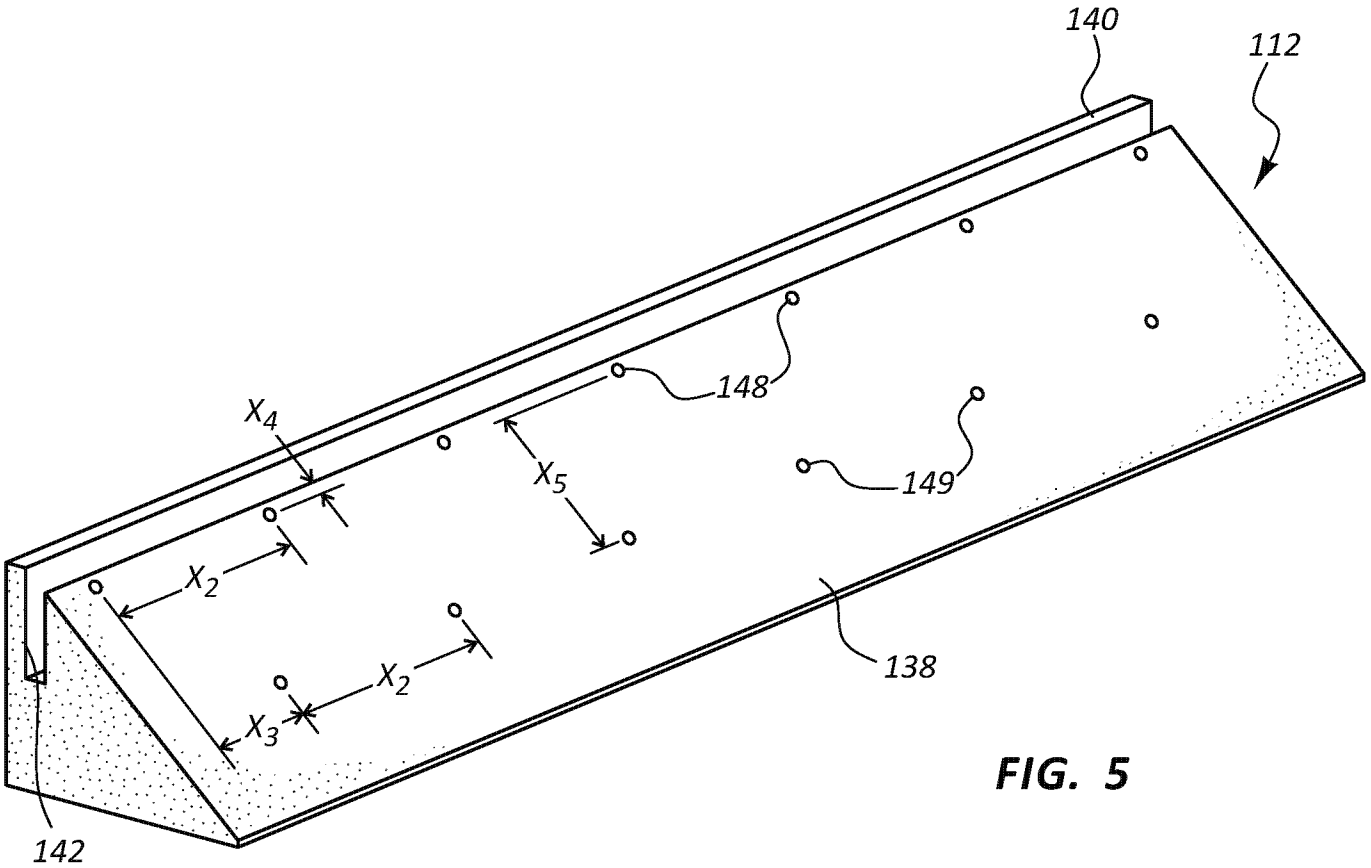
FIG. 5 is a perspective view of another cement form in accordance with the present disclosure.

FIG. 5 shows another example cement form 112 that includes a plurality of stake openings 148, 149. The stake openings 148, 149 are shown arranged in two rows along the length of the cement form 112. The stake openings 148, 149 are spaced apart a distance $X_2$ within each given row. The stake openings 148 may be offset from the stake openings 149 in the other row by a distance $X_3$. The stake openings 148 may be spaced from connector groove 142 a distance $X_4$. The rows of stake openings 148, 149 may be spaced apart a distance $X_5$. Each of the distances $X_2$, $X_3$, $X_4$, $X_5$ may be individually modified to provide a pattern or arrangement of stake openings 148, 149 on the cement form 112. Stake openings 148, 149 may also be positioned along a top surface 140 of the cement form 112. In other examples, additional or fewer rows and numbers of stake openings 148, 149 may be used.

The cement form 112 may be formed from any desired material. In at least some examples, the stake openings 148, 149 are formed concurrently with forming the cement form 112 via, for example, a molding/forming process. In other examples, the stake openings 148, 149 are formed in a separate step after the cement form 112 has been formed (e.g., using a drilling, cutting, stamping or other method for removing material to create the stake openings 148, 149).

Figure 6:
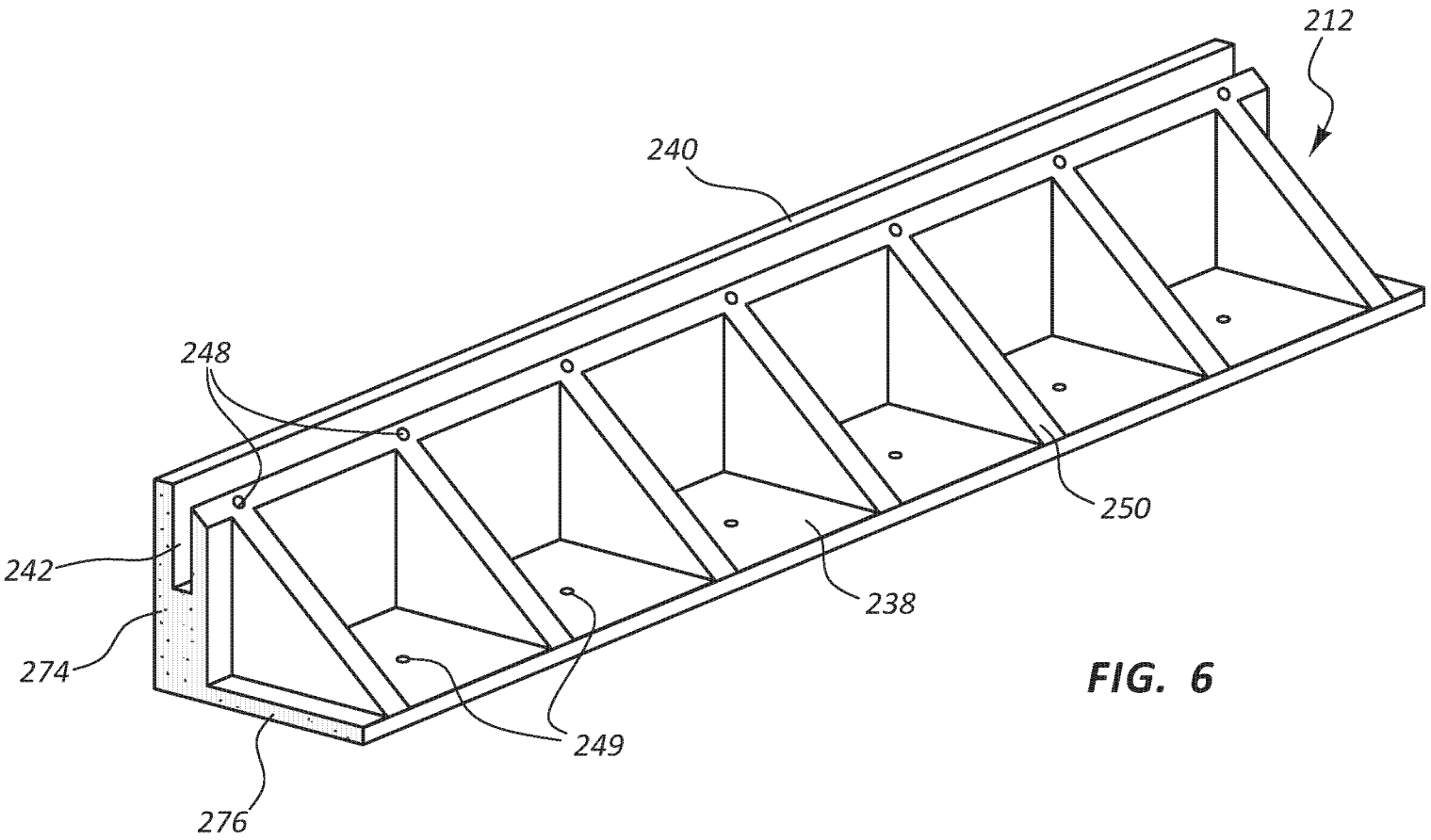
FIG. 6 is a perspective view of another cement form in accordance with the present disclosure.

FIG. 6 shows the cement form 212 embodiment that includes a plurality of support ribs 250. The support ribs 250 may extend between a vertical portion 274 and a bottom or horizontal portion 276. A plurality of upper stake openings 248 may be included along an upper portion of the rib 250 or along a top surface 240 or other portion of the vertical portion 274. A plurality of lower stake openings 249 may be positioned along a weight-bearing surface 238 and/or other portion of the horizontal portion 276. Other stake openings 244 may be positioned along other portions of ribs 250 or at other locations on cement form 212. The cement form 212 may include any desired number, arrangement, size, orientation and the like associated with the stake openings 248, 249. Furthermore, a cement form 212 may include any desired number, shape, size and orientation for the ribs 250. In at least some embodiments, cement form 212 may be void of the connector groove 242 and the ribs 250 may extend to top surface 240.

Figure 7:
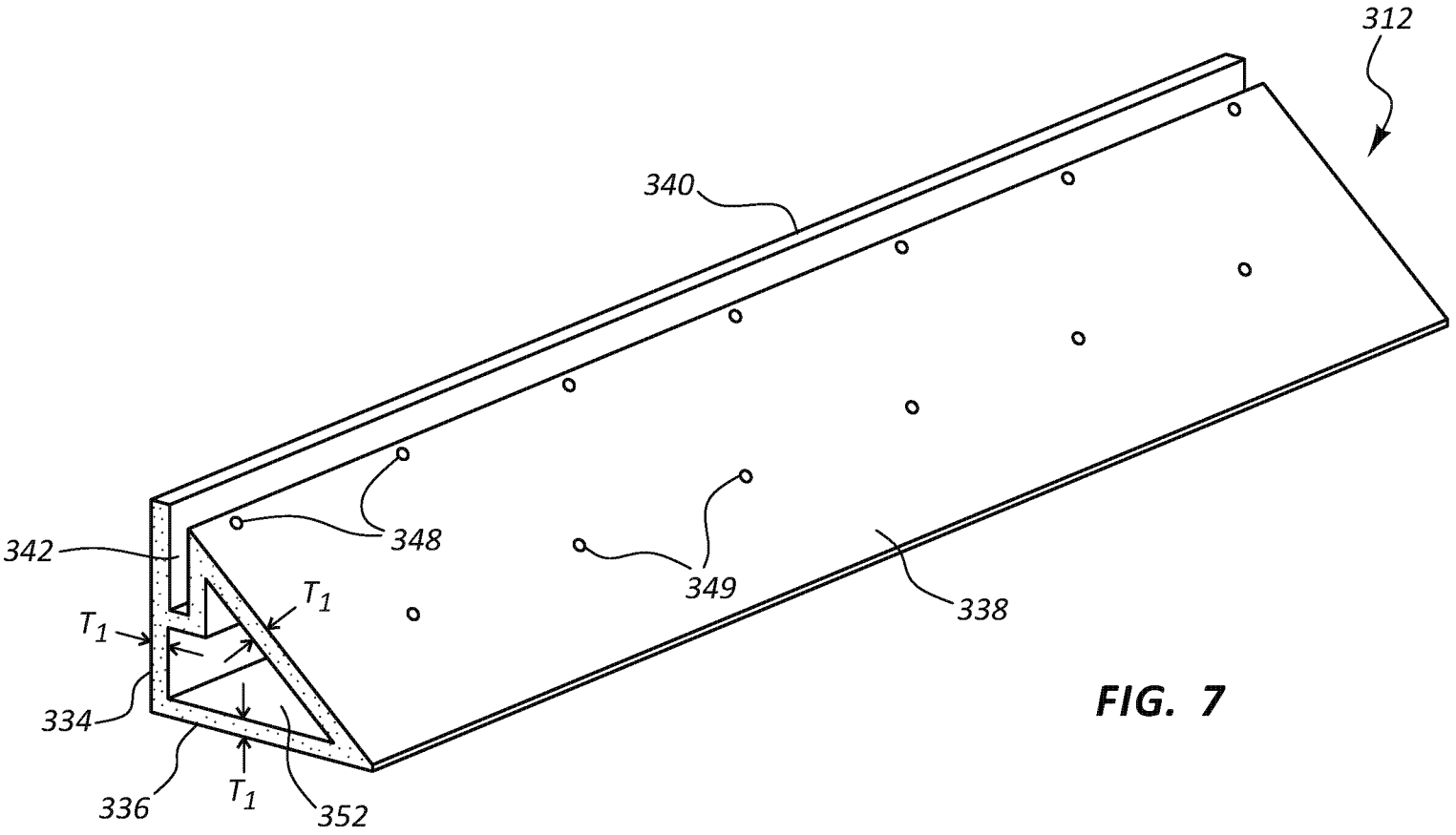
FIG. 7 is a perspective view of another cement form in accordance with the present disclosure.

FIG. 7 illustrates another example cement form 312 having a hollow interior 352. The hollow interior 352 may be formed during formation of the cement form 312 such as, for example, during a molding process. Alternatively, hollow interior 352 may be formed after the cement form 312 has been formed using, for example, a coring, cutting, stamping, drilling, or other material removing process. Cement form 312 may include a plurality of upper and lower stake openings 348, 349. The stake openings 348, 349 may extend through the weight-bearing surface 338 and the second surface 336.

Cement form 312 may also include a connector groove 342 and a first face 334. The hollow interior 352 may provide for a relatively constant wall thickness $T_1$ that define each of the first and second surfaces 334, 336 and the weight-bearing surface 338.

Cement form 312 is shown as an integrally formed, single piece. In other embodiments, cement form 312, along with other cement form embodiments disclosed herein, may comprise a plurality of parts that are separately formed and then later assembled together. In other embodiments, the cement form 312 may be formed as a wedge-shaped structure having a solid construction. In a later manufacturing step, portions of the wedge-shaped structure may be removed to form at least some of the features shown in FIG. 7. For example, the top surface 340 may be formed by cutting off a pointed edge of the wedge-shaped structure, the connector groove 342 may be formed by cutting out a portion of the solid structure, and the hollow interior 352 may be formed by removing an interior portion of the wedge-shaped structure. Many types of manufacturing processes and/or steps may be possible to form any one of the cement forms and associated cement form features disclosed herein.

Figure 8:
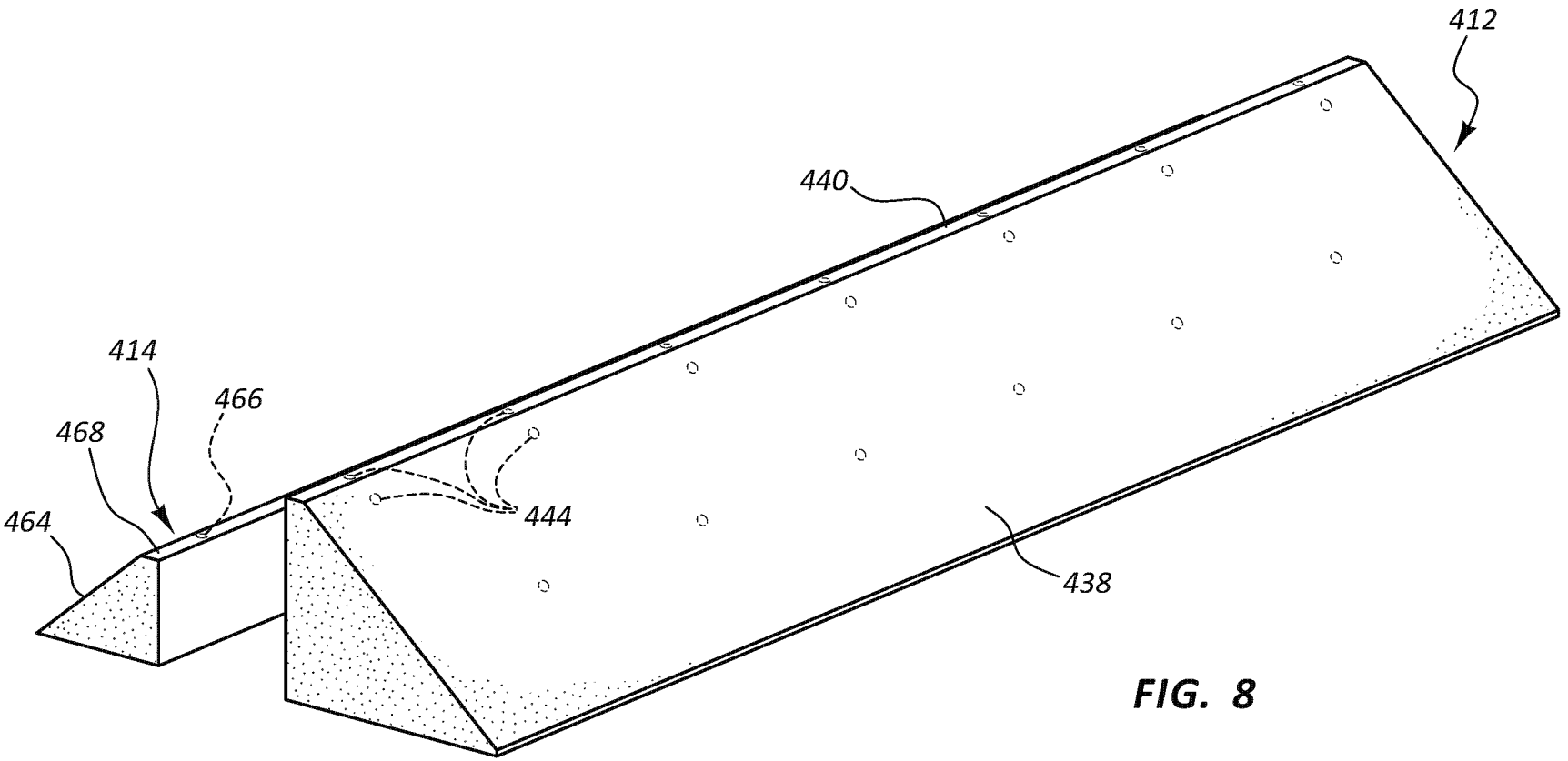
FIG. 8 is a perspective view of a cement form and inner insert in accordance with the present disclosure.

Referring to FIG. 8, another example cement form 412 and inner insert 414 are shown and described. The cement form 412 does not include a connector groove as shown in the embodiments of FIGS. 1-7. The cement forms 412 may be interconnected with adjacent cement forms using other structures and/or devices as opposed to the connecting members 16 described above with reference to FIGS. 1-4. For example, adjacent cement forms 412 may be connected to each other with clips or brackets that attach to the weight-bearing surfaces 438.

The cement form 412 and inner insert 414 may include a plurality of stake openings 444, 466, respectively. The cement form 412 may include a top surface 440, and the inner insert 414 may include a top surface 468. The stake openings may be formed in the top surfaces 440, 468. Alternatively, the stake openings 444, 466 may be formed on other surfaces such as, for example, the weight-bearing surface 438 and backfill support surface 464, respectively. The stake openings may be pre-formed or formed concurrently as stakes are driven through the cement form 412 and inner inserts 414 and into a ground support. The cement form 412 and inner insert 414 may comprise materials that permit such forming of the stake openings as the stakes are driven through the structure of the cement form 412 and inner insert 414.

The top surface 440 may provide a planer surface that provides an improved transition between cement form 412 and a top surface of a cement structure that is formed using the cement form 412. In at least some examples, the cement structure is created to be flush with the top surface 440. The inner insert 414 may include a top surface 468 to provide improved support of the resulting cement structure at the inner insert 414 as used to form and later support an underside surface of the cement structure. The top surface 468 may also provide improved ease of grading the backfill to the top edge of inner insert 414. Providing the top surface 468 as at least a partial planer surface may reduce the chance of damaging the top edge of the inner insert 414 during the grading process.

Figure 9B:
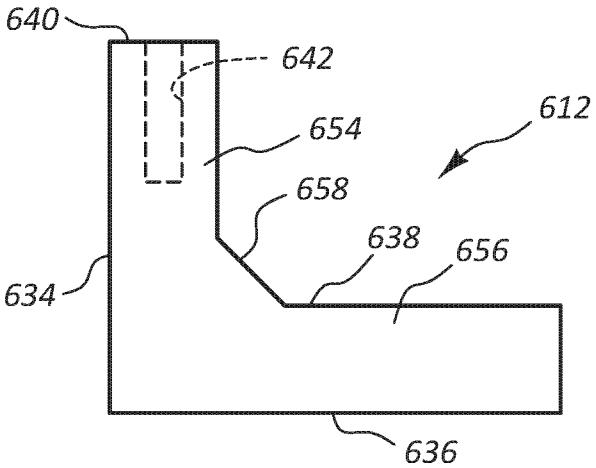
FIGS. 9A-9D are end views of further cement form embodiments in accordance with present disclosure.
Figure 9D:
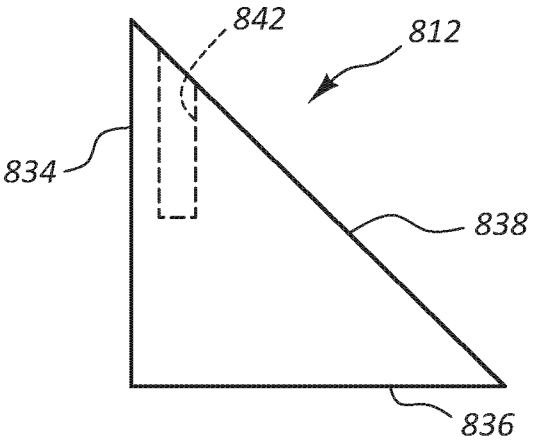
Figure 9A:
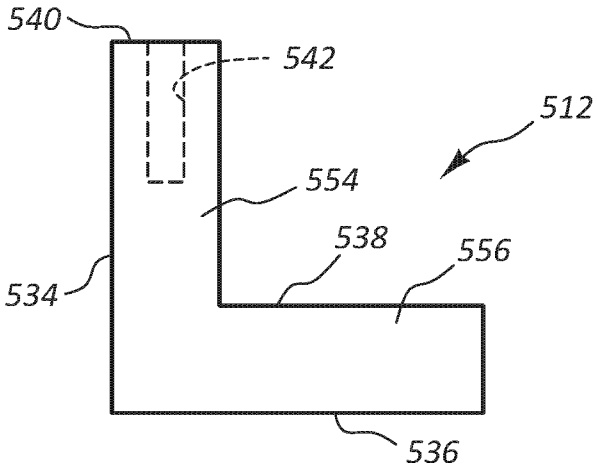

FIGS. 9A-9D show alternative cross-sectional shapes for the cement forms disclosed herein. For example, FIG. 9A shows an L-shape having a vertical leg 554 and a horizontal leg 556. The vertical leg 554 defines a first surface 534 that supports the cement structure during pouring of the cement, and a top surface 540. A connector groove 542 may be formed in the top surface 540. The horizontal leg 556 may define the second surface 536 as well as a weight-bearing surface 538. The vertical and horizontal legs 554, 556 may have a substantially similar thickness, which may provide a constant R rating. The thicknesses of the vertical and horizontal legs 554, 556 may provide sufficient structural rigidity to support the poured concrete. The cement form 512 may include a plurality of stake openings that are formed in, for example, the top surface 540 or the weight-bearing surface 538.

FIG. 9B shows a cement form 612 having a vertical leg 654 and a horizontal leg 656. A brace portion 658 may extend between the legs 654, 656 to provide additional support therebetween. The use of brace portion 658 may make it possible to have a reduced thickness for the vertical and horizontal legs 654, 656 because the brace portion 658 provides additional support and structural rigidity. The vertical leg 654 may define the first surface 634 and a top surface 640. A connector groove 642 may be formed along the top surface 640 or along any other desired portion of the cement form 612. The horizontal leg 656 may define the second surface 636 and the weight-bearing surface 638. A plurality of stake openings may be formed in, for example, the weight-bearing surface 638 and/or the top surface 640.

The brace portion 658 may extend in equal parts to the vertical leg 654 and the horizontal leg 656. In other examples, the brace portion 658 may have a non-uniform, non-symmetrical construction. The brace portion 658 may extend along an entire length of the cement form 612. In other embodiments, the brace portion 658 may be provided as rib features that extend along only portions of the length of the cement form 612.

Figure 9C:
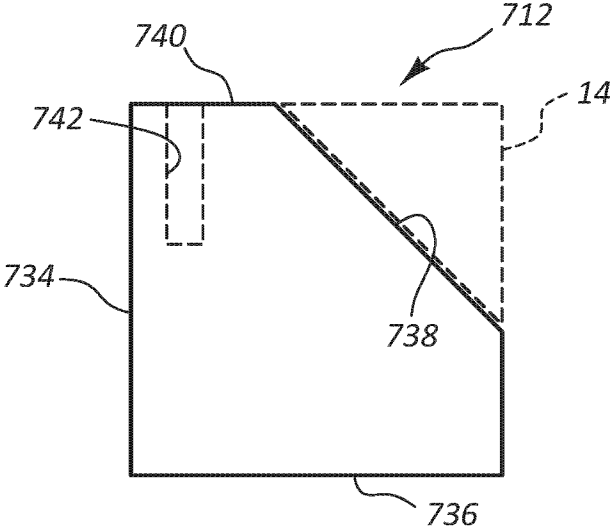

FIG. 9C illustrates a cement form embodiment 712 having a semi-wedge shaped construction and a semi-block shaped construction. In one example, the cement form 712 is formed from a block of material (e.g., foam material) that has a generally square shaped cross-section. A portion of the square shaped cross-section is removed. The removed portion may be the desired size for the inner insert 14.

The cement form 712 has a greater thickness throughout that provides an improved R rating as compared to other embodiments such as the embodiments of FIGS. 9A, 9B and 9D. The construction of cement form 712 may provide for an improved structural rigidity, stability while pouring the cement, and the like. The increased thickness may make it possible to use less dense and/or less rigid materials for the cement form 712 while still achieving the desired function of serving as a cement form and an insulating material.

Cement form 712 may include first and second surfaces 734, 736 and a weight-bearing surface 738. A top surface 740 may extend along a top edge thereof. A connector groove 742 may be formed, for example, the top surface 740 and/or the weight-bearing surface 738. Cement form 712 may include a plurality of stake openings pre-formed therein. In at least some examples, cement form 712 may comprise of materials that permit concurrent forming of a stake opening as the stake is driven through the material of the cement form 712.

FIG. 9D illustrates another example cement form 812 that has a right angle, triangular shape with two legs having equal lengths. The generally symmetrical shape of cement form 812 may make it possible to form two cement forms 812 from a single block of material having a square cross-sectional shape, while maintaining equal lengths for each of the first and second surfaces 834, 836. A connector groove 842 may be formed in a weight-bearing surface 838. The cement form 812 may be void of a generally planer top surface as is included in other embodiments disclosed herein. Cement form 812 may include a plurality of pre-formed stake openings formed therein, or may comprise materials that permit concurrent formation of stake openings as stakes are driven through the material of cement form 812.

Many other triangular shapes are possible for the cement form 812 by modifying the relative lengths between surfaces 834 and 836. Maintaining a right angle relationship between surfaces 834, 836 may be a constant feature among all of the various triangular shapes that are possible. The triangular shape of the cement form 812 may provide improved stacking of cement forms for purposes of storage, shipping, etc. Providing cement forms 812 having mirrored shapes maximizes storage space and may provide compact, efficient storage and/or shipping. Other designs disclosed herein provide similar benefits including, for example, the cement form 712 and inner insert 14 shown in FIG. 9C.

Figure 10B:
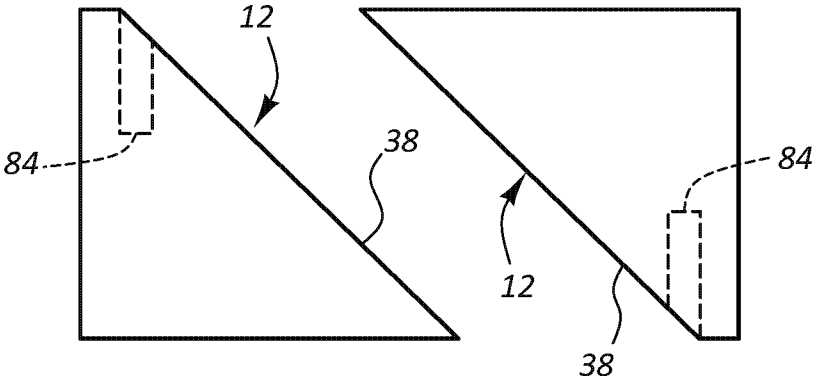
FIGS. 10A-10C show steps of forming a cement form in accordance with the present disclosure.
Figure 10C:
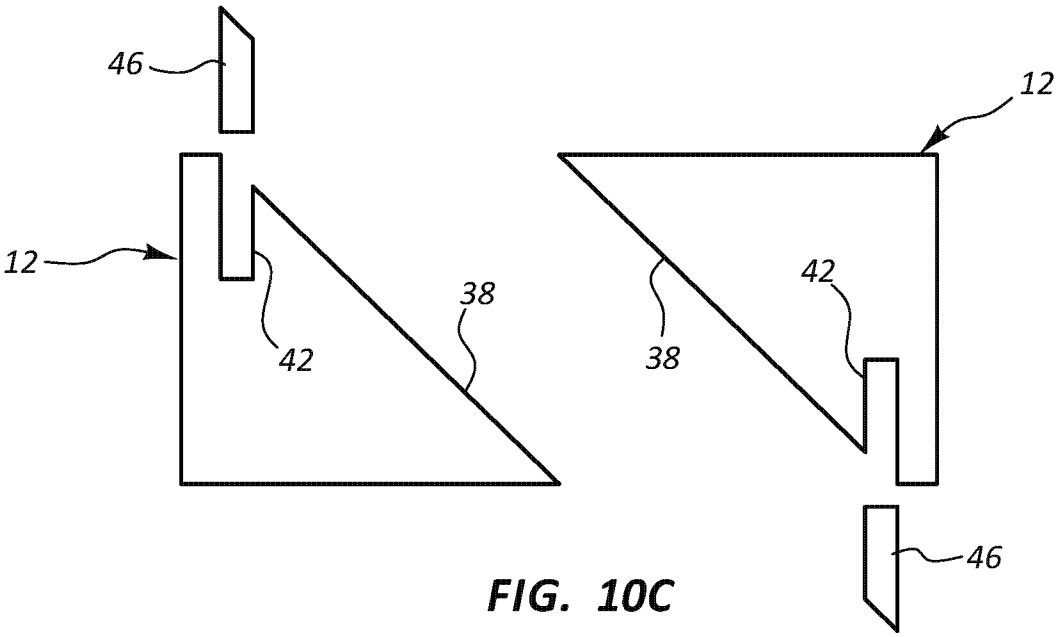
Figure 10A:
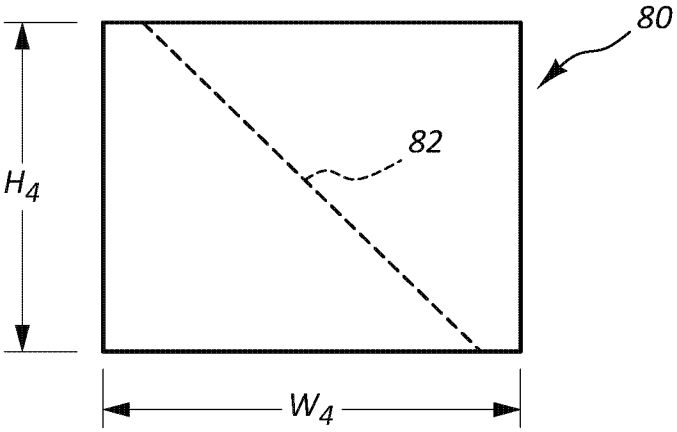

FIGS. 10A-10C show steps of manufacturing a pair of cement forms 12 in accordance with the present disclosure. FIG. 10A shows a block of material 80 having a rectangular cross-sectional shape. The rectangular shape having a slightly greater width $W_4$ than height $H_4$ makes it possible to maintain equal dimensions for the resulting first and second surfaces 34, 36 of each cement form 12 while also providing a flat top surface 40 for each of the cement forms 12. Other embodiments may include use of a block of material 80 having a square shaped cross-section and provide the same or similar benefits.

FIG. 10A shows a cut line 82 that is used to cut the block in half to create two separate cement forms 12 as shown in FIG. 10B. After the cement forms 12 are separated, connector grooves 42 may be formed with cuts 84. FIG. 10C shows removable strips 46 taken from connector groove 42 as a result of cuts 84. The strip 46 may be removed to make room for a connecting member such as connecting member 16 described with reference to FIGS. 1-4. The strip 46 may be replaced in connector groove 42 after removing connecting member 16 (e.g., after the cement structure has been formed) so that the connecting members can be used with a different cement form assembly. The connecting members can be reused for different cement pouring projects and the strips 46 may be used to fill connector groove 42 to prevent unwanted objects from entering connector groove 42 and to help maintain a desired R value for cement form 12.

The forming method described with reference to FIGS. 10A-10C is particularly useful when the material of block 80 comprise a foam material such as those foam materials described herein. However, other materials may be used such as, for example, polymer materials or other insulating materials. Using just three cuts (cuts 82 and two cuts of 84), two separate cement forms may be formed from a single block of material and at relatively low manufacturing and material cost. In embodiments in which the cement forms 12 do not require a connector groove, a single cut 82 through block 80 may result in two completed cement forms 12 that are ready for use.

Figure 11:
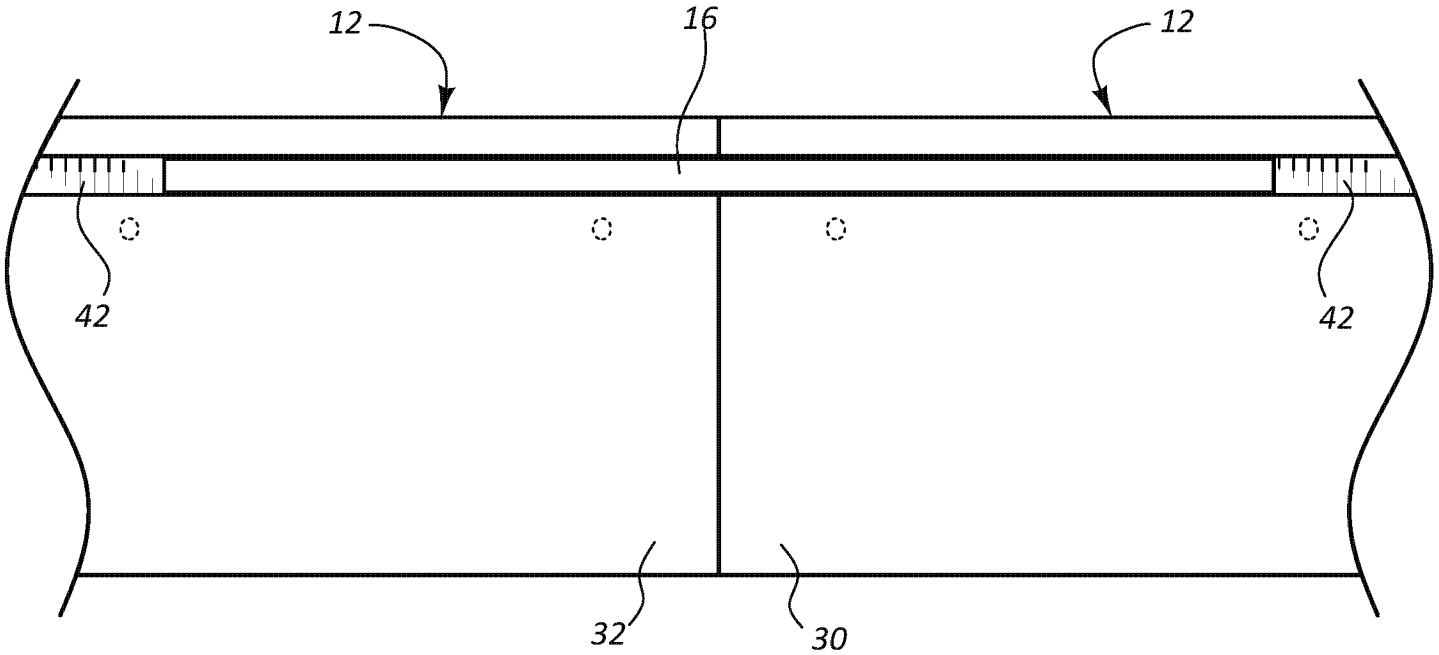
FIG. 11 is a top view of a pair of cement forms interconnected in accordance with the present disclosure.

FIG. 11 shows two cement forms 12 positioned end-to-end in a top view. A connecting member 16 is positioned within connector grooves 42 of the adjacent cement forms 12. The connecting member 16 spans the two cement forms 12. Typically, the cement forms 12 are positioned end-to-end in alignment with each other such that the connector grooves 42 are in alignment with each other. The connecting member 16 is then positioned within the connector groove 42.

A single connecting member 16 may span multiple cement forms 12 such as three or more cement forms. In some arrangements, the connecting member 16 has a length that is substantially the same as the length $L_1$ of cement form 12. Positioning a plurality of connecting members 16 end-to-end within the connector grooves of a plurality of aligned cement forms 12 may completely fill the connector grooves of all of the cement forms. In other examples, a relatively short cement form may be used within the connector groove 42 at or adjacent at the mating first and second ends 30, 32 of adjacent positioned cement forms 12 as shown in FIG. 11. The connector groove 42 may have a length that is customized for a particular length connecting member 16.

In other embodiments, the adjacent position cement forms 12 may be interconnected with different structured connecting members providing different functions. For example, the connecting members may include claws or barb features that grasp the material of the cement forms 12 without the need for a pre-forming groove or other apertures sized to receive the claw/barb features.

Figure 12A:
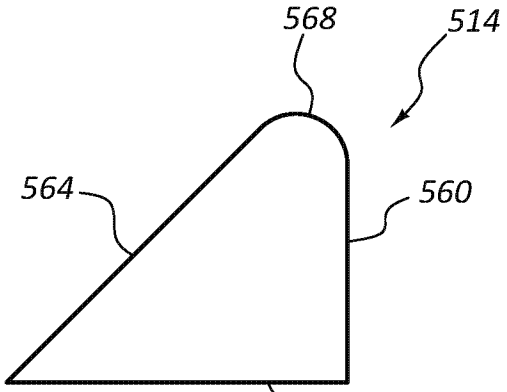
FIGS. 12A-12E are end views of inner insert embodiments in accordance with the present disclosure.

FIGS. 12A-12E illustrate alternative embodiments for inner inserts used with the cement form assemblies described herein. FIG. 12A shows an inner insert 514 having a wedge-shaped construction with a contoured top surface 568. The contoured upper edge (also referred to as a top surface 568) may provide a reduced stress point in the resultant cement structure that is supported by and/or formed around the inner insert 514. The top surface 568 may have any desired radius and may extend between the cement surface 560 and the backfill support surface 564. In some embodiments, other edges of the inner insert 514 may have curvature such as, for example, the edge formed at the intersection between ground support surface 562 and backfill support surface 564.

Figure 12B:
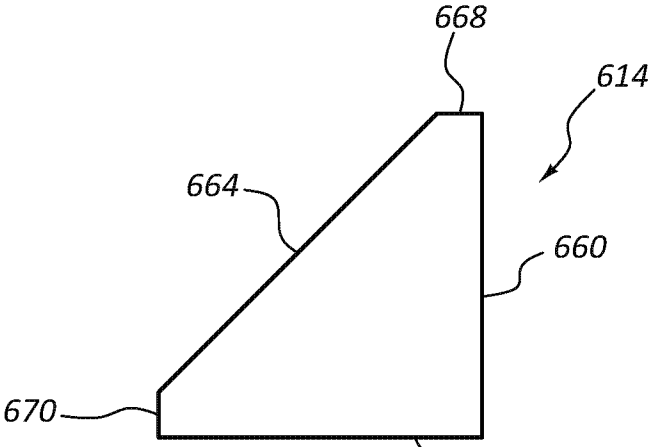

FIG. 12B shows an inner insert 614 having an upper surface 668 defined between the cement surface 660 and the backfill support surface 664, and a planer edge surface 670 defined between the ground support surface 662 and backfill support surface 664. Removing the pointed edges that are otherwise included in place of the surfaces 668, 670 may reduce the propensity of the sharp edges to break off or be deformed/damaged during manufacture, shipping, storage and installation of a cement form assembly at a construction site.

Figure 12C:
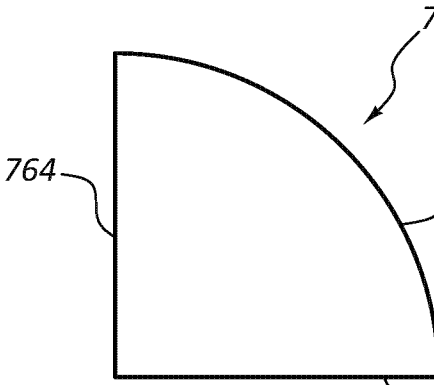

FIG. 12C shows an inner insert 714 having a contoured shape for the cement surface 760. The contoured shape of cement surface 760 may reduce the incidence of stress concentration points at the inner/lower surface of the cement structure (e.g., monolithic foundation). The inner insert 714 may have any desired shape and size for the cement surface 760, including a contoured portion, a combination of linear and contoured portions, and the like. In some embodiments, the backfill support surface 764 may be arranged at a non-vertical orientation thereby reducing the amount of material needed for the inner insert 714. Typically, the ground support surface 762 remains flat or planer to provide a desired interface with the ground support.

Figure 12D:
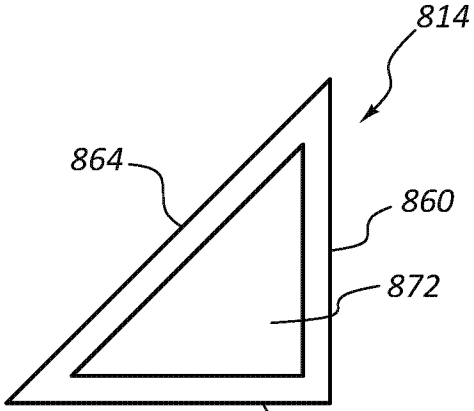

FIG. 12D shows an inner insert 814 having a hollow interior 872. The hollow interior may be formed concurrently with formation of the remaining portions of the inner insert 814. Alternatively, the hollow interior 872 may be formed after formation of the inner insert 814 structure. A boring, cutting, stamping, or other manufacturing step may be used to create the hollow interior 872.

The resulting sidewalls of the inner insert 814 may have a generally constant thickness associated with the cement surface 860, ground support surface 862 and backfill support surface 864. The hollow interior feature may be used in any of the inner insert embodiments shown with reference to FIGS. 12A-12E and other embodiments possible in accordance with the present disclosure. In some arrangements, the hollow interior 872 mirrors the outer peripheral shape cross-sectional shape of the inner insert 814. In other embodiments, the hollow interior may have a shape that is different from the perimeter shape such as, for example, a generally circular shape interior 872 used with the triangular shape outer periphery of inner insert 814.

Figure 12E:
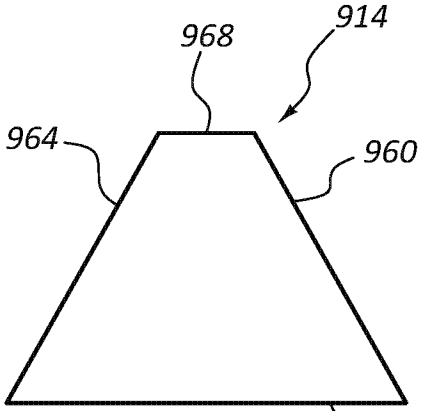

FIG. 12E shows an inner insert embodiment 914 having an equilateral triangular shape with a truncated upper corner of the triangle. The truncated upper portion defines a top surface 968. A top surface 968 may provide the desired improved grading to the top of the inner insert 914 with reduced chance of damaging the top surface 968. The tapered shape of cement surface 960 may provide improved strength and limited stress concentration along the inner, bottom surface of the cement structure (e.g., monolithic foundation). The ground support surface 962 has a generally planer construction. The backfill support surface 964 may mirror the tapered or angled orientation of the cement surface 960. Other variations of the wedge-shaped, triangular-shaped construction of the inner insert 914 are possible wherein different lengths, angled orientations, truncation locations, and the like are provided.

Figure 13:
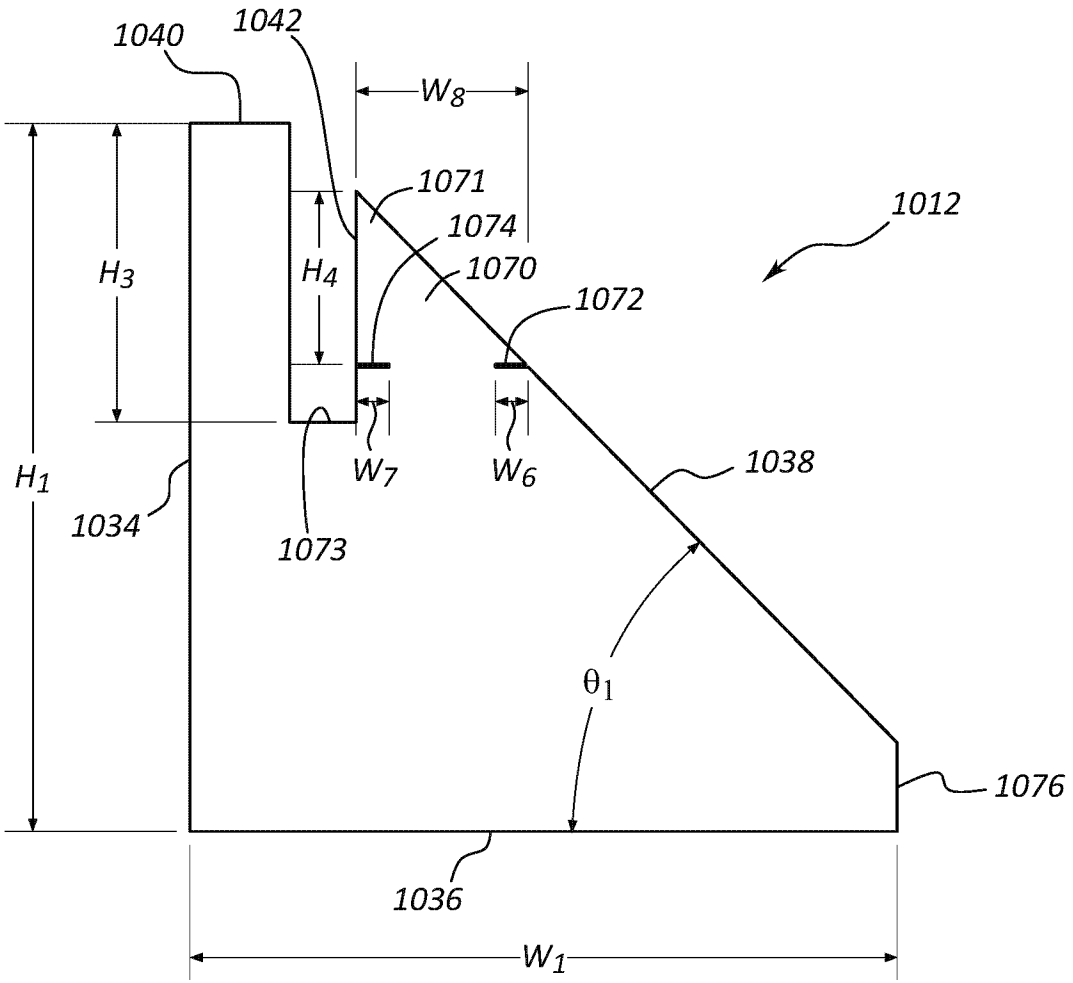
FIG. 13 is an end view of another cement form with a breakaway portion in accordance with the present disclosure.

FIG. 13 is an end view of another example cement form 1012. The cement form 1012 includes a first surface 1034, a second surface 1036, and a weight-bearing surface 1038. The cement form 1012 may also include a top surface 1040 and a connector groove 1042. The cement form 1012 may include a detachable portion 1070. A pair of relief cuts 1072, 1074 may define at least in part the detachable portion 1070. The detachable portion 1070 may also be referred to as a detachable tip portion 1070.

The detachable portion 1070 may have a height $H_4$ and a width $W_8$ as shown in FIG. 13. The relief cuts 1072, 1074 may have widths $W_6$, $W_7$, respectively. The detachable portion 1070 may extend along an entire length of the cement form 1012. In at least some examples, each of the relief cuts 1072, 1074 may also extend along an entire length of the cement form 1012, or at least along an entire length of the detachable portion 1070. The relief cuts 1072, 1074 may have different shapes, sizes, and orientations than those shown in FIG. 13. The widths $W_6$, $W_7$ may be increased to facilitate easier disconnection of detachable portion 1070. In some embodiments, only a single one of the relief cuts 1072, 1074 may be included. At least one of the relief cuts 1072, 1074 may be positioned and/or accessible within the connector groove 1042.

The detachable portion 1070 may be positioned adjacent to the connector groove 1042. The detachable portion 1070 may include a pointed structure or tip 1071. By removing the detachable portion 1070, more of the connector groove 1042 may be exposed. In at least some embodiments, once the detachable portion 1070 is removed, the connector groove 1042 may be less suitable for retaining the strip or insert 46 after removal of the connecting member 16 as described above with reference to FIGS. 1-4.

Removing the detachable portion 1070 may provide certain advantages when using the cement form 1012 as part of forming a cement structure, such as a monolithic building foundation. Maintaining connection of the detachable portion to the remainder of the cement form 1012 prior to and during formation of the cement structure may provide additional stability and connectivity between the plurality of cement forms used to form the cement structure. For example, the detachable portion 1070 may provide a more secure connection of a connecting member 16 that is inserted into the connector groove 1042 to provide improved interconnection of adjacent positioned cement forms. Once the cement structure is formed and the connector is removed from the connector groove 1042, the detachable portion 1070 may be removed. By removing the detachable portion 1070, backfill dirt may be filled along the weight-bearing surface 1038 at a lower height as compared to the embodiment of FIGS. 1-4 while still covering all of the cement form 1012 except that portion in contact with the cement structure. When the same amount of backfill is used to cover the cement form 1012 as in the embodiment shown in FIGS. 1-4, there is a greater depth of backfill all the way up to that portion of the cement form 1012 that is contacting the cement structure. This increased depth of backfill, particularly when the backfill is topsoil, may be advantageous for growing vegetation. When the cement form does not include a detachable portion adjacent to the connector groove 1042 or a similar location towards a top end of the cement form 1012, back fill dirt must be filled to a greater height in order to cover all of the weight-bearing surface 1038. Removing the detachable portion 1070 may result in little negative impact on the R value provided by the cement form.

The cement form 1012 may also include a truncated portion 1076 positioned at the intersection between surfaces 1036, 1038. The truncated portion 1076 may provide several advantages. For example, the truncated portion 1076 removes an otherwise pointed tip structure or portion of the cement form 1012. Pointed tip features, particularly those arranged along a bottom edge of the cement form, are easily damaged and/or broken off during manufacture, shipment, storage and use. By truncating the intersection between surfaces 1036, 1038, the chance of damage and/or breaking off of small portions of the cement form 1012 is reduced or eliminated. Further, removing the otherwise pointed tip along the bottom edge 1036 may reduce the amount of material needed for the cement form 1012. Reducing the amount of needed material can reduce the cost associated with manufacturing cement form 1012. Furthermore, removing the pointed tip and replacing it with the truncated portion 1076 may also reduce the total amount of space needed to ship and store the cement form 1012.

The cement form 1012 may include a weight-bearing surface 1038 that is arranged at an angle $\theta_1$ relative to the surface 1036. The angle $\theta_1$ may be in the range of, for example, about 20° to about 70°, and more particularly in a range of about 40° to about 50°. The smaller the angle $\theta_1$, the greater amount of downward applied force the backfill materials may apply to the weight-bearing surface 1038, which may otherwise assist in holding the cement form 1012 in place during setup of the cement form assembly and creating the cement structure. However, the greater the angle $\theta_1$, the less backfill required to cover the weight-bearing surface 1038.

The widths $W_6$ and $W_7$ of the relief cuts 1072, 1074 may be in the range of, for example, about 0.5 inch to about 3 inch, and more particularly in the range of about 0.5 inch to about 1 inch. The size of relief cuts 1072, 1074 may vary depending on, for example, the total width $W_1$ of the cement form 1012, the angle $\theta_1$ of the weight-bearing surface 1038, the height $H_1$ of the cement form 1012, and other features thereof. Similarly, the height $H_4$ of the detachable portion 1070 may be dependent on the same features, dimensions, etc. of the cement form 1012. Typically, the height $H_4$ is less than the height $H_3$ of the connector groove 1042. In at least some embodiments, the height $H_4$ is at least in the range of about 0.5" to about 3" less than the height $H_3$ such that the connector groove 1042 is capable of retaining the piece 46 even after removal of the detachable portion 1070. In other embodiments, the relief cut 1074 is positioned below the bottom surface of the connector groove 1042 such that the entirety of the connector groove 1042 is exposed after removal of the detachable portion 1070.

Figure 14:
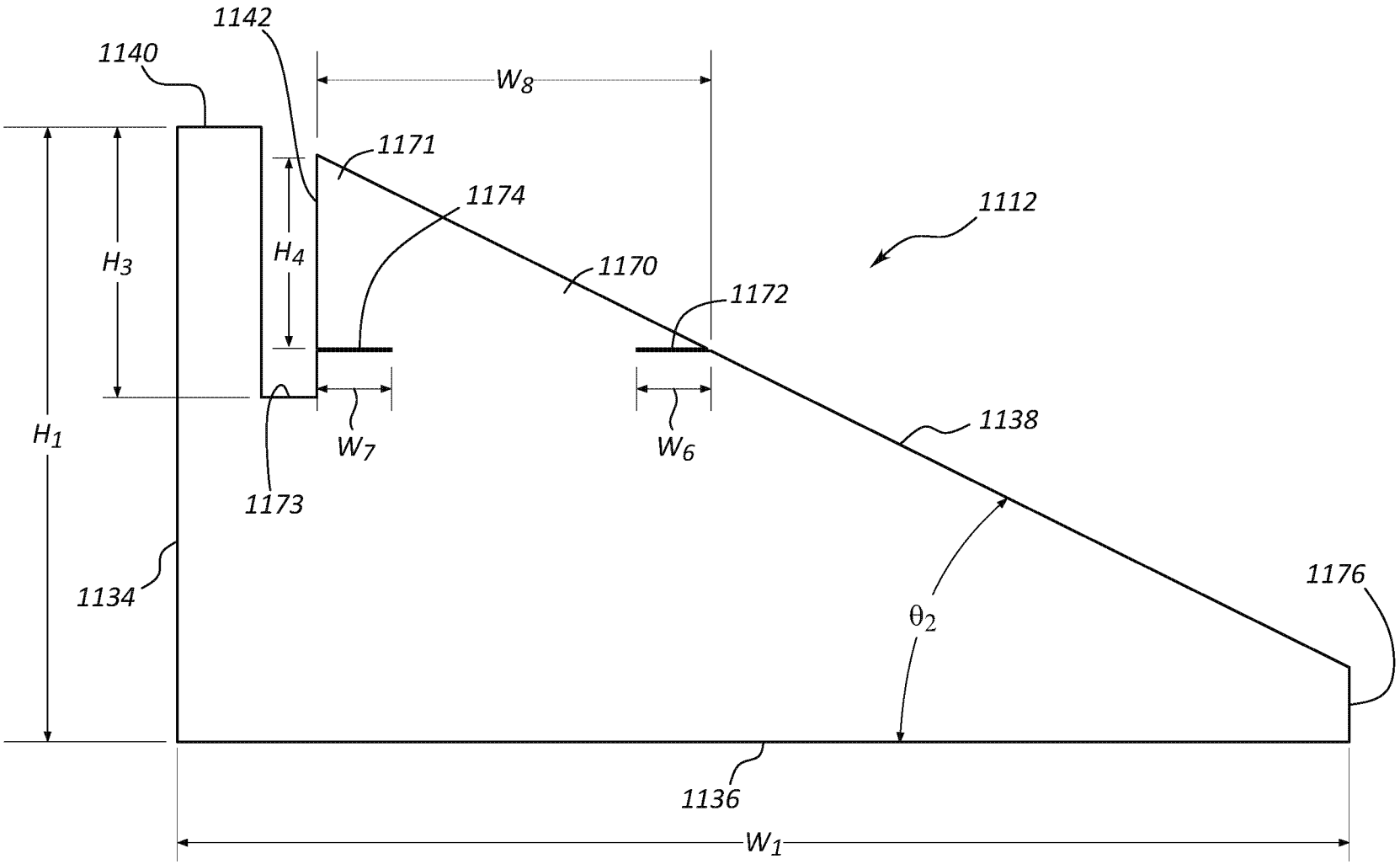
FIG. 14 is an end view of another cement form with a breakaway portion in accordance with the present disclosure.
Figure 15:
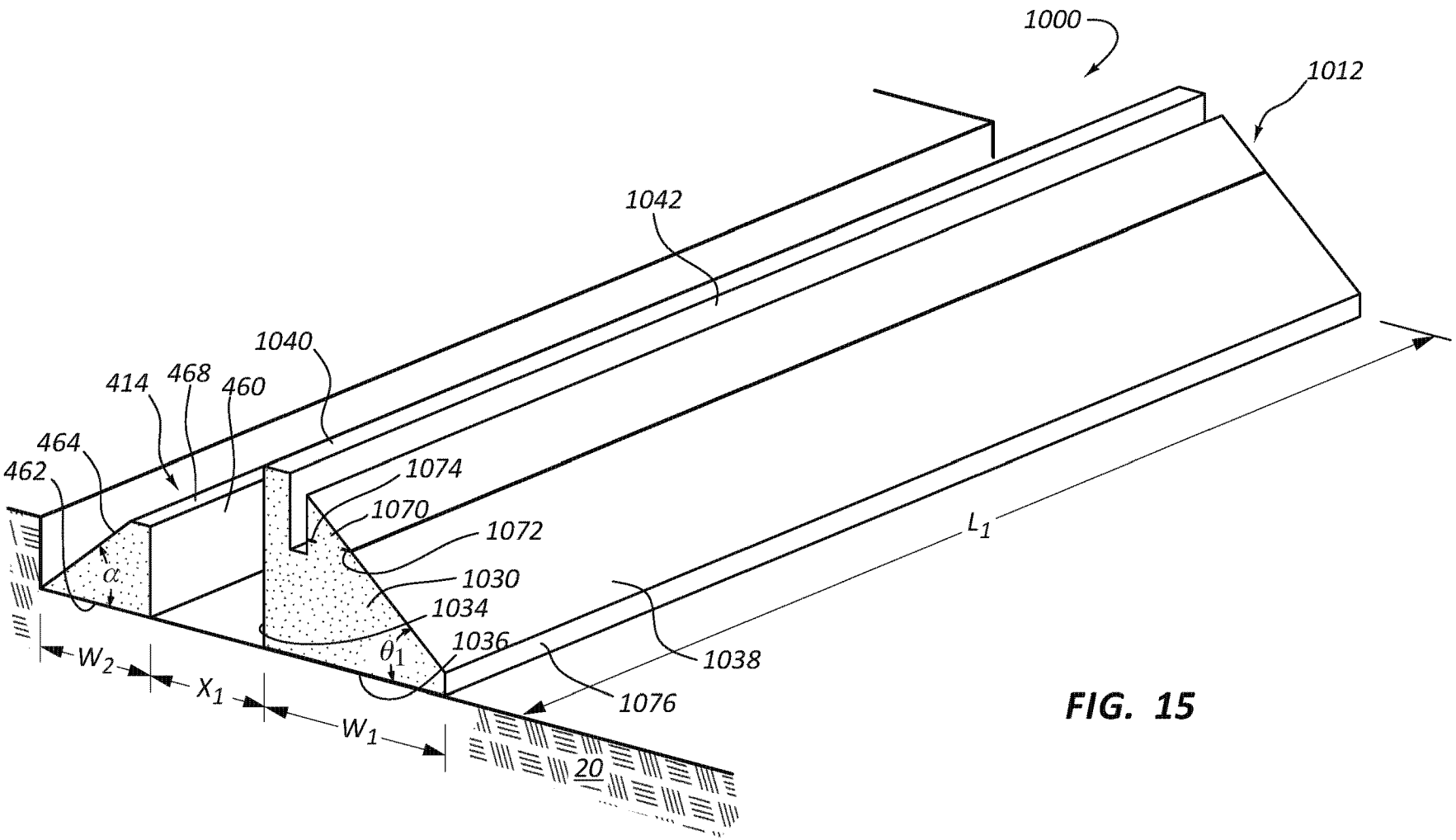
FIG. 15 is a perspective view of a cement form assembly that includes the cement form shown in FIG. 13 and the inner insert shown in FIG. 8 in accordance with the present disclosure.

Referring now to FIG. 14, another example cement form 1112 is shown and described. The cement form 1112 includes first and second surfaces 1134, 1136, a weight-bearing surface 1138, a top surface 1140, a connector groove 1142, and a detachable portion 1170. Cement form 1112 may also include relief cuts 1172, 1174 that define at least in part the detachable portion 1170. The relief cuts 1172, 1174 may have widths $W_6$ and $W_7$, respectively. The relief cut 1172 may be formed along the weight-bearing surface 1138. The relief cut 1174 may be formed along an inner surface of the connector groove 1142. The detachable portion 1170 and relief cuts 1172, 1174, may extend along an entire length of the cement form 1112 (e.g., length $L_1$ shown in FIG. 1).

The cement form 1112 may have a different cross-sectional shape and related dimensions as compared to the other cement forms disclosed herein. For example, the surface 1136 and surface 1138 may be arranged at an angle $\theta_2$ that has a lower value than the angle $\theta_1$ for the cement form 1012. The angle $\theta_2$ may be in the range of, for example, about 15° to about 40°, and more preferably in the range of about 20° to about 30°. The smaller angle $\theta_2$ for the arrangement between surfaces 1136, 1138 may result in a longer weight-bearing surface 1138 when the height $H_1$ remains the same. This longer weight-bearing surface 1138 may provide increased surface area for backfill to be positioned upon, thereby applying a greater downward force that may improve maintaining the cement form 1112 in a fixed position prior to and during formation of a cement structure. Further, the detachable portion 1170 may have a greater cross-sectional area because of the increased length of the weight-bearing surface 1138 when the height $H_4$ remains the same.

The cement form 1112 may also include a truncated portion 1176. The truncated portion 1176 may have the same or similar advantages as the truncated portion 1076 discussed above with referenced to FIG. 13.

The detachable portions 1070, 1170 shown in FIGS. 13 and 14 may be sized, shaped or otherwise formed as part of the respective cement forms 1012, 1112 to be removable with or without the relief cuts 1072, 1074 and 1172, 1174, respectively. In some examples, only a single relief cut is provided for each of the detachable portions 1070, 1170. In other examples, a single relief cut may extend a greater distance across a total width $W_8$ of the detachable portion. The relief cuts may be formed by cutting the material of the cement forms 1012, 1112. In other examples, the relief cuts or similar relief features may be formed in the cement form during formation of the cement forms (e.g., during a casting or molding process). The relief cuts may have a generally linear shape as shown in FIGS. 13 and 14. In other embodiments, the relief cuts may have a tapered or wedge-shaped cross-section that may help facilitate detachment of the detachable portions 1070, 1170. In still further embodiments, the relief cuts may be formed along only portions of the entire length of the cement form such as in 2 to 10 segments along the length. The distance $H_4$ from the relief cuts 1074, 1174 to the upper tip 1071, 1171 of the detachable portion 1170 may vary depending on a number of criteria. Typically, the relief cuts 1074, 1174 are position no further vertically from the upper tip 1071, 1171 than a base surface 1073, 1173 of the connector groove 1042, 1142. In some embodiments, the relief cuts 1074, 1174 be positioned downward beyond the base surfaces 1073, 1173. The cement forms 1012, 1112 may have a generally L-shaped cross-sectional shape after removal of the detachable portions 1070, 1170 depending on the shape and size of the detachable portions 1070, 1170.

Generally, the cement forms 1012, 1112 may be non-symmetrical or include cross-sectional shapes that are non-symmetrical. In particular, the cement form 1012 may have a greater height $H_1$ as compared to its width $W_1$. The cement form 1112 may have a greater width $W_1$ than its height $H_1$. In some embodiments, the truncated portions 1076, 1176 may be formed to make an otherwise relatively symmetrical cross-sectional shape for the cement form into a relatively non-symmetrical shape.

Referring now to FIGS. 15-19, the cement form 1012 is shown as part of a cement form assembly 1000. The cement form assembly 1000 may be used to form a cement structure, such as a monolithic building foundation. The cement form 1012 is shown in use with an inner insert 414, which is described in further detail above with reference to FIG. 8.

When preparing the cement form assembly 1000 for use in creating a monolithic building foundation, a ground support 20 is graded to a level surface. The inner insert 414 is positioned inward of the cement form 1012 a distance $X_1$.

Figure 16:
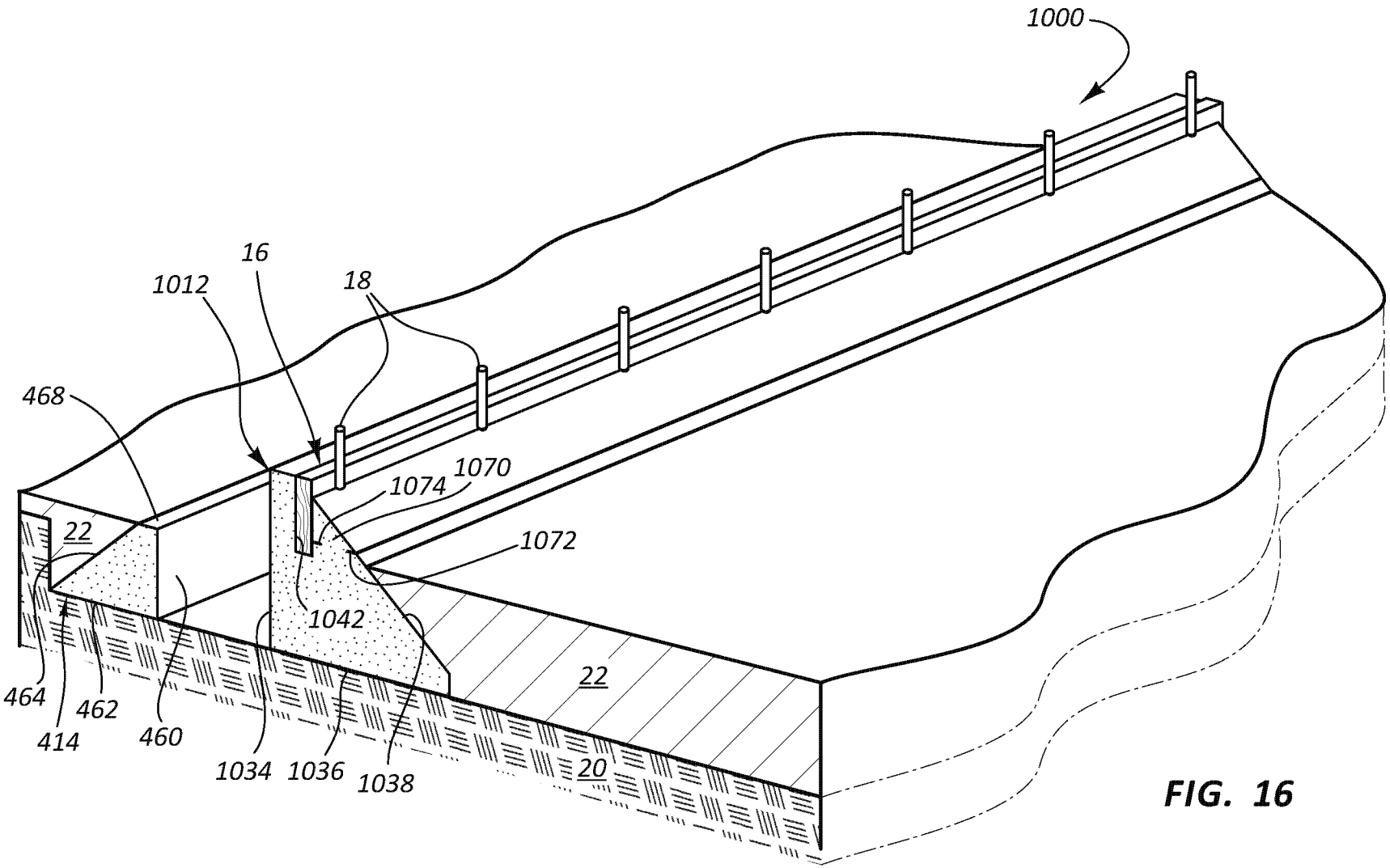
FIG. 16 is a perspective view of the cement form assembly shown in FIG. 15 with connecting members inserted.

FIG. 16 shows the cement form 1012 held in place with a plurality of stakes 18 that are driven through the material of the cement form 1012. In some embodiments, the cement form 1012 includes a plurality of pre-formed holes (not shown) that are receptive of the stakes In some embodiments, the stakes 18 may be driven through the detachable portion 1070. In other examples, the stakes 18 may be driven through other portions of the cement form 1012 instead of the detachable portion 1070. Backfill 22 may be positioned over portions of the weight-bearing surface 1038 and a backfill support surface 464 of the inner insert 414. Further, a plurality of connecting members 16 may be positioned in a connector groove 1042 of the cement form 1012 to align and connect together adjacent positioned cement forms 1012.

Figure 17:
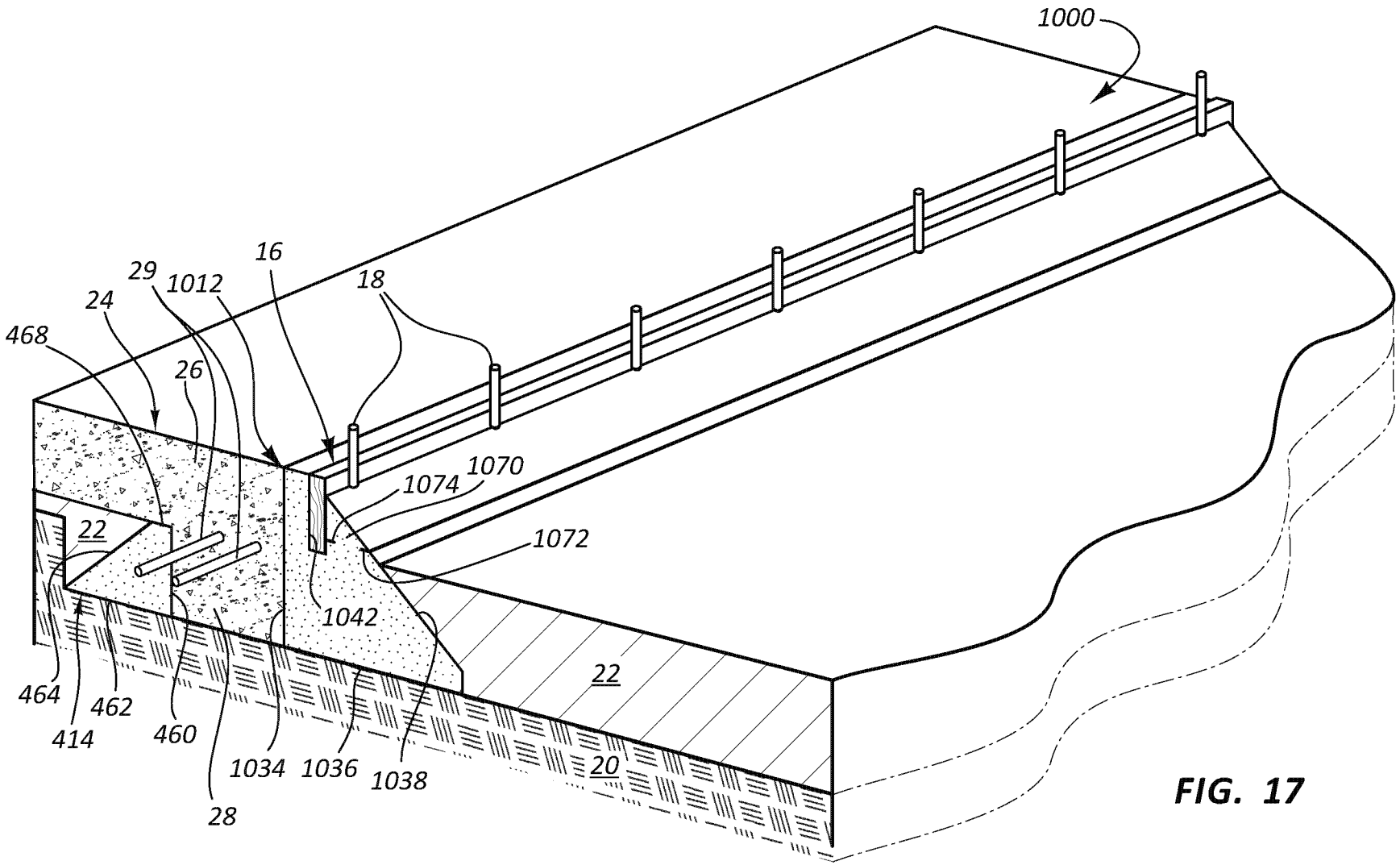
FIG. 17 is a perspective view of the cement form assembly of FIG. 16 in use to form a monolithic foundation.

FIG. 17 shows the cement structure 24 formed by pouring cement into the space between the inner insert 414 and the cement form 1012. Portions of the cement structure may extend across the top of the inner insert. Rebar members 29 may be positioned in the cement structure 24. The cement structure 24 may be referred to as a foundation that includes a slab portion 26 and a footing portion 28. The use of the inner insert 414 reduces the amount of cement that is required to form the foundation 24, particularly in the area where the slab portion 26 and footing portion 28 intersect.

Figure 18:
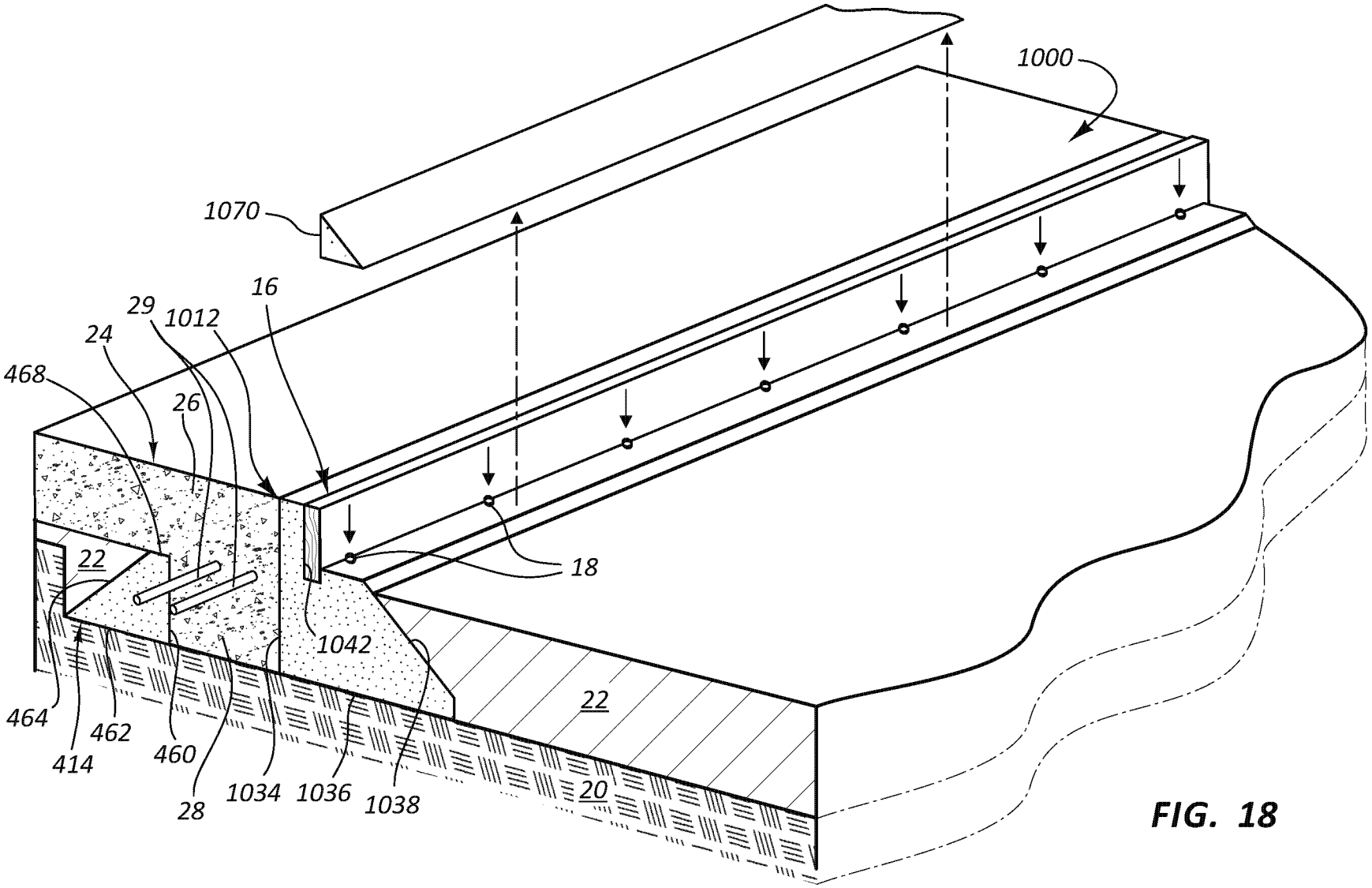
FIG. 18 is a perspective view of the cement form assembly shown in FIG. 17 with connecting members removed and the breakaway portion removed.
Figure 19:
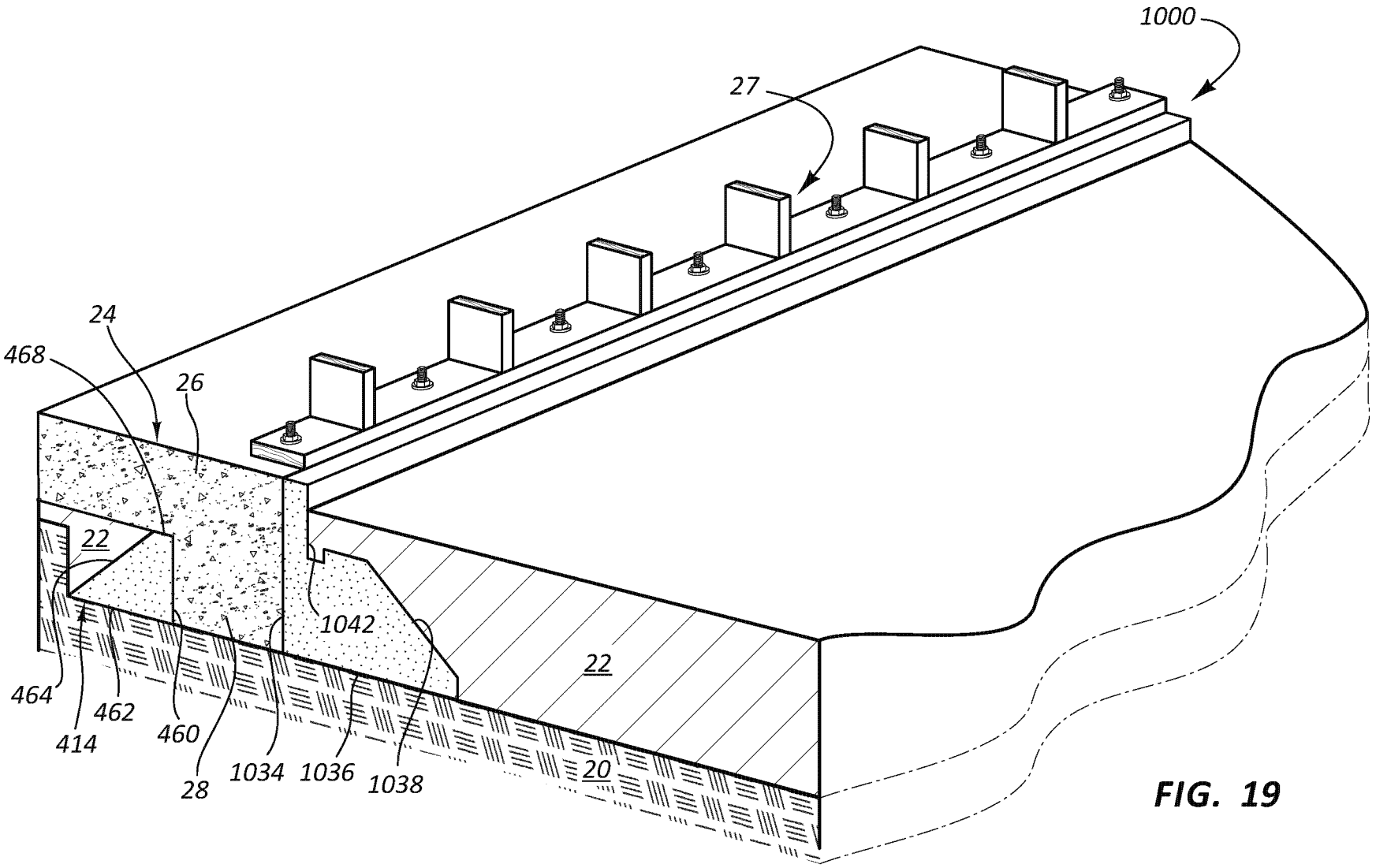
FIG. 19 is a perspective view of the cement form assembly shown in FIG. 18 with additional backfill covering the cement form a structure supported on the foundation.

After the foundation 24 has been poured, the connecting members 16 may be removed. The detachable portion 1070 may be detached from the cement form 1012, as shown in FIG. 18. The stakes 18 may be driven downward below the top surface 1040 and even as low as the location of the relief cuts 1072, 1074 after the detachable portion 1070 has been removed. The backfill 22 may be graded to a higher level to cover the stakes 18 and all of the cement form 1012 except for a portion 1075 that is in direct contact with the foundation 24. In some embodiments, the insert 46 (FIG. 4) may be reinserted into the connector groove prior to increasing the height of the backfill 22. In other embodiments, the stakes 18 may be removed rather than driven further into the cement form 1012. FIG. 19 shows the backfill 22 increased in height and a building structure (e.g., wall 27) positioned on top of the foundation 24.

The method of forming a foundation 24 described with reference to FIGS. 15-19 may be performed without using backfill 22 along the weight-bearing surface 1038 prior to forming the foundation 24. The backfill 22 may be added after removing the detachable portion 1070 or at other stages in the process.

Figure 20:
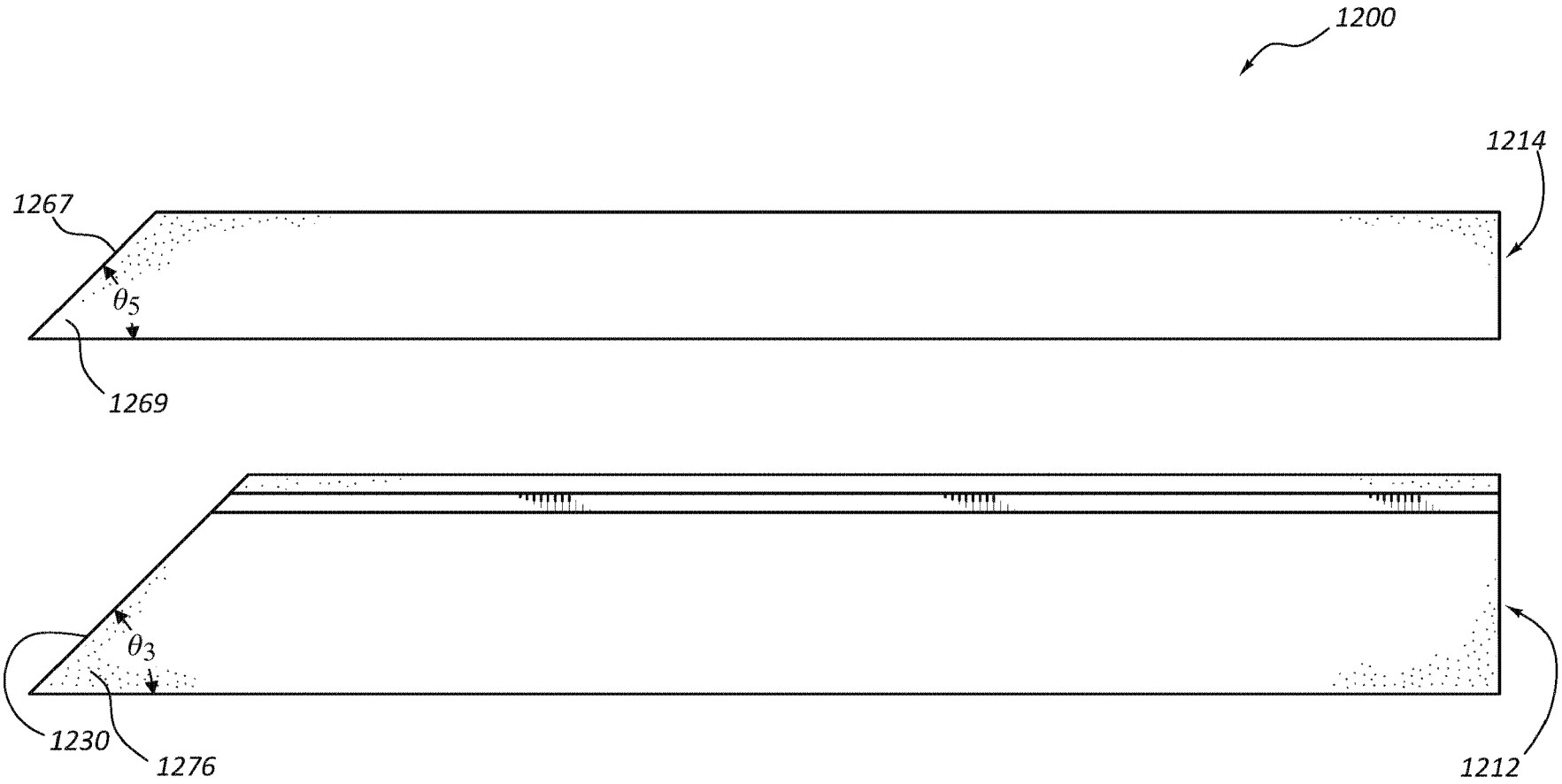
FIG. 20 is a top view of another cement form assembly with the cement form and inner insert have angled end portions in accordance with the present disclosure.
Figure 21:
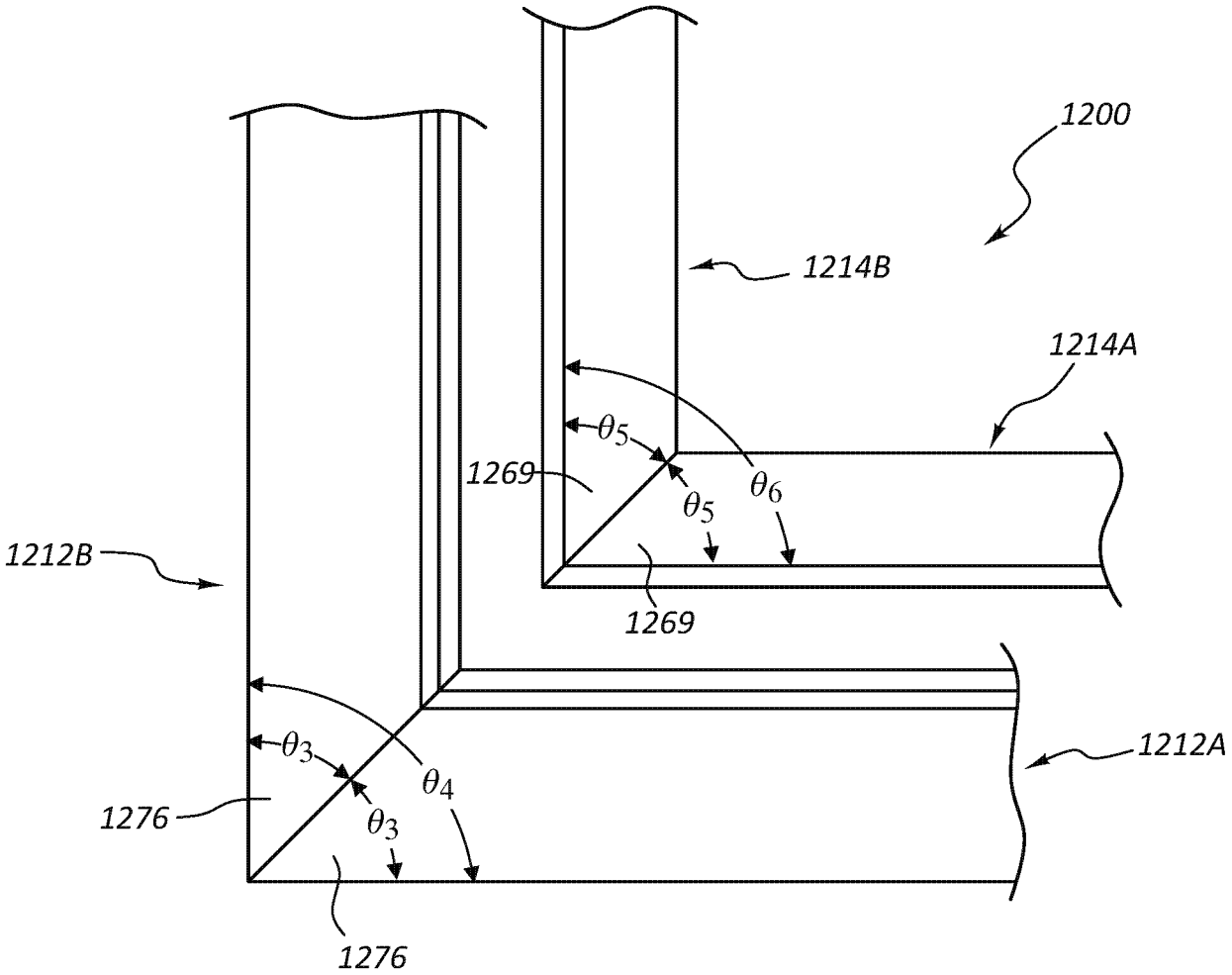
FIG. 21 is a top view of the cement form assembly shown in FIG. 20 with pairs of cement forms and inner inserts arranged at right angles relative to each other.

Referring to FIGS. 20 and 21, another example cement form 1212 and another example inner insert 1214 are shown and described. The cement form 1212 includes an angled end portion 1276 that defines an angled end surface 1230. The angled end portion 1276 is arranged at an angle $\theta_3$ relative to the length $L_1$ of the cement form 1212. Typically, the angle $\theta_3$ is about 45°. However, the angle $\theta_3$ may be modified depending on a desired angled arrangement between the cement form 1212 and an adjacent positioned cement form 1212.

FIG. 21 shows a pair of cement forms 1212A, 1212B that each include an angled end portion 1276 each having an angle $\theta_3$ of 45°. The angled end portions 1276 when mated together provide for a combined angle $\theta_4$ of 90° between the cement forms 1212A, 1212B. In another example (not shown) the angled end portion 1276 of cement form 1212A may have an angle $\theta_3$ of 60°, and the angled end portion 1276 of cement form 1212B has an angle $\theta_3$ of 60° so that the mated arrangement creates an angle $\theta_4$ of 120°.

FIG. 20 shows the inner insert 1214 having an angled end portion 1269 that forms an angled end surface 1267. The angled end portion 1269 is arranged at an angle $\theta_5$. FIG. 21 shows a pair of inner inserts 1214A, 1214B that are mated together at the angled end portions 1269, wherein each of the angles $\theta_5$ is about 45° and the combined angle of $\theta_6$ is about 90°. The angles $\theta_5$ may be varied to create a combined angle $\theta_6$ that is different from 90°.

The angled end portions 1276, 1269 shown in FIG. 20 may be included on a single end of the cement form 1212 and inner insert 1214, respectively, or may be included on each end of the cement form 1212 and inner insert 1214, respectively. The angled end portions 1276, 1269 may be referred to as angled ends, mitered ends, pre-cut angled ends, pre-cut surfaces, angled corner portions, and the like. The angled end portions 1276, 1269 may be created during manufacture of the respective cement form 1212 and inner insert 1214. In some arrangements, the angled end portions 1276, 1269 may be cut and/or formed prior to delivery of the cement form 1012 and inner insert 414 to a work site. A designer of a cement structure, such as a monolithic foundation, may determine in advance how many cement forms 1212 and inner inserts 1214 are needed to form the corners for the foundation. The designer can then order a certain number of cement forms 1212 and inner inserts 1214 to create the expected number of corners for the foundation. Further, the designer may order certain numbers of the cement forms without angled end portions (e.g., cement forms 12, 1012, 1112, etc.) and inner inserts (e.g., inner insert 14, 414, etc.) and the length of those cement forms and inner inserts to create a cement form assembly with as little waste material and the need for cutting the cement forms and inner inserts as possible.

Figure 22:
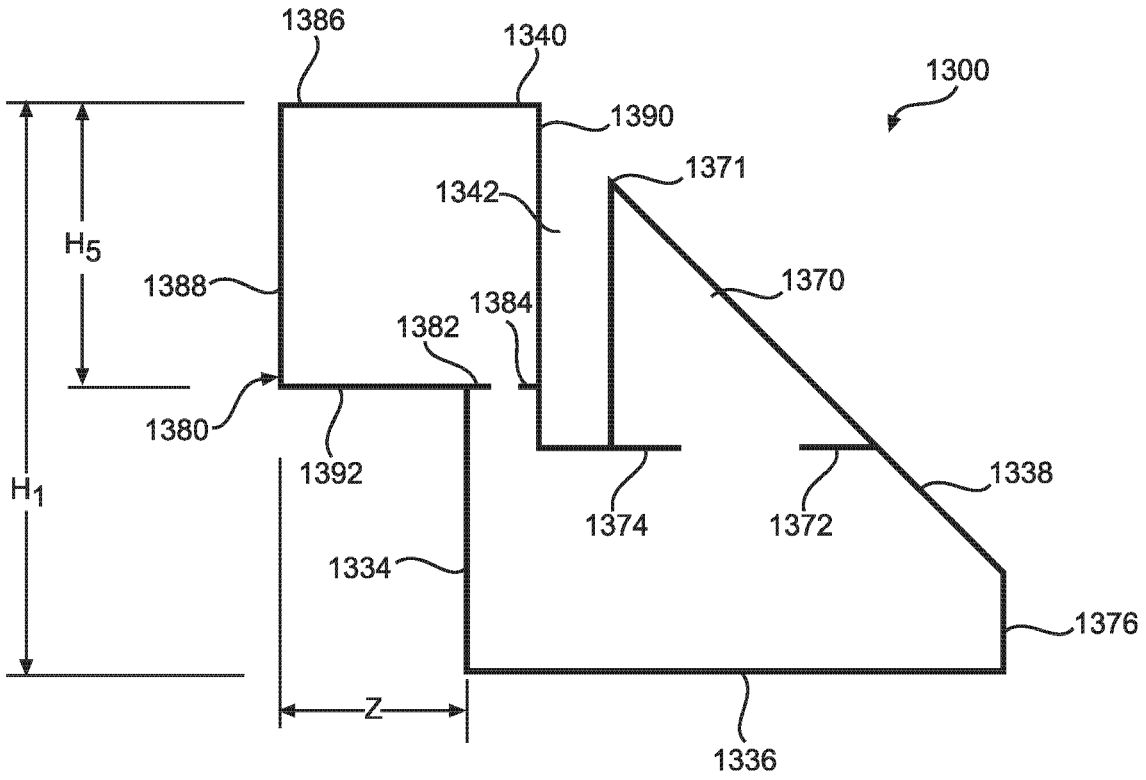
FIG. 22 is an end view of another example cement form in accordance with the present disclosure.
Figure 23:
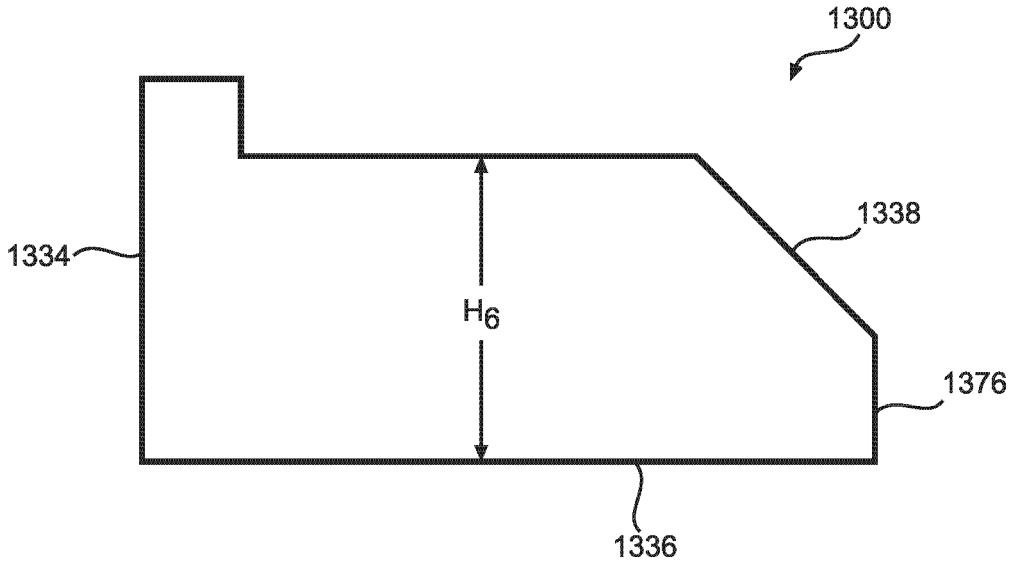
FIG. 23 is an end view of the cement form shown in FIG. 22 with attachable portions removed therefrom.
Figure 24:
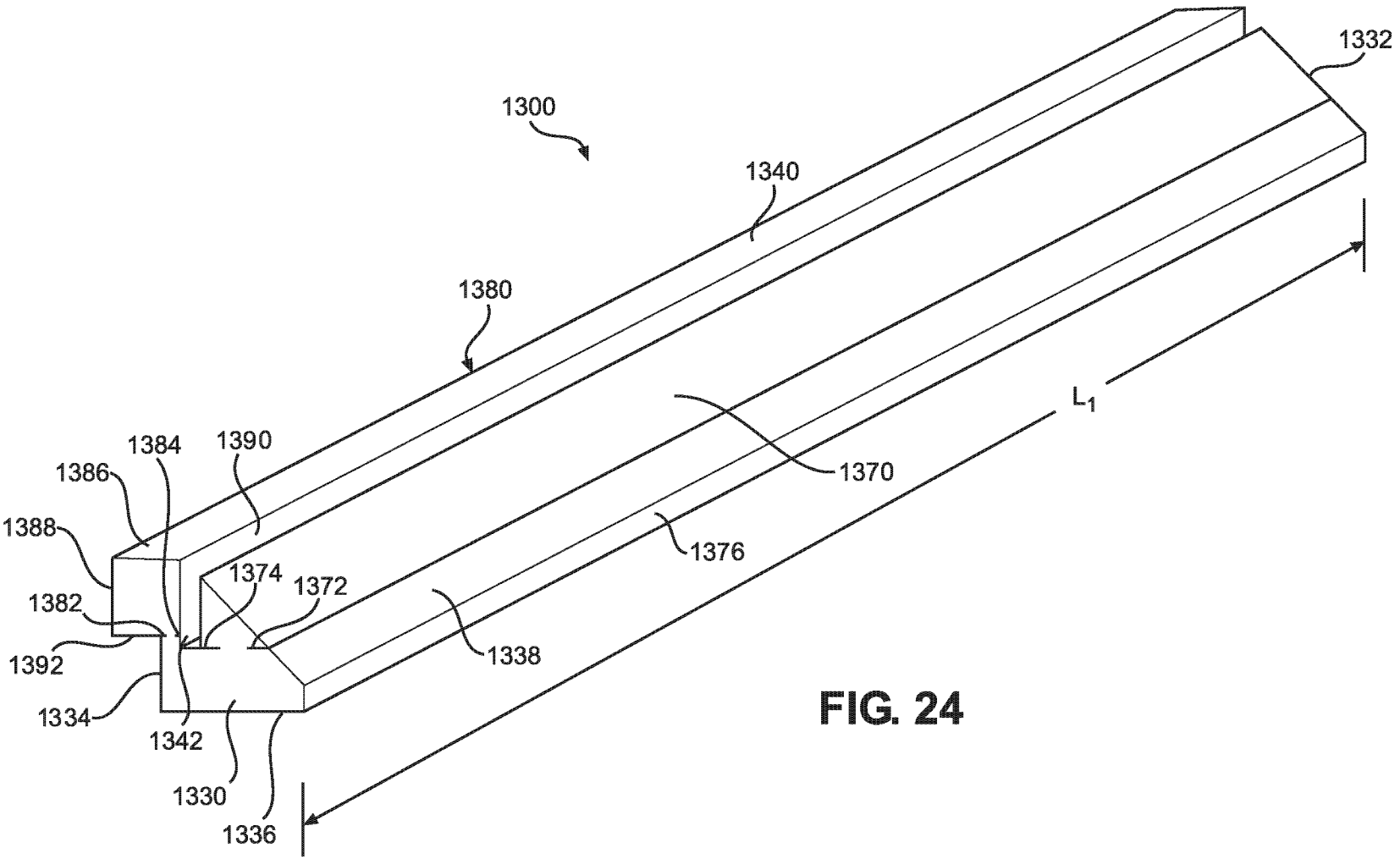
FIG. 24 is a perspective view of the cement form shown in FIG. 22.

Referring to FIGS. 22-24 another example cement form in accordance with the present disclosure is shown and described. The cement form 1300 includes one or more features used to form a brick ledge in the cement structure (e.g., cement foundation). The brick ledge feature of the cement form 1300 may provide a brick ledge feature in the cement structure that is below grade or otherwise below the top surface of the cement structure. The resulting brick ledge provided by using the cement form 1300 is positioned along a top, outer edge of the cement structure. The brick ledge is sized, shaped and arranged to support a layer of brick, such as a brick wall or brick facade positioned on an exterior of a building structure supported by a cement foundation that includes the brick ledge. The brick ledge may be referred to as a recessed brick ledge, a below-grade brick ledge, a brick recess, a brick recess, or brick ledge recess.

The cement form 1300 may include first and second surfaces 1334, 1336, a weight bearing surface 1338 extending at an angle relative to the first and second surfaces 1334, 1336, a top surface 1340, and a connector groove 1342. A top surface 1340 may define an uppermost surface or point for the cement form 1300 when the cement form is oriented in an upright position as shown in FIG. 22. Typically, the top surface of the cement structure being formed by the cement form 1300 is graded to the top surface 1340.

The connector groove 1342 is configured to receive one or more connecting members extending between and interconnecting adjacent positioned cement forms 1300. Example connecting members and use of the connector groove in a cement form are described above with reference to at least FIG. 11. In other embodiments, the cement form does not include a connector groove. In these embodiments, adjacent positioned cement forms may be held in place relative to each other without the use of an interconnecting connector that spans between the adjacent positioned cement forms.

The cement form 1300 may also include a detachable portion 1370 having a tip 1371 that defines an uppermost portion of the detachable portion 1370. The tip 1371 may be arranged at or adjacent to the opening of the connector groove 1342. The cement form 1300 may include one or more relief cuts 1372, 1374 that help facilitate detachment of the detachable portion 1370 from remaining portions of the cement form 1300. The relief cuts 1372, 1374 may be arranged coplanar so as to provide a relatively planar detachment point between the detachable portion 1370 and remaining portions of the cement form 1300.

FIG. 23 shows the detachable portion 1370 detached or otherwise removed from the cement form 1300. The detachment point (defined at least in part by the relief cuts 1372, 1374) may be arranged at a distance $H_6$ from the second or bottom surface 1336. This surface may be covered with backfill dirt after the building foundation is formed using the cement form 1300. The detachable portion 1370 may have other features and functionality similar to the detachable portions 1070, 1170 described above with reference to FIGS. 13-19.

The cement form 1300 may further include a truncated end or portion 1376 positioned between the second surface 1336 and the weight bearing surface 1338. The truncated portion 1376 may have similar features and functionality to the truncated portions 1076, 1176 described above with reference to FIGS. 13-14.

Cement form 1300 also includes a brick ledge portion 1380. The brick ledge portion 1380 may extend at least in part from the first surface 1334 a distance Z, as shown in FIG. 22. Brick ledge portion 1380 may have a height $H_5$ along the face or cement facing surface 1388. The brick ledge portion 1380 may also have a top surface 1386, an inner surface 1390 and a bottom surface 1392. The top surface 1386 may be coincident or coplanar with the top surface 1340 of the overall cement form 1300.

The cement form 1300 may include one or more relief cuts 1382, 1384 that help facilitate detachment of the brick ledge portion 1380 from the remaining portions of the cement form 1300. The relief cuts 1382, 1384 may be arranged coplanar with each other and help define a plane or surface once the brick ledge portion 1380 is removed, as shown in FIG. 23.

The brick ledge portion 1380 may have a variety of shapes and sizes, and may be positioned at various locations on the cement form 1300. For example, the brick ledge portion 1380 may be positioned at different locations along the first surface 1334, and/or exposed to the connector groove 1342. Typically, the brick ledge portion 1380 has a rectangular cross-sectional shape as shown in FIG. 22 that generally corresponds to the shape of the bricks being used. The shape of the brick ledge portion 1380 extending from the first surface 1334 into the cement structure being formed by the cement form 1300 (e.g., a cement foundation) defines a shape of the brick ledge formed in the cement structure along the perimeter top edge of that cement structure. The dimensions Z and $H_5$ may vary depending on different variables including, for example, the size and shape of the brick to be positioned in the brick ledge, the desired distance from the top surface of the cement structure to the brick ledge, inclusion of a layer of insulation between the brick and the brick ledge surfaces, etc. In some examples, the height $H_5$ is in the range from about 1 inch to about 12 inches, and more particularly about 4 inches to about 6 inches. The dimension Z is typically in the range from about 2 inches to about 6 inches, and more particularly about 3 inches to about 5 inches.

FIG. 24 shows a perspective view of cement form 1300 having first and second ends 1330, 1332. The detachable portion 1370 and brick ledge portion 1380 extend along the entire $L_1$ of the cement form 1300. In some embodiments, the brick ledge portion 1380 may include additional relief cuts that facilitate detaching sections of the brick ledge portion along the $L_1$. In some embodiments, it may be possible to cut, break off, or otherwise alter the size, shape or orientation of the brick ledge portion 1380.

Referring again to FIG. 22, the cement form 1300 has an overall height $H_1$ between the second surface 1336, which is intended to be supported on a ground surface, and the top surface 1340, which corresponds to the top surface 1386 of the brick ledge portion 1380. The height $H_1$ typically is in the range of about 10 inches to about 14 inches, and more particularly about 12 inches. Other heights are possible in other embodiments, such as greater heights for the cement form 1400 described below.

Figure 25:
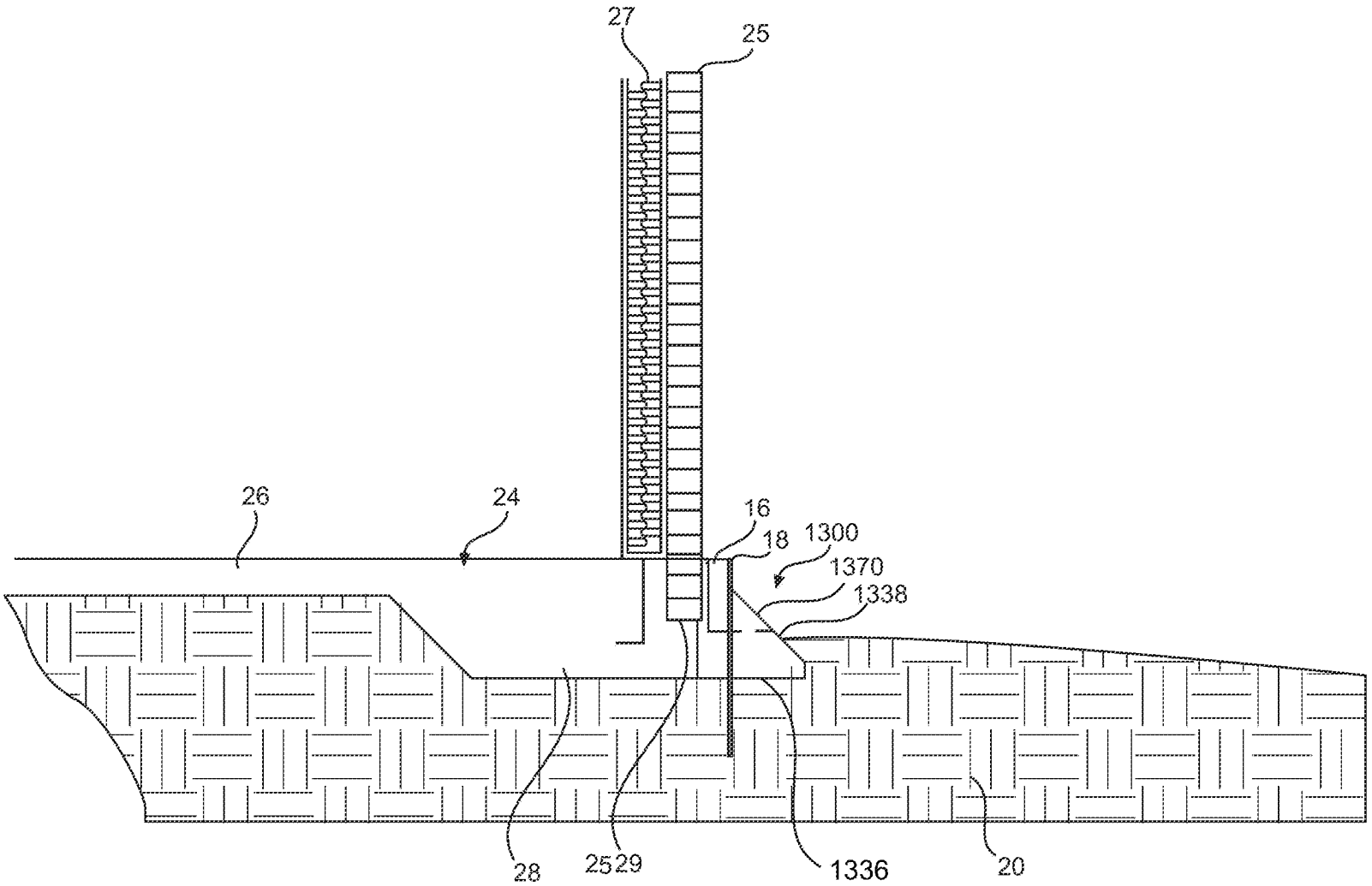
FIG. 25 is an end view of the cement form shown in FIG. 22 in use with a cement foundation, building wall, and layer of brick.

FIG. 25 shows the cement form 1300 in use. The cement form 1300 may be held in place with one or more stakes 18, a connecting member 16, and backfill dirt. The cement form 1300 is fixed relative to a ground surface 20 with the second surface 1336 facing and supported on the ground surface 20. At least some backfill dirt may be positioned on the weight bearing surface 1338 to help hold the cement form 1300 in place while pouring the cement foundation 24.

The cement foundation 24 includes a slab portion 26 and a footing portion 28 as described above with reference to at least FIGS. 3, 4, and 17-19. The brick ledge portion of the cement form is maintained in place on the cement form during formation of the foundation 24. After the foundation has been poured and at least partially cured, the brick ledge portion is removed, thereby providing a recess or ledge feature 2529 within the foundation 24 to receive bricks 25. The bricks 25 may be supported on the ledge 2529 and may also be secured to a wall 27 that is supported on a top surface of the foundation 24. The ledge 2529 is recessed or otherwise positioned below the grade of the top surface of the foundation 24.

Portions of the cement form 1300 may cover or overlap with the brick wall 25 within the recess 2529. The cement form 1300 may provide some insulating properties for the brick 25 as well as insulating properties for the foundation 24.

After the foundation 24 is at least partially cured, the brick ledge portion 1380 as well as the detachable portion 1370 can be removed from the cement form 1300. The connecting member 16 and stakes 18 may also be removed. Backfill dirt (e.g., backfill 22 shown in FIGS. 2-4 and 16-19) may help hold the cement form 1300 in place relative to the foundation 24. The backfill 22 may cover otherwise exposed surfaces of the cement form after removing the detachable portion 1370 and/or the brick ledge portion 1380.

Figure 26:
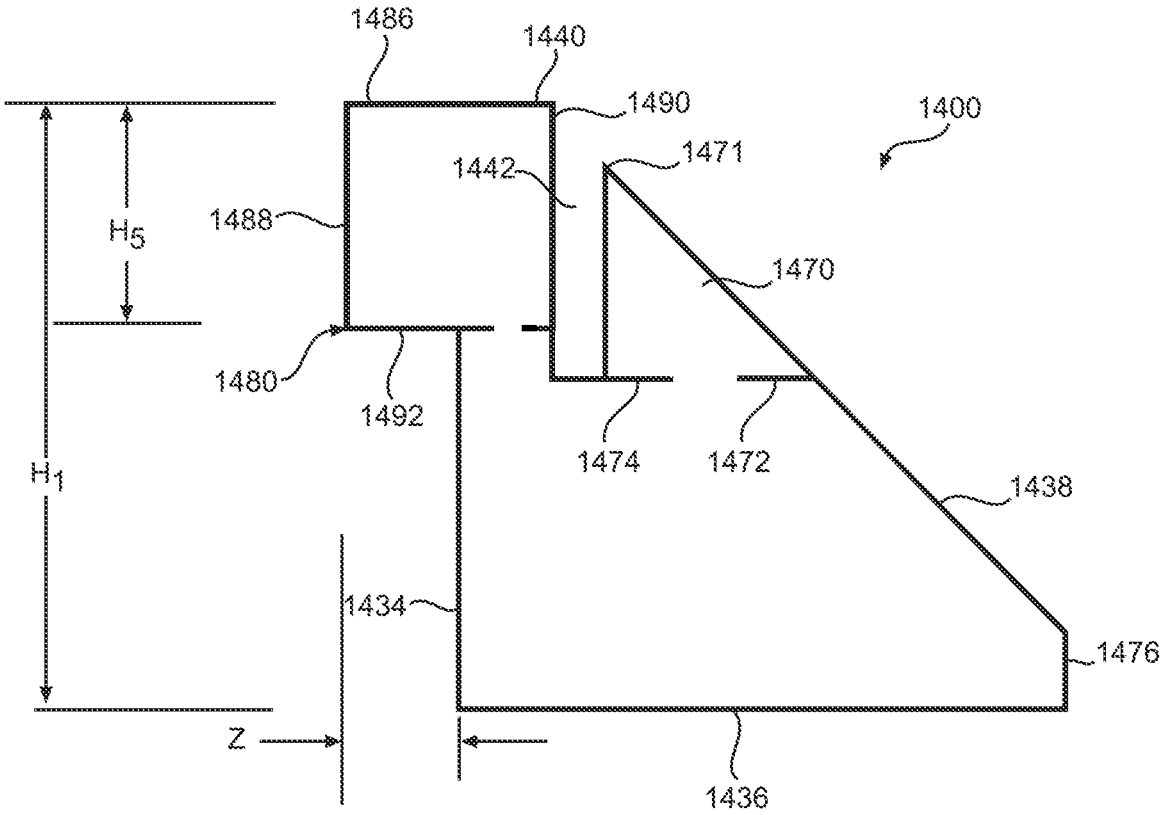
FIG. 26 is an end view of another example cement form in accordance with the present disclosure.
Figure 27:
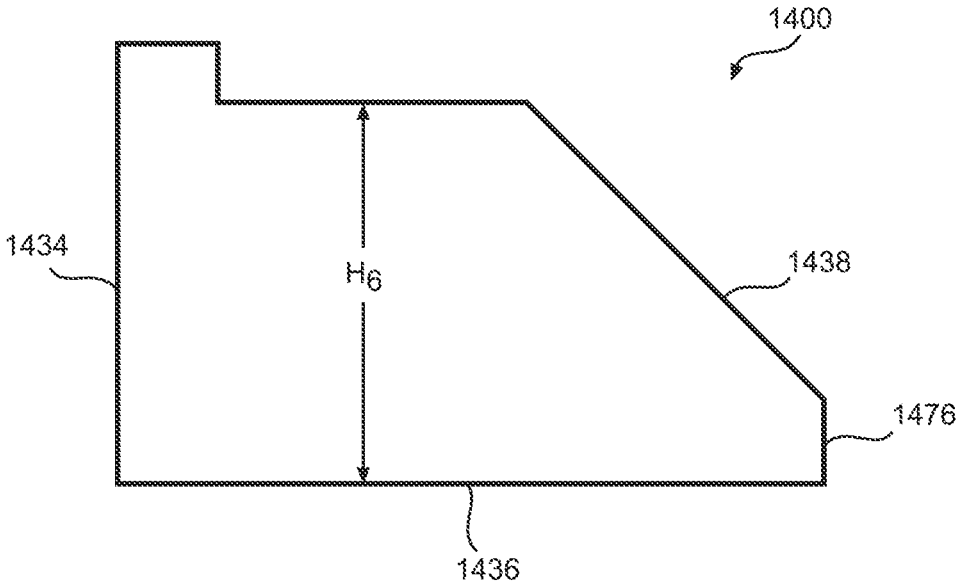
FIG. 27 is an end view of the cement form shown in FIG. 26 with attachable portions removed therefrom.
Figure 28:
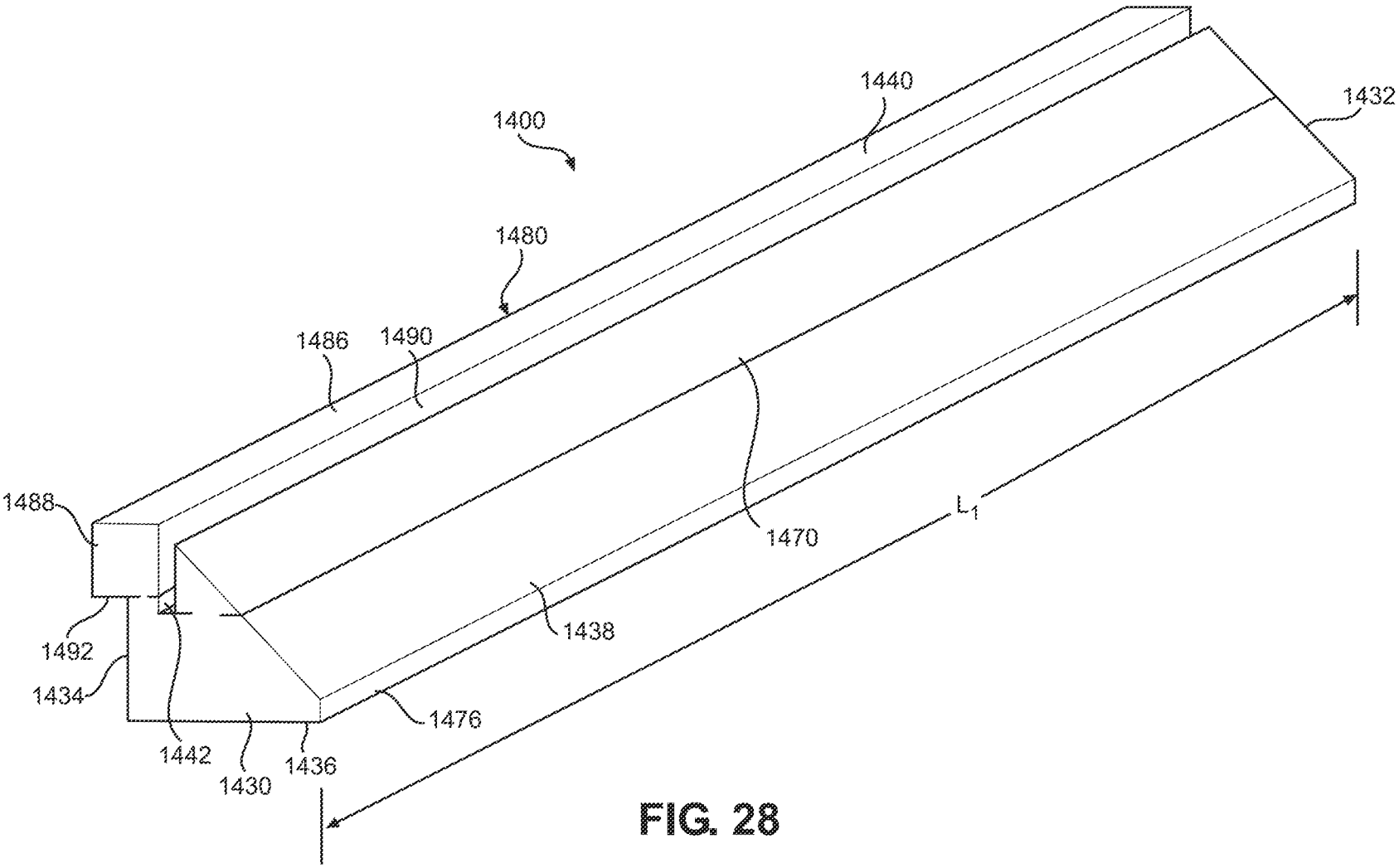
FIG. 28 is a perspective view of the cement form shown in FIG. 26.

Referring now to FIGS. 26-28, another example cement form 1400 is shown and described. The cement form 1400 may include many of the same or similar features as the cement form 1300 described above with reference to FIGS. 22-25. The cement form 1400 includes first and second ends 1430, 1432, first and second surfaces 1434, 1436, a weight bearing surface 1438, a top surface 1440, and a connector groove 1442 sized to receive a connecting member. The cement form 1400 may also include a detachable portion 1470 having a tip 1471, one or more relief cuts 1472, 1474, and a truncated portion or surface 1476.

Cement form 1400 may include a brick ledge portion 1480 having a top surface 1486, a face or cement facing surface 1488, an inner surface 1490, and a bottom surface 1492. The face 1488 may be offset a distance Z from the first surface 1434. The brick ledge portion 1480 may have a height $H_5$ along the face 1488. An overall height $H_1$ of the cement form 1400 may be greater than the height $H_1$ of the cement form 1300 described above. As a result, the height $H_6$ of the cement form shown in FIG. 27 may be greater when the detachable portion 1470 and brick ledge portion 1480 are the same size as corresponding parts in cement form 1300. Many other sizes and shapes are possible for the detachable portion 1470 and brick ledge portion 1480 that may result in different sizes, shapes and other features for the cement form 1400 after removal of the detachable portion 1470 and brick ledge portion 1480 (FIG. 27). In at least one example, the $H_1$ for the cement form 1400 is in the range from about 15 inches to about 30 inches, and more particularly about 18 inches to about 24 inches.

Referring to FIG. 28, the cement form 1400 may have a length $L_1$. For all of the cement forms disclosed herein, the length $L_1$ may be greater than the height $H_1$ and a width measured across the base or second surface 1436 (or corresponding surface in other embodiments) from the first surface 1434 to the truncated surface 1476. Thus, the cement form 1400 may be considered an elongated structure wherein the length measurement is measured along the first surface 1434.

Furthermore, the cement form 1400 and other cement forms having a brick ledge portion as disclosed herein, may have a generally wedge-shaped cross-section or end view (e.g., FIG. 26). Many other cross-sectional shapes and structures are possible for the cement forms 1300, 1400 including, for example, those alternative structures described above with reference to FIGS. 12A-12E. Any of these cross-sectional shapes may include a brick ledge portion that is integrally formed with remaining portions of the cement form, detachable (e.g., as facilitated by one or more relief cuts), detachably mounted, or removable altogether along with remaining portions of the cement form after formation of the cement foundation. That is, in at least some embodiments, the brick ledge portion is not intended to be detachable from the remaining portions of the cement form, and the entire cement form, including the brick ledge portion, is intended to be removed after formation of the cement foundation thereby leaving behind a brick ledge feature formed in the perimeter edge of the foundation.

While there are advantages to leaving the cement form, or at least portions thereof, in the ground adjacent to and in contact with the foundation after formation of the foundation (e.g., for insulating properties), it is also possible to remove the cement form in its entirety, including the brick ledge portion, after formation of the foundation, and still maintain many of the advantages associated with using the cement forms disclosed herein. In particular, using a foam cement form, wherein the cement form is formed in its entirety from a foam material that is lightweight, relatively easy to cut and otherwise manufacture, and has low weight requirements for shipping and handling purposes, as compared to other types of cement forms, has many inherent advantages even if removed in its entirety after formation of the cement structure it is used to create.

Although using foam materials are described for the cement forms disclosed herein, and the brick ledge portion of the cement form, other types of materials may also be used and have certain advantages compared to foam. Other example materials include other polymer materials, natural materials such as wood or paper, metal materials, composite materials, laminate materials, and fiberglass.

The brick ledge portion of the cement form may be formed integrally as a single piece with remaining portions of the cement form. For example, the brick ledge portion and remaining portions of the cement form may be cut from a continuous, solid piece of foam material, molded as an integral single piece, or the like. Alternatively, the brick ledge portion may be formed as a separate piece that is connected to remaining portions of the cement form in a separate assembly step as shown in the examples of FIGS. 29-32.

Figure 29:
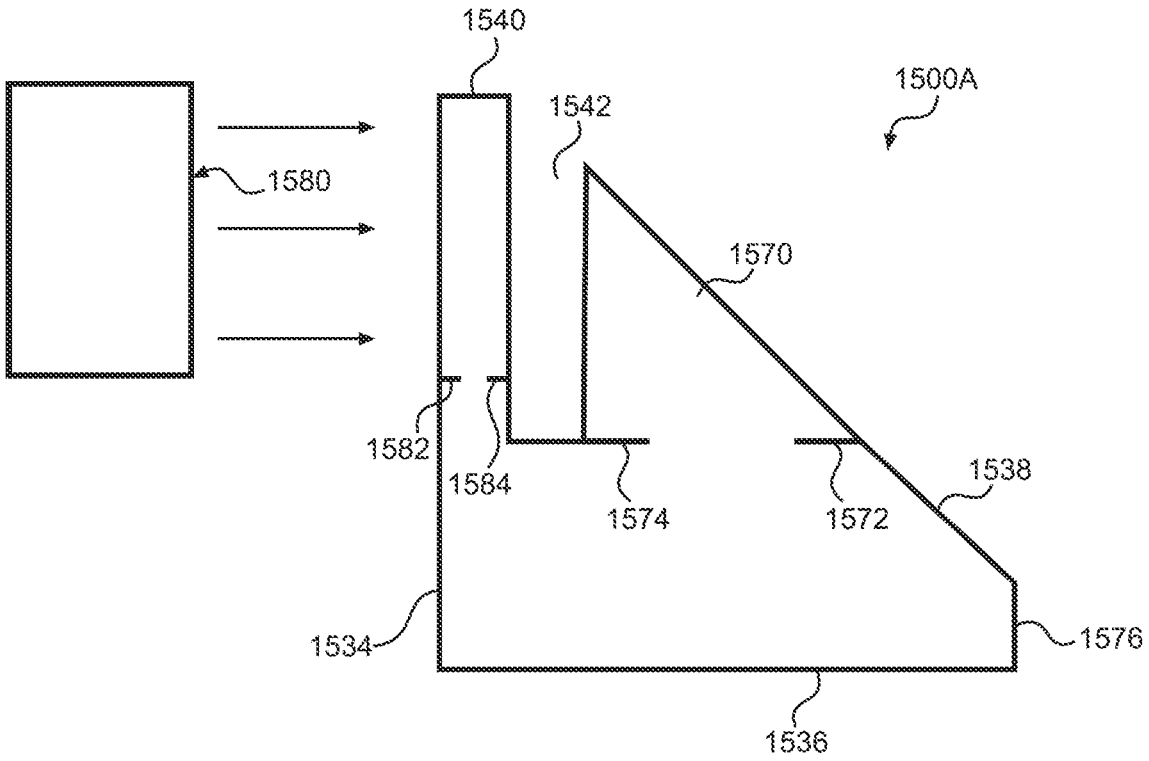
FIG. 29 is an exploded end view of another example cement form in accordance with the present disclosure.
Figure 30:
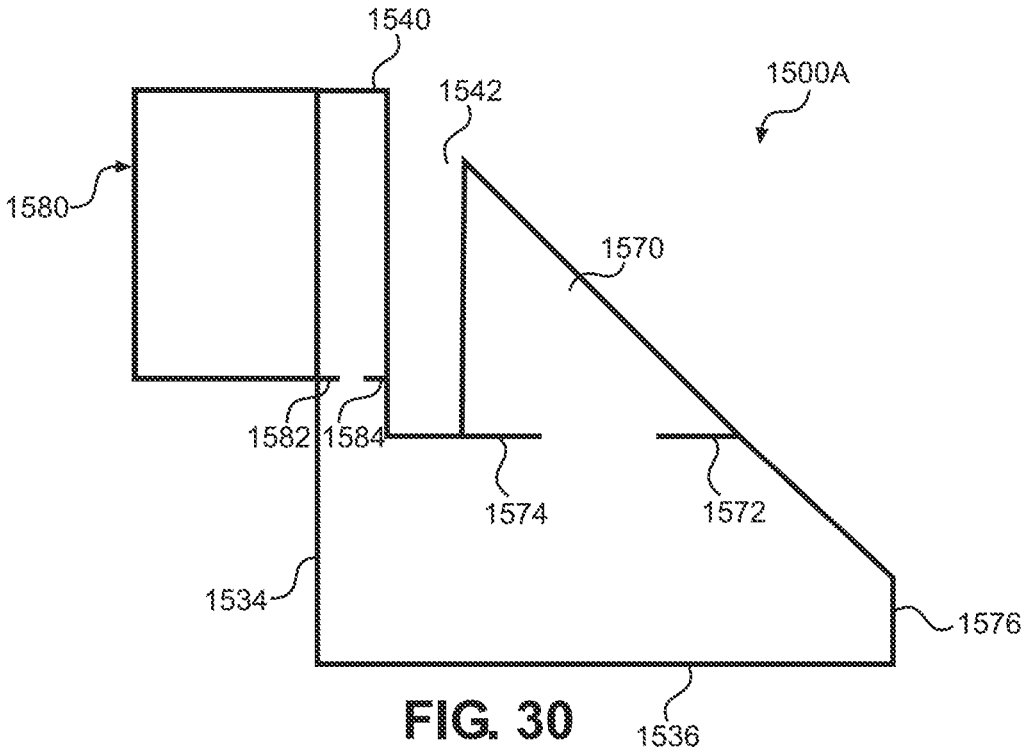
FIG. 30 is an assembled end view of the cement form shown in FIG. 29.

FIGS. 29 and 30 show a cement form 1500A having first and second surfaces 1534, 1536, a weight bearing surface 1538, a top surface 1540, and a connector groove 1542. In at least some embodiments, the cement form 1500A may also include a detachable portion 1570 having a tip 1571, relief cuts 1572, 1574, and a truncated portion 1576. The cement form 1500A may have many of the same or similar features as the cement forms 1000, 1100 described above with reference to FIGS. 12-19.

The cement form 1500A may further include one or more relief cuts 1582, 1584 to help facilitate breaking off a portion of the cement form that supports a brick ledge portion 1580, such as a portion of the first surface 1534 and a surface exposed within the connector groove 1542. The separate brick ledge portion 1580 may be connected to first surface 1534 using, for example, a fastener, adhesive, heat welding, or other bonding method or material. The cement form 1500A with brick ledge portion 1580 mounted thereto is shown in FIG. 30. In at least some embodiments, the brick ledge portion 1580 is releasably mounted to the first surface 1534.

The cement form 1500A may be used to create a cement structure such as a monolithic building foundation. After the foundation is poured and at least partially cured, the brick ledge portion 1580 may be detached from the remaining portions of the cement form 1500A such as, for example, along the relief cuts 1582, 1584. The detachable portion 1570 may also be detached along, for example, the relief cuts 1572, 1574. The remaining portions of the cement form 1500A may be left in the ground to support and/or insulate the cement foundation and/or bricks that are positioned in the brick ledge of the foundation, which was formed by the brick ledge portion 1580. The remaining portions of the cement form 1500A can be left in the ground and covered with backfill dirt.

Figure 31:
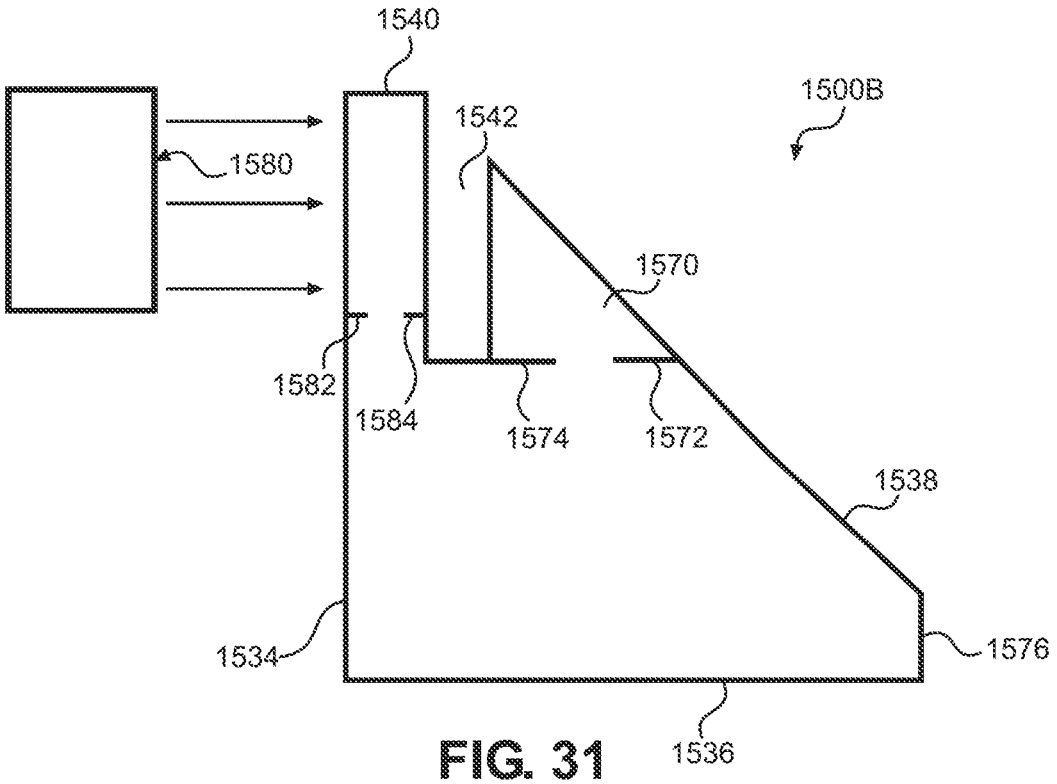
FIG. 31 is an exploded end view of another example cement form in accordance with the present disclosure.
Figure 32:
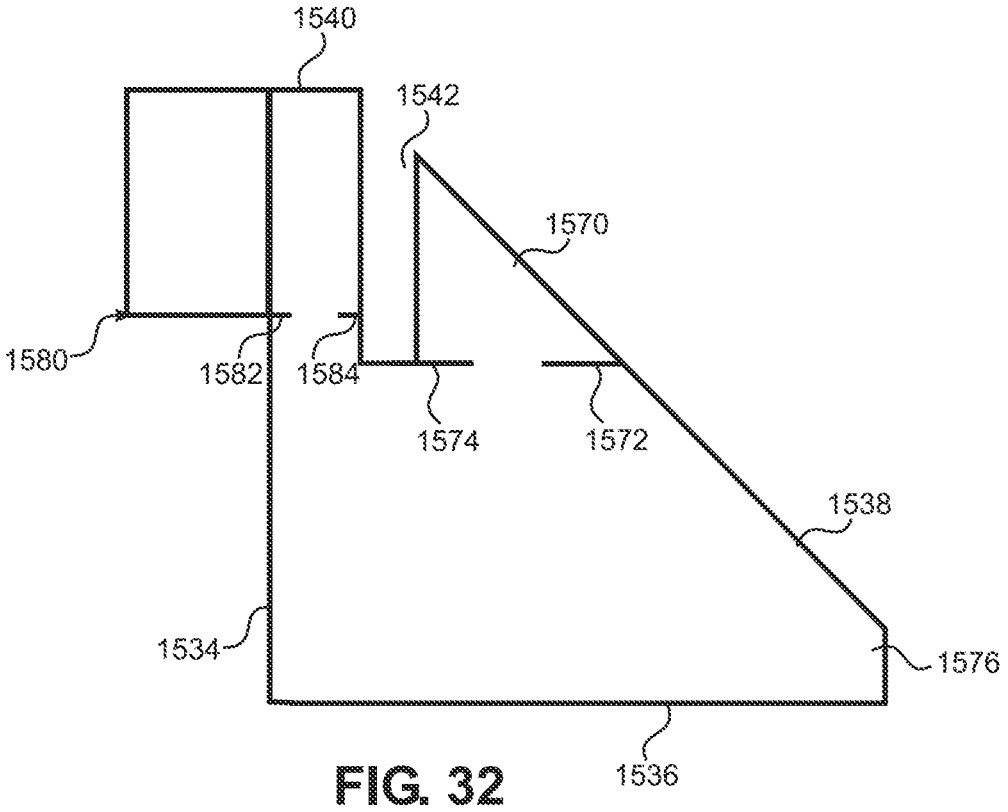
FIG. 32 is an assembled end view of the cement form shown in FIG. 31.

FIGS. 31 and 32 show another cement form 1500B having many of the same or similar features as the cement form 1500A, and also similar features to the cement form 1300 and/or 1100 described above. The cement form 1500B includes a separately formed brick ledge portion 1580 that is connected to the cement form 1500B in a separate assembly step to create the cement form assembly shown in FIG. 32. The brick ledge portion 1580 may be connected to the first surface 1534 using a variety of connection methods or structures including, for example, fasteners, adhesives, and other bonding agents. As with the cement form 1500A described above, the cement form 1500B may be used to create a cement structure such as a monolithic building foundation. After the cement structure is poured and at least partially cured, the brick ledge portion is removed (e.g., along the relief cuts 1582, 1584), detachable portion 1570 may be removed (e.g., along relief cuts 1572, 1574), and backfill dirt may be placed over some or all of the otherwise exposed portions of the cement form 1500B.

Figure 33:
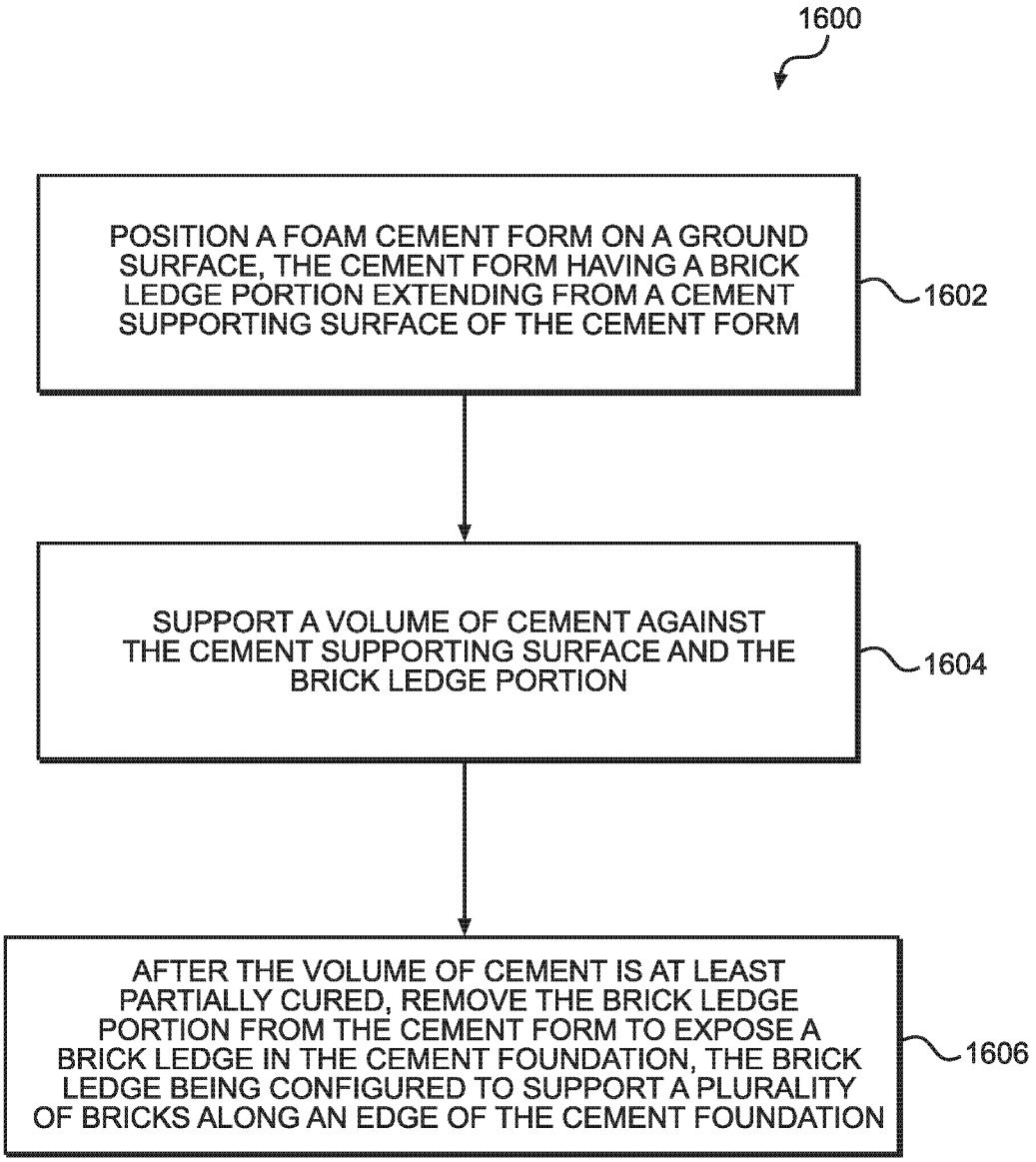
FIG. 33 is a flow diagram showing steps of an example method related to the cement forms shown in FIGS. 22-32.

FIG. 33 illustrates steps of an example method 1600 related to use of the cement form with brick ledge portion described with reference to FIGS. 22-32. Method 1600 may be one example of many different types of methods having fewer or greater number of steps compared to those shown in FIG. 33.

Method 1600 may include, at block 1602, positioning a foam cement form on a ground surface, wherein the cement form has a brick ledge portion extending from a cement supporting surface of the cement form. Block 1604 includes supporting a volume of cement against the cement supporting surface and the brick ledge portion. At block 1606, the method 1600 includes, after the volume of cement is at least partially cured, removing the brick ledge portion from the cement form to expose a brick ledge in the cement foundation. A brick ledge may be configured to support a plurality of bricks along a perimeter, side edge, and/or sidewall of the cement foundation.

The method 1600 may also include providing the brick ledge portion as a rectangular shape to form the brick ledge with a right-angled shape. The cement form may include at least one relief cut, and removing the brick ledge portion may include breaking off the brick ledge portion at the at least one relief cut. The cement supporting portion may be arranged parallel to a vertical plane, and the cement form may include a ground support surface arranged perpendicular to the cement supporting surface and facing a ground surface upon which the cement form is supported. The cement form may include a connector groove extending along a length of the cement form in a horizontal direction, and the method may include inserting a connector member into the connector groove to interconnect adjacent positioned cement forms.

The cement forms with brick ledge portions may provide a number of advantages as compared to other types of cement forms and brick ledge forming features. For example, the cement forms disclosed herein may comprise a foam material that is relatively inexpensive to make, manufacture, ship, handle, and use at a construction site. The relatively low cost of the cement forms made of foam may make it economically feasible to discard all or portions of the cement form after forming a cement structure such as a monolithic building foundation. The foam material may be beneficial to leave in place in the ground adjacent to the cement structure after forming the cement structure to provide an insulating function. The brick ledge portion may be removable from the cement form after forming the cement structure and disposed of at a relatively low-cost point. This disposability aspect may save significant amounts of time otherwise required to handle, clean, and store a reusable cement forming features.

The apparatuses and methods disclosed herein provide numerous advantages as compared to the traditional cement form structures and related methods of forming cement structures such as monolithic cement foundations described above with reference to FIGS. 34A and 34B. For example, the apparatuses and methods disclosed herein provide a reduced cost solution for at least the reason that the required man hours is significantly reduced for setting up cement forms for pouring a cement structure, such as a monolithic cement foundation. Further, the apparatuses and methods disclosed herein provide for improved insulation of a cement structure such as the monolithic cement foundation. The man hours required to install the insulation material is possibly non-existent since the cement forms themselves may include insulating material and be left in the ground after pouring the cement structure and covered to provide the insulating function.

At least some of the methods of manufacturing disclosed herein may provide for improved ease in creating the cement forms. The structure of the cement forms may provide improved storing, shipping, and handling with increased efficiency. Still further, at least some of the materials possible for use in the cement forms (e.g., foam materials) are significantly lighter weight than traditional cement forms. As a result, the cost of shipping and the amount of effort and/or energy required in maneuvering these cement forms of the present disclosure is significantly reduced thereby increasing the overall efficiency for using the cement form assemblies disclosed herein. Further, the use of foam as a primary material for the cement forms provides for a lighter weight object to be manually maneuvered at a work site, which may provide reduced incidence of workplace injuries such as back strains, pulled muscles, foot or leg crushing/bruising, and the like due that may otherwise occur when using traditional material for the cement forms.

Another advantage related to using foam or polymer materials as the primary (if not exclusive) material for the cement form is that such materials typically do not absorb moisture from the cement as the cement cures. Avoiding moisture absorption leads to improved consistency in how the cement cures as compared to using other materials for the cement forms such as wood. Wood cement forms have a high rate of moisture absorption, and are typically sprayed with a petroleum product such as diesel fuel just prior to pouring the cement in an effort to limit the moisture absorption properties of the wood. An improved consistency in how the cement cures may lead to reduced incidence of later cracking in the cement structure.

A further advantage relates to the ability to backfill around and/or over the cement forms prior to pouring cement. The pre-backfilling (i.e., prior to pouring cement) makes it possible to have excavation equipment on site just for digging and set up of the cement forms (i.e., the equipment does not have to return after pouring cement and removing the cement forms according to traditional methods), thereby decreasing costs and overall time for completing formation of a cement structure such as a monolithic foundation. Increasing the speed of forming a cement foundation typically results in an over decrease in the overall time for completion of a construction project, which leads to reduced costs and improved efficiencies. Providing a backfill prior to pouring also may involve grading the ground surface surrounding the cement forms. A graded surface may improve safety for workers during pouring of cement because the workers can work on a graded rather than having to work on uneven surface and/or working around kickers, stakes and brace boards as is required in traditional methods.

Additional advantages associated with the breakaway feature described herein is the ability to more easily modify the shape and/or size of portions of the cement form after forming the cement structure using the cement form. By pre-cutting or otherwise pre-forming one or more relief features in the cement form during manufacture, the breakaway portion may be removed using less force and/or may break off with a relatively clean break surface remaining on the cement form. By positioning the relief features at various locations on the cement form, it is possible to break off different sized and shaped portions. Some embodiments may include multiple pre-formed relief features that permit a user to selective choose the size and/or shape of the resulting portion that is broken off.

Further advantages are associated with an angled end of the cement form. The angled end portions permit assembly of multiple cement forms and inner inserts at predetermined orientations relative to each other (e.g., 90° or 60° angles). Providing pre-cut angles at the ends of the cement forms and inner inserts can also reduce the time required to assembly multiple cement forms and inner inserts together at a job site.

Both the cement form and the extension may have an elongated construction with a greater length (along a length of the cement structure) than width (laterally relative to a side of the cement structure) or height (relative to a height of the cement structure). The cement form and extension may be particularly suited for use in forming a building foundation, such as a monolithic building foundation, and remaining in place after formation of the foundation to provide a thermal barrier for the foundation.

Illustrative Embodiments

The following is a description of various embodiments of the disclosed subject matter. Each embodiment may include one or more of the various features, characteristics, or advantages of the disclosed subject matter. The embodiments are intended to illustrate a few aspects of the disclosed subject matter and should not be considered a comprehensive or exhaustive description of all possible embodiments.

P1. A cement form, comprising: a single piece, unitary body member having a solid, continuous construction and a wedge-shaped cross-section, the body member comprising: a first surface arranged vertically and configured to support a volume of cement during formation of a cement foundation; a second surface arranged horizontally and configured to contact a ground support surface; a foam material; an elongate construction with a greater length dimension in a horizontal direction than a height dimension in a vertical direction; a brick ledge portion extending from the first surface and configured to displace a portion of the volume of cement to form a brick ledge in the cement foundation, the brick ledge portion being removable after the volume of cement is cured while other portions of the cement form remain in place thereby providing access to the brick ledge in the cement foundation.

P2. The cement form of paragraph P1, wherein the brick ledge portion has a rectangular shape.

P3. The cement form of any one of paragraphs P1-P2, wherein the brick ledge portion is integrally formed as a single piece with at least the first surface of the cement form.

P4. The cement form of any one of paragraphs P1-P3, wherein the brick ledge portion is formed as a separate piece and releasably secured to the first surface in a separate assembly step prior to use of the cement form to create a cement foundation.

P5. The cement form of any one of paragraphs P1-P4, wherein the brick ledge portion is arranged at a top end of the cement form and defines at least in part an upper most surface of the cement form.

P6. The cement form of any one of paragraphs P1-P5, wherein the brick ledge portion extends horizontally from the first surface in a direction perpendicular to the first surface.

P7. The cement form of any one of paragraphs P1-P6, further comprising a weight-bearing surface positioned at an acute angle relative to the first and second surfaces, the weight-bearing surface facing at least in part in a vertical direction, the weight-bearing surface being arranged at an angle in the range of about 20° to about 60° relative to the second surface.

P8. The cement form of any one of paragraphs P1-P7, further comprising a connector groove extending along at least a portion of a length of the body member, the connector groove being configured to receive a connecting member that extends between adjacent positioned cement forms, the connector groove being open in a vertically upward direction and having a closed bottom end.

P9. A cement form, comprising: an elongate member, comprising: a wedge cross-sectional shape; a foam material; first and second ends and a length measured therebetween in a horizontal direction; a cement support surface extending vertically and configured to support a volume of cement used to create a cement foundation; a height measured in a vertical direction that is less than the length; a brick ledge portion configured to displace a portion of the volume of cement to form a brick ledge in the cement foundation, the brick ledge portion being removable after the volume of cement is cured thereby providing access to the brick ledge in the cement foundation.

P10. The cement form of paragraph P9, wherein the cement form, after removal of the brick ledge portion, remains in place after the volume of cement cures.

P11. The cement form of any one of paragraphs P9-P10, wherein the brick ledge portion extends from the cement support surface in a direction perpendicular to the cement support surface.

P12. The cement form of any one of paragraphs P9-P11, wherein the brick ledge portion has a rectangular shape.

P13. The cement form of any one of paragraphs P9-P12, further comprising at least one relief cut formed in the cement form at a boundary of the brick ledge portion, the at least one relief cut facilitating disconnection of the brick ledge portion from the cement form.

P14. The cement form of paragraph P13, wherein the at least one relief cut includes first and second relief cuts arranged within a horizontal plane.

P15. The cement form of any one of paragraphs P9-P14, wherein the elongate member further comprises a connector groove extending along the length of the elongate member and spaced away from the cement support surface, the connector groove being open in a vertical direction and sized to receive a connecting member that spans between adjacent positioned cement forms.

P16. A cement form configured for use in forming a cement foundation, comprising: a single piece foam member comprising: first and second ends, and a length measured between the first and second ends; a cement support surface oriented vertically and arranged to support a volume of cement, the cement support surface defining a height of the cement form, the height being less than the length, the cement support surface having a brick ledge portion configured to displace a portion of the volume of cement to form a brick ledge in the cement foundation; a connector groove extending along the length, the connector groove being sized to receive a connector member that interconnects adjacent positioned cement forms.

P17. The cement form of paragraph P16, wherein the brick ledge portion is removable from remaining portion of the cement form after the volume of cement is cured.

P18. The cement form of any one of paragraphs P16-P17, further comprising at least one relief cut positioned at an edge of the brick ledge portion, the relief cut facilitating removal of the brick ledge portion after the volume of cement is cured.

P19. A method of forming a cement foundation, comprising: positioning a foam cement form on a ground surface, the cement form having a brick ledge portion extending from a cement supporting surface of the cement form; supporting a volume of cement against the cement supporting surface and the brick ledge portion; after the volume of cement is at least partially cured, removing the brick ledge portion from the cement form to expose a brick ledge in the cement foundation, the brick ledge being configured to support a plurality of bricks along an edge of the cement foundation.

P20. The cement form of paragraph P19, wherein the brick ledge portion has a rectangular shape to form the brick ledge with a right angle shape.

P21. The cement form of any one of paragraphs P19-P20, wherein the cement form includes at least one relief cut, and removing the brick ledge portion includes breaking off the brick ledge portion at the at least one relief cut.

P22. The cement form of any one of paragraphs P19-P21, wherein the cement supporting surface is arranged parallel with a vertical plane, the cement form including a ground support surface arranged perpendicular to the cement supporting surface and facing a ground surface upon which the cement form is supported.

P23. The cement form of any one of paragraphs P19-P22, wherein the cement form includes a connector groove extending along a length of the cement form in a horizontal direction, the method including inserting a connector member into the connector groove to interconnect adjacent positioned cement forms.

General Terminology and Interpretative Conventions

Any methods described in the claims or specification should not be interpreted to require the steps to be performed in a specific order unless expressly stated otherwise. Also, the methods should be interpreted to provide support to perform the recited steps in any order unless expressly stated otherwise.

Certain features described in the context of separate embodiments can also be implemented in combination in a single embodiment. Conversely, various features that are described in the context of a single embodiment can also be implemented in multiple embodiments separately or in any suitable subcombination. Moreover, although features may be described above in certain combinations and even initially claimed as such, one or more features from a claimed combination can be excised from the combination, and the claimed combination may be directed to a subcombination or variation of a subcombination.

The example configurations described in this document do not represent all the examples that may be implemented or that are within the scope of the claims. The term "example" shall be interpreted to mean "serving as an example, instance, or illustration," and not "preferred" or "advantageous over other examples."

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The phrase "based on" shall be interpreted to refer to an open set of conditions unless unequivocally stated otherwise (e.g., based on only a given condition). For example, a step described as being based on a given condition may be based on the recited condition and one or more unrecited conditions.

The terms have, having, contain, containing, include, including, and characterized by should be interpreted to be synonymous with the terms comprise and comprising—i.e., the terms are inclusive or open-ended and do not exclude additional unrecited subject matter. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any subranges or any individual values subsumed by each range. For example, a stated range of 1 to 10 should be considered to include and provide support for claims that recite any subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth), which values can be expressed alone or as a minimum value (e.g., at least 5.8) or a maximum value (e.g., no more than 9.9994).

All disclosed numerical values are to be understood as being variable from 0-100% in either direction and thus provide support for claims that recite such values (either alone or as a minimum or a maximum—e.g., at least <value> or no more than <value>) or any ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range expressed individually (e.g., 15.2), as a minimum value (e.g., at least 4.3), or as a maximum value (e.g., no more than 12.4).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described.

Joining or Fastening Terminology and Interpretative Conventions

The term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The term "coupled" includes joining that is permanent in nature or releasable and/or removable in nature. Permanent joining refers to joining the components together in a manner that is not capable of being reversed or returned to the original condition. Releasable joining refers to joining the components together in a manner that is capable of being reversed or returned to the original condition.

Releasable joining can be further categorized based on the difficulty of releasing the components and/or whether the components are released as part of their ordinary operation and/or use. Readily or easily releasable joining refers to joining that can be readily, easily, and/or promptly released with little or no difficulty or effort. Difficult or hard to release joining refers to joining that is difficult, hard, or arduous to release and/or requires substantial effort to release. The joining can be released or intended to be released as part of the ordinary operation and/or use of the components or only in extraordinary situations and/or circumstances. In the latter case, the joining can be intended to remain joined for a long, indefinite period until the extraordinary circumstances arise.

It should be appreciated that the components can be joined together using any type of fastening method and/or fastener. The fastening method refers to the way the components are joined. A fastener is generally a separate component used in a mechanical fastening method to mechanically join the components together. A list of examples of fastening methods and/or fasteners are given below. The list is divided according to whether the fastening method and/or fastener is generally permanent, readily released, or difficult to release.

Examples of permanent fastening methods include welding, soldering, brazing, crimping, riveting, stapling, stitching, some types of nailing, some types of adhering, and some types of cementing. Examples of permanent fasteners include some types of nails, some types of dowel pins, most types of rivets, most types of staples, stitches, most types of structural ties, and toggle bolts.

Examples of readily releasable fastening methods include clamping, pinning, clipping, latching, clasping, buttoning, zipping, buckling, and tying. Examples of readily releasable fasteners include snap fasteners, retainer rings, circlips, split pin, linchpins, R-pins, clevis fasteners, cotter pins, latches, hook and loop fasteners (VELCRO), hook and eye fasteners, push pins, clips, clasps, clamps, zip ties, zippers, buttons, buckles, split pin fasteners, and/or conformat fasteners.

Examples of difficult to release fastening methods include bolting, screwing, most types of threaded fastening, and some types of nailing. Examples of difficult to release fasteners include bolts, screws, most types of threaded fasteners, some types of nails, some types of dowel pins, a few types of rivets, a few types of structural ties.

It should be appreciated that the fastening methods and fasteners are categorized above based on their most common configurations and/or applications. The fastening methods and fasteners can fall into other categories or multiple categories depending on their specific configurations and/or applications. For example, rope, string, wire, cable, chain, and the like can be permanent, readily releasable, or difficult to release depending on the application.

Drawing Related Terminology and Interpretative Conventions

Reference numbers in the drawings and corresponding description refer to identical or similar elements although such numbers may be referenced in the context of different embodiments.

The drawings are intended to illustrate embodiments that are both drawn to scale and/or not drawn to scale. This means the drawings can be interpreted, for example, as showing: (a) everything drawn to scale, (b) nothing drawn to scale, or (c) one or more features drawn to scale and one or more features not drawn to scale. Accordingly, the drawings can serve to provide support to recite the sizes, proportions, and/or other dimensions of any of the illustrated features either alone or relative to each other. Furthermore, all such sizes, proportions, and/or other dimensions are to be understood as being variable from 0-100% in either direction and thus provide support for claims that recite such values or any ranges or subranges that can be formed by such values.

Spatial or directional terms, such as "left," "right," "front," "back," and the like, relate to the subject matter as it is shown in the drawings and/or how it is commonly oriented during manufacture, use, or the like. However, it is to be understood that the described subject matter may assume various alternative orientations and, accordingly, such terms are not to be considered as limiting.

Incorporation by Reference

The entire content of each document listed below is incorporated by reference into this document (the documents below are collectively referred to as the "incorporated documents"). If the same term is used in both this document and one or more of the incorporated documents, then it should be interpreted to have the broadest meaning imparted by any one or combination of these sources unless the term has been explicitly defined to have a different meaning in this document. If there is an inconsistency between any incorporated document and this document, then this document shall govern. The incorporated subject matter should not be used to limit or narrow the scope of the explicitly recited or depicted subject matter.

Priority patent documents incorporated by reference:

U.S. Prov. App. No. 63/021,221, titled "Cement Form with Brick Ledge," filed on 7 May 2021.

Additional documents incorporated by reference:

U.S. Pat. Pub. No. 2020/0115878 (application Ser. No. 16/713,517), titled "Cement Form Apparatus and Method," filed on 13 Dec. 2019, published on 16 Apr. 2020.

U.S. Pat. No. 10,920,391 (application Ser. No. 16/034,902), titled "Cement Form with Breakaway Portion," filed on 13 Jul. 2018, issued on 16 Feb. 2021.

U.S. Pat. Pub. No. 2021/0079669 (application Ser. No. 16/571,496), titled "Cement Form with Extension," filed on 16 Sep. 2019, published on 18 Mar. 2021.

The invention claimed is:

1. A cement form comprising:

a ground facing surface extending horizontally and configured to contact a ground surface;

a cement facing surface extending vertically and configured to contact and support a volume of cement used to create a cement foundation; and a connector groove extending along at least a portion of a length of the cement form, the connector groove being configured to receive a connecting member that extends between adjacent positioned cement forms, the connector groove being open in a vertically upward direction and having a closed bottom end, wherein the cement facing surface includes two vertical surfaces offset horizontally from each other, and the cement facing surface is configured to form a brick ledge in the cement foundation;

wherein the cement form has an elongated shape and a solid, continuous construction; and wherein the cement form includes a foam material that forms at least a portion of the cement facing surface.

2. The cement form of claim 1 wherein the cement facing surface is configured to form a right angle in the volume of cement.

3. The cement form of claim 1 comprising a brick ledge portion forming one of the two vertical surfaces in the cement facing surface, the brick ledge portion being shaped to form the brick ledge in the cement foundation.

4. The cement form of claim 3 wherein the brick ledge portion is an integral component of the cement form.

5. The cement form of claim 3 wherein the brick ledge portion is releasably coupled to the other one of the two vertical surfaces in the cement facing surface.

6. The cement form of claim 3 wherein the brick ledge portion is positioned at the top of the cement form and defines at least in part an upper most surface of the cement form.

7. The cement form of claim 1 wherein the cement facing surface includes a horizontal surface extending between the two vertical surfaces.

8. The cement form of claim 1 further comprising a weight-bearing surface positioned at an angle relative to the ground facing surface and the cement facing surface, the weight-bearing surface being positioned at an angle in the range of about 20° to about 60° relative to the ground facing surface.

9. A cement foundation comprising:

a volume of cement; and a cement form comprising:

a ground facing surface extending horizontally on a ground surface;

a cement facing surface extending vertically in contact with and supporting the volume of cement, the cement facing surface including two vertical surfaces offset horizontally from each other to form a brick ledge in the cement foundation; and a connector groove extending lengthwise along at least a portion of the cement form and spaced away from the cement facing surface, the connector groove being open in a vertical direction and sized to receive a connecting member that spans between adjacent cement forms, wherein the cement form has an elongated shape and a solid, continuous construction; and wherein the cement form includes a foam material that forms at least a portion of the cement facing surface.

10. The cement foundation of claim 9 wherein the cement form comprises a brick ledge portion forming one of the two vertical surfaces in the cement facing surface, the brick ledge portion forming the brick ledge in the cement foundation.

11. The cement foundation of claim 10 wherein the brick ledge portion is positioned at the top of the cement form.

12. The cement foundation of claim 10 further comprising at least one relief cut formed in the cement form at a boundary of the brick ledge portion, the at least one relief cut facilitating removal of the brick ledge portion from the cement form.

13. The cement foundation of claim 12 wherein the at least one relief cut includes first and second relief cuts arranged within a horizontal plane.

14. The cement foundation of claim 9 wherein the cement facing surface forms a right angle in the volume of cement.

15. A method of forming a cement foundation comprising:

positioning a foam cement form on a ground surface, the cement form having a cement facing surface including a brick ledge portion and a connector groove extending along a length of the cement form in a horizontal direction;

inserting a connector member into the connector groove to interconnect adjacent positioned cement forms;

positioning a volume of cement against the cement facing surface and the brick ledge portion; and removing the brick ledge portion from the cement form to expose a brick ledge in the cement foundation, the brick ledge being configured to support a plurality of bricks along an edge of the cement foundation.

16. The method of claim 15 wherein the brick ledge portion has a rectangular shape to form the brick ledge with a right angle shape.

17. The method of claim 15 wherein the cement form includes at least one relief cut, and removing the brick ledge portion includes breaking off the brick ledge portion at the at least one relief cut.

* * * * *